US011173383B2

(12) United States Patent
Krenn et al.

(10) Patent No.: US 11,173,383 B2
(45) Date of Patent: Nov. 16, 2021

(54) CARD-HANDLING DEVICES AND RELATED METHODS, ASSEMBLIES, AND COMPONENTS

(71) Applicant: SG Gaming, Inc., Las Vegas, NV (US)

(72) Inventors: Peter Krenn, Neufeld (AT); Paul K. Scheper, Bloomington, MN (US)

(73) Assignee: SG Gaming, Inc., Las Vegas, NV (US)

( * ) Notice: Subject to any disclaimer, the term of this patent is extended or adjusted under 35 U.S.C. 154(b) by 0 days.

(21) Appl. No.: 17/064,259

(22) Filed: Oct. 6, 2020

(65) Prior Publication Data

US 2021/0101071 A1 Apr. 8, 2021

Related U.S. Application Data

(60) Provisional application No. 62/911,907, filed on Oct. 7, 2019.

(51) Int. Cl.
*A63F 1/12* (2006.01)
*A63F 1/14* (2006.01)

(52) U.S. Cl.
CPC . *A63F 1/12* (2013.01); *A63F 1/14* (2013.01)

(58) Field of Classification Search
CPC ..... A63F 1/12; A63F 1/14
USPC ..... 273/149 R
See application file for complete search history.

(56) References Cited

U.S. PATENT DOCUMENTS 130,281 A 8/1872 Coughlin
205,030 A 6/1878 Ash
609,730 A 8/1898 Booth
673,154 A 4/1901 Bellows
793,489 A 6/1905 Caleb
892,389 A 7/1908 Bellows
1,014,219 A 1/1912 Hall
1,043,109 A 11/1912 Horace
1,157,898 A 10/1915 Perret
1,256,509 A 2/1918 Belknap
1,380,898 A 6/1921 Charles
1,556,856 A 10/1925 Lipps
1,757,553 A 5/1930 Tauschek
1,850,114 A 3/1932 McCaddin
(Continued)

FOREIGN PATENT DOCUMENTS

AU 2383667 A 1/1969
AU 5025479 A 3/1980
(Continued)

OTHER PUBLICATIONS

PCT International Search Report and Written Opinion, PCT Application No. PCT/US2015/051038, dated Jan. 22, 2016, 11 pages.
(Continued)

*Primary Examiner* — Alvin A Hunter
(74) *Attorney, Agent, or Firm* — TraskBritt

(57) ABSTRACT

A card-handling device may include a card intake, a card output, a card imaging device positioned between the card intake and the card output. The card imaging device may be configured to identify a non-conforming card. The card-handling device may be configured to store the non-conforming card in a designated location and/or to reorient the non-conforming card with a card-flipping apparatus configured to reorient flipped cards identified as non-conforming cards.

22 Claims, 20 Drawing Sheets

(56) References Cited

U.S. PATENT DOCUMENTS

| | | | |
|---|---|---|---|
| 1,885,276 | A | 11/1932 | McKay |
| 1,889,729 | A | 11/1932 | Hammond |
| 1,955,926 | A | 4/1934 | Matthaey |
| 1,992,085 | A | 2/1935 | McKay |
| 1,998,690 | A | 4/1935 | William et al. |
| 2,001,220 | A | 5/1935 | Smith |
| 2,001,918 | A | 5/1935 | Nevius |
| 2,016,030 | A | 10/1935 | Woodruff et al. |
| 2,043,343 | A | 6/1936 | Warner |
| 2,060,096 | A | 11/1936 | McCoy |
| 2,065,824 | A | 12/1936 | Plass |
| 2,159,958 | A | 5/1939 | Sachs |
| 2,185,474 | A | 1/1940 | Nott |
| 2,254,484 | A | 9/1941 | Hutchins |
| D132,360 | S | 5/1942 | Gardner |
| 2,282,040 | A | 5/1942 | Doran |
| 2,328,153 | A | 8/1943 | Laing |
| 2,328,879 | A | 9/1943 | Issacson |
| D139,530 | S | 11/1944 | Schindler |
| 2,364,413 | A | 12/1944 | Wittel |
| 2,525,305 | A | 10/1950 | Lombard |
| 2,543,522 | A | 2/1951 | Cohen |
| 2,588,582 | A | 3/1952 | Sivertson |
| 2,615,719 | A | 10/1952 | Fonken |
| 2,659,607 | A | 11/1953 | Skillman et al. |
| 2,661,215 | A | 12/1953 | Stevens |
| 2,676,020 | A | 4/1954 | Ogden |
| 2,692,777 | A | 10/1954 | Miller |
| 2,701,720 | A | 2/1955 | Ogden |
| 2,705,638 | A | 4/1955 | Newcomb |
| 2,711,319 | A | 6/1955 | Earl et al. |
| 2,714,510 | A | 8/1955 | Oppenlander et al. |
| 2,717,782 | A | 9/1955 | Droll |
| 2,727,747 | A | 12/1955 | Semisch, Jr. |
| 2,731,271 | A | 1/1956 | Brown |
| 2,747,877 | A | 5/1956 | Joseph |
| 2,755,090 | A | 7/1956 | Aldrich |
| 2,757,005 | A | 7/1956 | Nothaft |
| 2,760,779 | A | 8/1956 | Ogden et al. |
| 2,770,459 | A | 11/1956 | Wilson et al. |
| 2,778,643 | A | 1/1957 | Williams |
| 2,778,644 | A | 1/1957 | Stephenson |
| 2,782,040 | A | 2/1957 | Matter |
| 2,790,641 | A | 4/1957 | Adams |
| 2,793,863 | A | 5/1957 | Liebelt |
| 2,815,214 | A | 12/1957 | Hall |
| 2,821,399 | A | 1/1958 | Heinoo |
| 2,914,215 | A | 11/1959 | Neidig |
| 2,937,739 | A | 5/1960 | Moise |
| 2,950,005 | A | 8/1960 | MacDonald |
| RE24,986 | E | 5/1961 | Stephenson |
| 3,067,885 | A | 12/1962 | Kohler |
| 3,107,096 | A | 10/1963 | Osborn |
| 3,124,674 | A | 3/1964 | Edwards et al. |
| 3,131,935 | A | 5/1964 | Gronneberg |
| 3,147,978 | A | 9/1964 | Hjalmar |
| D200,652 | S | 3/1965 | Fisk |
| 3,185,482 | A | 5/1965 | Russell |
| 3,222,071 | A | 12/1965 | Lang |
| 3,235,741 | A | 2/1966 | Plaisance |
| 3,288,308 | A | 11/1966 | Gingher |
| 3,305,237 | A | 2/1967 | Granius |
| 3,312,473 | A | 4/1967 | Friedman et al. |
| 3,452,509 | A | 7/1969 | Werner |
| 3,530,968 | A | 9/1970 | Palmer |
| 3,588,116 | A | 6/1971 | Kosaburo |
| 3,589,730 | A | 6/1971 | Slay |
| 3,595,388 | A | 7/1971 | Castaldi |
| 3,597,076 | A | 8/1971 | Hubbard et al. |
| 3,598,396 | A | 8/1971 | Andrews et al. |
| 3,618,933 | A | 11/1971 | Roggenstein et al. |
| 3,627,331 | A | 12/1971 | Erickson |
| 3,666,270 | A | 5/1972 | Mazur |
| 3,680,853 | A | 8/1972 | Houghton et al. |
| 3,690,670 | A | 9/1972 | Cassady et al. |
| 3,704,938 | A | 12/1972 | Fanselow |
| 3,716,238 | A | 2/1973 | Porter |
| 3,751,041 | A | 8/1973 | Seifert |
| 3,761,079 | A | 9/1973 | Azurel |
| 3,810,627 | A | 5/1974 | Levyd |
| D232,953 | S | 9/1974 | Shigeo |
| 3,861,261 | A | 1/1975 | Maxey |
| 3,897,954 | A | 8/1975 | Erickson et al. |
| 3,899,178 | A | 8/1975 | Watanabe |
| 3,909,002 | A | 9/1975 | Levy |
| 3,929,339 | A | 12/1975 | Mattioli |
| 3,944,077 | A | 3/1976 | Green |
| 3,944,230 | A | 3/1976 | Fineman |
| 3,949,219 | A | 4/1976 | Crouse |
| 3,968,364 | A | 7/1976 | Miller |
| 3,981,163 | A | 9/1976 | Tillotson |
| 4,023,705 | A | 5/1977 | Reiner et al. |
| 4,033,590 | A | 7/1977 | Pic |
| 4,072,930 | A | 2/1978 | Lucero et al. |
| 4,088,265 | A | 5/1978 | Garczynski |
| 4,151,410 | A | 4/1979 | McMillan et al. |
| 4,159,581 | A | 7/1979 | Lichtenberg |
| 4,162,649 | A | 7/1979 | Thornton |
| 4,166,615 | A | 9/1979 | Kurokawa et al. |
| 4,232,861 | A | 11/1980 | Maul |
| 4,280,690 | A | 7/1981 | Hill |
| 4,283,709 | A | 8/1981 | Lucero et al. |
| 4,310,160 | A | 1/1982 | Willette et al. |
| 4,339,134 | A | 7/1982 | Macheel |
| 4,339,798 | A | 7/1982 | Hedges et al. |
| 4,361,393 | A | 11/1982 | Noto |
| 4,368,972 | A | 1/1983 | Naramore |
| 4,369,972 | A | 1/1983 | Parker |
| 4,374,309 | A | 2/1983 | Walton |
| 4,377,285 | A | 3/1983 | Kadlic |
| 4,385,827 | A | 5/1983 | Naramore |
| 4,388,994 | A | 6/1983 | Suda et al. |
| 4,397,469 | A | 8/1983 | Carter, III |
| 4,421,312 | A | 12/1983 | Delgado et al. |
| 4,421,501 | A | 12/1983 | Scheffer |
| D273,962 | S | 5/1984 | Fromm |
| D274,069 | S | 5/1984 | Fromm |
| 4,457,512 | A | 7/1984 | Stevenson |
| 4,467,424 | A | 8/1984 | Hedges et al. |
| 4,494,197 | A | 1/1985 | Troy et al. |
| 4,497,488 | A | 2/1985 | Plevyak et al. |
| 4,512,580 | A | 4/1985 | Matviak |
| 4,513,969 | A | 4/1985 | Samsel, Jr. |
| 4,515,367 | A | 5/1985 | Howard |
| 4,531,187 | A | 7/1985 | Uhland |
| 4,534,562 | A | 8/1985 | Cuff et al. |
| 4,549,738 | A | 10/1985 | Greitzer |
| 4,566,782 | A | 1/1986 | Britt et al. |
| 4,575,367 | A | 3/1986 | Karmel |
| 4,586,712 | A | 5/1986 | Lorber et al. |
| 4,659,082 | A | 4/1987 | Greenberg |
| 4,662,637 | A | 5/1987 | Pfeiffer |
| 4,662,816 | A | 5/1987 | Fabrig |
| 4,667,959 | A | 5/1987 | Pfeiffer et al. |
| 4,741,524 | A | 5/1988 | Bromage |
| 4,750,743 | A | 6/1988 | Nicoletti |
| 4,755,941 | A | 7/1988 | Bacchi |
| 4,759,448 | A | 7/1988 | Kawabata |
| 4,770,412 | A | 9/1988 | Wolfe |
| 4,770,421 | A | 9/1988 | Hoffman |
| 4,807,884 | A | 2/1989 | Breeding |
| 4,822,050 | A | 4/1989 | Normand et al. |
| 4,832,342 | A | 5/1989 | Plevyak et al. |
| 4,858,000 | A | 8/1989 | Lu |
| 4,861,041 | A | 8/1989 | Jones et al. |
| 4,876,000 | A | 10/1989 | Mikhail |
| 4,900,009 | A | 2/1990 | Kitahara et al. |
| 4,904,830 | A | 2/1990 | Rizzuto |
| 4,921,109 | A | 5/1990 | Hasuo et al. |
| 4,926,327 | A | 5/1990 | Sidley |
| 4,948,134 | A | 8/1990 | Suttle et al. |
| 4,951,950 | A | 8/1990 | Normand et al. |
| 4,969,648 | A | 11/1990 | Hollinger et al. |
| 4,993,587 | A | 2/1991 | Abe |

(56) References Cited

U.S. PATENT DOCUMENTS 4,995,615 A 2/1991 Cheng
5,000,453 A 3/1991 Stevens et al.
5,004,218 A 4/1991 Sardano et al.
5,039,102 A 8/1991 Arthur
5,067,713 A 11/1991 Soules et al.
5,078,405 A 1/1992 Jones et al.
5,081,487 A 1/1992 Hoyer et al.
5,096,197 A 3/1992 Embury
5,102,293 A 4/1992 Schneider
5,118,114 A 6/1992 Tucci
5,121,192 A 6/1992 Kazui
5,121,921 A 6/1992 Friedman et al.
5,146,346 A 9/1992 Knoll
5,154,429 A 10/1992 Levasseur
5,179,517 A 1/1993 Sarbin et al.
5,197,094 A 3/1993 Tillery et al.
5,199,710 A 4/1993 Lamle
5,209,476 A 5/1993 Eiba
5,224,712 A 7/1993 Laughlin et al.
5,240,140 A 8/1993 Huen
5,248,142 A 9/1993 Breeding
5,257,179 A 10/1993 Demar
5,259,907 A 11/1993 Soules et al.
5,261,667 A 11/1993 Breeding
5,267,248 A 11/1993 Reyner
5,275,411 A 1/1994 Breeding
5,276,312 A 1/1994 McCarthy
5,283,422 A 2/1994 Storch et al.
5,288,081 A 2/1994 Breeding
5,299,089 A 3/1994 Lwee
5,303,921 A 4/1994 Breeding
5,344,146 A 9/1994 Lee
5,356,145 A 10/1994 Verschoor
5,362,053 A 11/1994 Miller
5,374,061 A 12/1994 Albrecht
5,377,973 A 1/1995 Jones et al.
5,382,024 A 1/1995 Ernst
5,382,025 A 1/1995 Sklansky et al.
5,390,910 A 2/1995 Mandel et al.
5,397,128 A 3/1995 Hesse et al.
5,397,133 A 3/1995 Penzias
5,416,308 A 5/1995 Hood et al.
5,431,399 A 7/1995 Kelley
5,431,407 A 7/1995 Hofberg et al.
5,437,462 A 8/1995 Breeding
5,445,377 A 8/1995 Steinbach
5,470,079 A 11/1995 Lestrange et al.
D365,853 S 1/1996 Zadro
5,489,101 A 2/1996 Moody
5,515,477 A 5/1996 Sutherland
5,524,888 A 6/1996 Heidel
5,531,448 A 7/1996 Moody
5,544,892 A 8/1996 Breeding
5,575,475 A 11/1996 Steinbach
5,584,483 A 12/1996 Sines et al.
5,586,766 A 12/1996 Forte et al.
5,586,936 A 12/1996 Bennett et al.
5,605,334 A 2/1997 McCrea, Jr.
5,613,912 A 3/1997 Slater
5,632,483 A 5/1997 Garczynski et al.
5,636,843 A 6/1997 Roberts
5,651,548 A 7/1997 French et al.
5,655,961 A 8/1997 Acres et al.
5,655,966 A 8/1997 Werdin et al.
5,669,816 A 9/1997 Garczynski et al.
5,676,231 A 10/1997 Legras et al.
5,676,372 A 10/1997 Sines et al.
5,681,039 A 10/1997 Miller
5,683,085 A 11/1997 Johnson et al.
5,685,543 A 11/1997 Garner
5,690,324 A 11/1997 Otomo et al.
5,692,748 A 12/1997 Frisco et al.
5,695,189 A 12/1997 Breeding et al.
5,701,565 A 12/1997 Morgan
5,707,286 A 1/1998 Carlson
5,707,287 A 1/1998 McCrea, Jr.
5,711,525 A 1/1998 Breeding
5,718,427 A 2/1998 Cranford et al.
5,719,288 A 2/1998 Sens et al.
5,720,484 A 2/1998 Hsu
5,722,893 A 3/1998 Hill et al.
5,735,525 A 4/1998 McCrea, Jr.
5,735,724 A 4/1998 Udagawa
5,735,742 A 4/1998 French
5,743,798 A 4/1998 Adams et al.
5,768,382 A 6/1998 Schneier et al.
5,770,533 A 6/1998 Franchi
5,770,553 A 6/1998 Kroner et al.
5,772,505 A 6/1998 Garczynski et al.
5,779,546 A 7/1998 Meissner et al.
5,781,647 A 7/1998 Fishbine et al.
5,785,321 A 7/1998 Van et al.
5,788,574 A 8/1998 Ornstein et al.
5,791,988 A 8/1998 Nomi
5,802,560 A 9/1998 Joseph et al.
5,803,808 A 9/1998 Strisower
5,810,355 A 9/1998 Trilli
5,813,326 A 9/1998 Salomon
5,813,912 A 9/1998 Shultz
5,814,796 A 9/1998 Benson et al.
5,836,775 A 11/1998 Hiyama et al.
5,839,730 A 11/1998 Russell
5,845,906 A 12/1998 Wirth
5,851,011 A 12/1998 Lott
5,867,586 A 2/1999 Liang
5,879,233 A 3/1999 Stupero
5,883,804 A 3/1999 Christensen
5,890,717 A 4/1999 Rosewarne et al.
5,892,210 A 4/1999 Levasseur
5,909,876 A 6/1999 Brown
5,911,626 A 6/1999 McCrea, Jr.
5,919,090 A 7/1999 Mothwurf
D412,723 S 8/1999 Hachuel et al.
5,936,222 A 8/1999 Korsunsky et al.
5,941,769 A 8/1999 Order
5,944,310 A 8/1999 Johnson et al.
D414,527 S 9/1999 Tedham
5,957,776 A 9/1999 Hoehne
5,974,150 A 10/1999 Kaish et al.
5,989,122 A * 11/1999 Roblejo ..... A63F 1/14
273/149 P
5,991,308 A 11/1999 Fuhrmann et al.
6,015,311 A 1/2000 Benjamin et al.
6,019,368 A 2/2000 Sines et al.
6,019,374 A 2/2000 Breeding
6,039,650 A 3/2000 Hill
6,050,569 A 4/2000 Taylor
6,053,695 A 4/2000 Longoria et al.
6,061,449 A 5/2000 Candelore et al.
6,068,258 A 5/2000 Breeding et al.
6,069,564 A 5/2000 Hatano et al.
6,071,190 A 6/2000 Weiss et al.
6,093,103 A 7/2000 McCrea, Jr.
6,113,101 A 9/2000 Wirth
6,117,012 A 9/2000 McCrea, Jr.
6,123,010 A 9/2000 Blackstone
D432,588 S 10/2000 Tedham
6,126,166 A 10/2000 Lorson et al.
6,131,817 A 10/2000 Miller
6,139,014 A 10/2000 Breeding et al.
6,149,154 A 11/2000 Grauzer et al.
6,154,131 A 11/2000 Jones et al.
6,165,069 A 12/2000 Sines et al.
6,165,072 A 12/2000 Davis et al.
6,183,362 B1 2/2001 Boushy
6,186,895 B1 2/2001 Oliver
6,196,416 B1 3/2001 Seagle
6,200,218 B1 3/2001 Lindsay
6,210,274 B1 4/2001 Carlson
6,213,310 B1 4/2001 Wennersten et al.
6,217,447 B1 4/2001 Lofink et al.
6,234,900 B1 5/2001 Cumbers
6,236,223 B1 5/2001 Brady et al.
6,250,632 B1 6/2001 Albrecht

(56) References Cited

U.S. PATENT DOCUMENTS 6,254,002 B1 7/2001 Litman
6,254,096 B1 7/2001 Grauzer et al.
6,254,484 B1 7/2001 McCrea, Jr.
6,257,981 B1 7/2001 Acres et al.
6,267,248 B1 7/2001 Johnson et al.
6,267,648 B1 7/2001 Katayama et al.
6,267,671 B1 7/2001 Hogan
6,270,404 B2 8/2001 Sines et al.
6,272,223 B1 8/2001 Carlson
6,293,546 B1 9/2001 Hessing et al.
6,293,864 B1 9/2001 Romero
6,299,167 B1 10/2001 Sines et al.
6,299,534 B1 10/2001 Breeding et al.
6,299,536 B1 10/2001 Hill
6,308,886 B1 10/2001 Benson et al.
6,313,871 B1 11/2001 Schubert
6,325,373 B1 12/2001 Breeding et al.
6,334,614 B1 1/2002 Breeding
6,341,778 B1 1/2002 Lee
6,342,830 B1 1/2002 Want et al.
6,346,044 B1 2/2002 McCrea, Jr.
6,361,044 B1 3/2002 Block et al.
6,386,973 B1 5/2002 Yoseloff
6,402,142 B1 6/2002 Warren et al.
6,446,864 B1 9/2002 Kim et al.
6,454,266 B1 9/2002 Breeding et al.
6,460,848 B1 10/2002 Soltys et al.
6,464,584 B2 10/2002 Oliver
6,490,277 B1 12/2002 Tzotzkov
6,508,709 B1 1/2003 Karmarkar
6,514,140 B1 2/2003 Storch
6,517,435 B2 2/2003 Soltys et al.
6,517,436 B2 2/2003 Soltys et al.
6,527,271 B2 3/2003 Soltys et al.
6,530,836 B2 3/2003 Soltys et al.
6,532,297 B1 3/2003 Lindquist
6,533,276 B2 3/2003 Soltys et al.
6,533,662 B2 3/2003 Soltys et al.
6,543,770 B1 4/2003 Kaji et al.
6,561,897 B1 5/2003 Bourbour et al.
6,579,180 B2 6/2003 Soltys et al.
6,579,181 B2 6/2003 Soltys et al.
6,581,747 B1 6/2003 Charlier et al.
6,582,301 B2 6/2003 Hill
6,582,302 B2 6/2003 Romero
6,585,586 B1 7/2003 Romero
6,585,588 B2 7/2003 Hartl
6,585,856 B2 7/2003 Zwick et al.
6,588,750 B1 7/2003 Grauzer et al.
6,588,751 B1 7/2003 Grauzer et al.
6,595,857 B2 7/2003 Soltys et al.
6,609,710 B1 8/2003 Order
6,612,928 B1 9/2003 Bradford et al.
6,616,535 B1 9/2003 Nishizaki et al.
6,619,662 B2 9/2003 Miller
6,622,185 B1 9/2003 Johnson et al.
6,626,757 B2 9/2003 Oliveras
6,629,019 B2 9/2003 Legge et al.
6,629,591 B1 10/2003 Griswold et al.
6,629,889 B2 10/2003 Mothwurf
6,629,894 B1 10/2003 Purton
6,637,622 B1 10/2003 Robinson
6,645,068 B1 11/2003 Kelly et al.
6,645,077 B2 11/2003 Rowe
6,651,985 B2 11/2003 Sines et al.
6,652,379 B2 11/2003 Soltys et al.
6,655,690 B1 12/2003 Anthony
6,658,135 B1 12/2003 Morito et al.
6,659,460 B2 12/2003 Blaha et al.
6,659,461 B2 12/2003 Yoseloff et al.
6,659,875 B2 12/2003 Purton
6,663,490 B2 12/2003 Soltys et al.
6,666,768 B1 12/2003 Akers
6,671,358 B1 12/2003 Seidman et al.
6,676,517 B2 1/2004 Anthony
6,680,843 B2 1/2004 Farrow et al.
6,685,564 B2 2/2004 Oliver
6,685,567 B2 2/2004 Cockerille et al.
6,685,568 B2 2/2004 Soltys et al.
6,688,597 B2 2/2004 Jones
6,688,979 B2 2/2004 Soltys et al.
6,690,673 B1 2/2004 Jarvis
6,698,756 B1 * 3/2004 Baker ..... A63F 1/12 273/149 R
6,698,759 B2 3/2004 Webb et al.
6,702,289 B1 3/2004 Feola
6,702,290 B2 3/2004 Buono-Correa et al.
6,709,333 B1 3/2004 Bradford et al.
6,719,634 B2 4/2004 Mishina et al.
6,722,974 B2 4/2004 Sines et al.
6,729,205 B2 5/2004 Phillips
6,732,067 B1 5/2004 Powderly
6,733,012 B2 5/2004 Bui et al.
6,733,388 B2 5/2004 Ewald
6,746,333 B1 6/2004 Onda et al.
6,747,560 B2 6/2004 Stevens, III
6,758,751 B2 7/2004 Soltys et al.
6,758,757 B2 7/2004 Luciano et al.
6,769,693 B2 8/2004 Huard et al.
6,774,782 B2 8/2004 Runyon et al.
6,789,801 B2 9/2004 Snow
6,802,510 B1 10/2004 Haber
6,804,763 B1 10/2004 Stockdale et al.
6,808,173 B2 10/2004 Snow
6,827,282 B2 12/2004 Silverbrook
6,834,251 B1 12/2004 Fletcher
6,840,517 B2 1/2005 Snow et al.
6,842,263 B1 1/2005 Saeki
6,843,725 B2 1/2005 Nelson
6,848,616 B2 2/2005 Tsirline et al.
6,848,844 B2 2/2005 McCue et al.
6,848,994 B1 2/2005 Knust et al.
6,857,961 B2 2/2005 Soltys et al.
6,874,784 B1 4/2005 Promutico et al.
6,874,786 B2 4/2005 Bruno et al.
6,877,657 B2 4/2005 Ranard et al.
6,877,748 B1 4/2005 Patroni et al.
6,893,347 B1 5/2005 Zilliacus et al.
6,899,628 B2 5/2005 Leen et al.
6,902,167 B2 6/2005 Webb
6,905,121 B1 6/2005 Timpano
6,923,446 B2 8/2005 Snow
6,938,900 B2 9/2005 Snow
6,941,180 B1 9/2005 Fischer et al.
6,950,948 B2 9/2005 Neff
6,955,599 B2 10/2005 Bourbour et al.
6,957,746 B2 10/2005 Martin et al.
6,959,925 B1 11/2005 Baker et al.
6,960,134 B2 11/2005 Hartl et al.
6,964,612 B2 11/2005 Soltys et al.
6,986,514 B2 1/2006 Snow
6,988,516 B2 1/2006 Debaes et al.
7,011,309 B2 3/2006 Soltys et al.
7,020,307 B2 3/2006 Hinton et al.
7,028,598 B2 4/2006 Teshima
7,029,009 B2 * 4/2006 Grauzer ..... A63F 1/14 273/149 P
7,036,818 B2 * 5/2006 Grauzer ..... A63F 1/12 273/149 R
7,046,458 B2 5/2006 Nakayama
7,046,764 B1 5/2006 Kump
7,048,629 B2 5/2006 Sines et al.
7,066,464 B2 6/2006 Blad et al.
7,068,822 B2 6/2006 Scott
7,079,010 B2 7/2006 Champlin
7,084,769 B2 8/2006 Bauer et al.
7,089,420 B1 8/2006 Durst et al.
D527,900 S 9/2006 Dewa et al.
7,106,201 B2 9/2006 Tuttle
7,113,094 B2 9/2006 Garber et al.
7,114,718 B2 10/2006 Grauzer et al.
7,128,652 B1 10/2006 Lavoie et al.
7,139,108 B2 11/2006 Andersen et al.
7,140,614 B2 11/2006 Snow

(56) References Cited

U.S. PATENT DOCUMENTS 7,162,035 B1 1/2007 Durst et al.
7,165,769 B2 1/2007 Crenshaw et al.
7,165,770 B2 1/2007 Snow
7,175,522 B2 2/2007 Hartl
7,186,181 B2 3/2007 Rowe
7,201,656 B2 4/2007 Darder
7,202,888 B2 4/2007 Tecu et al.
7,203,841 B2 4/2007 Jackson et al.
7,222,852 B2 5/2007 Soltys et al.
7,222,855 B2 5/2007 Sorge
7,231,812 B1 6/2007 Lagare
7,234,698 B2 6/2007 Grauzer et al.
7,237,969 B2 7/2007 Bartman
7,243,148 B2 7/2007 Keir et al.
7,243,698 B2 7/2007 Leonard
7,246,799 B2 7/2007 Snow
7,255,642 B2 8/2007 Sines et al.
7,257,630 B2 8/2007 Cole et al.
7,261,294 B2 * 8/2007 Grauzer ..... A63F 1/12 273/149 P
7,264,241 B2 9/2007 Schubert et al.
7,264,243 B2 9/2007 Yoseloff et al.
7,277,570 B2 10/2007 Armstrong
7,278,923 B2 * 10/2007 Grauzer ..... A63F 1/12 273/148 R
7,294,056 B2 11/2007 Lowell et al.
7,297,062 B2 11/2007 Gatto et al.
7,300,056 B2 11/2007 Gioia et al.
7,303,473 B2 12/2007 Rowe
7,303,475 B2 12/2007 Britt et al.
7,309,065 B2 12/2007 Yoseloff et al.
7,316,609 B2 1/2008 Dunn et al.
7,331,579 B2 2/2008 Snow
7,334,794 B2 2/2008 Snow
7,338,044 B2 3/2008 Grauzer et al.
7,338,362 B1 3/2008 Gallagher
7,341,510 B2 3/2008 Bourbour et al.
D566,784 S 4/2008 Palmer
7,357,321 B2 4/2008 Yoshida et al.
7,360,094 B2 4/2008 Neff
7,367,563 B2 5/2008 Yoseloff et al.
7,367,565 B2 5/2008 Chiu
7,367,884 B2 5/2008 Breeding et al.
7,384,044 B2 6/2008 Grauzer et al.
7,387,300 B2 6/2008 Snow
7,389,990 B2 6/2008 Mourad
7,399,226 B2 7/2008 Mishra
7,407,438 B2 * 8/2008 Schubert ..... A63F 1/14 273/149 P
7,434,805 B2 * 10/2008 Grauzer ..... A63F 1/12 273/149 R
7,436,957 B1 10/2008 Fischer et al.
7,448,626 B2 11/2008 Fleckenstein
7,458,582 B2 12/2008 Snow et al.
7,461,843 B1 * 12/2008 Baker ..... A63F 1/12 273/149 R
7,464,932 B2 12/2008 Darling
7,464,934 B2 12/2008 Schwartz
7,472,906 B2 1/2009 Shai
7,478,813 B1 1/2009 Hofferber et al.
7,500,672 B2 3/2009 Ho
7,506,874 B2 3/2009 Hall
7,510,186 B2 3/2009 Fleckenstein
7,510,190 B2 3/2009 Snow et al.
7,510,194 B2 3/2009 Soltys et al.
7,510,478 B2 3/2009 Benbrahim et al.
7,513,437 B2 4/2009 Douglas
7,515,718 B2 4/2009 Nguyen et al.
7,523,936 B2 4/2009 Grauzer et al.
7,523,937 B2 4/2009 Fleckenstein
7,525,510 B2 4/2009 Beland et al.
7,540,498 B2 6/2009 Crenshaw et al.
7,549,643 B2 6/2009 Quach
7,554,753 B2 6/2009 Wakamiya
7,556,197 B2 7/2009 Yoshida et al.
7,575,237 B2 8/2009 Snow
7,578,506 B2 8/2009 Lambert
7,584,963 B2 9/2009 Krenn et al.
7,584,966 B2 9/2009 Snow
7,591,728 B2 9/2009 Gioia et al.
7,597,623 B2 10/2009 Grauzer et al.
7,644,923 B1 1/2010 Dickinson et al.
7,661,676 B2 2/2010 Smith et al.
7,666,090 B2 2/2010 Hettinger
7,669,853 B2 3/2010 Jones
7,686,681 B2 3/2010 Soltys et al.
7,740,244 B2 6/2010 Ho
7,744,452 B2 6/2010 Cimring et al.
7,753,374 B2 7/2010 Ho
7,758,425 B2 7/2010 Poh et al.
7,762,554 B2 7/2010 Ho
7,766,332 B2 8/2010 Grauzer et al.
7,766,333 B1 8/2010 Stardust et al.
7,769,853 B2 8/2010 Nezamzadeh
7,773,749 B1 8/2010 Durst et al.
7,780,529 B2 8/2010 Rowe et al.
7,784,790 B2 8/2010 Grauzer et al.
7,804,982 B2 9/2010 Howard et al.
7,824,255 B2 11/2010 Lutnick et al.
7,846,020 B2 12/2010 Walker et al.
7,890,365 B2 2/2011 Hettinger
7,900,923 B2 3/2011 Toyama et al.
7,908,169 B2 3/2011 Hettinger
7,931,533 B2 4/2011 Lemay et al.
7,946,586 B2 * 5/2011 Krenn ..... A63F 1/14 273/149 R
7,959,153 B2 6/2011 Franks, Jr.
7,976,023 B1 7/2011 Hessing et al.
7,988,554 B2 8/2011 Lemay et al.
7,995,196 B1 8/2011 Fraser
8,002,638 B2 8/2011 Grauzer et al.
8,016,663 B2 9/2011 Soltys et al.
8,021,231 B2 9/2011 Walker et al.
8,025,294 B2 9/2011 Grauzer et al.
8,038,521 B2 * 10/2011 Grauzer ..... A63F 1/12 463/17
RE42,944 E 11/2011 Blaha et al.
8,057,302 B2 11/2011 Wells et al.
8,062,134 B2 11/2011 Kelly et al.
8,092,307 B2 1/2012 Kelly
8,109,514 B2 2/2012 Toyama
8,150,158 B2 4/2012 Downs, III
8,171,567 B1 5/2012 Fraser et al.
8,251,293 B2 8/2012 Nagata et al.
8,251,802 B2 8/2012 Snow
8,270,603 B1 9/2012 Durst et al.
8,287,347 B2 10/2012 Snow et al.
8,287,386 B2 10/2012 Miller et al.
8,319,666 B2 11/2012 Weinmann et al.
8,342,525 B2 1/2013 Scheper et al.
8,342,526 B1 1/2013 Sampson et al.
8,342,529 B2 1/2013 Snow
8,419,521 B2 4/2013 Grauzer et al.
8,429,229 B2 4/2013 Sepich et al.
8,444,489 B2 5/2013 Lian et al.
8,475,252 B2 7/2013 Savage et al.
8,498,444 B2 7/2013 Sharma
8,505,916 B2 8/2013 Grauzer et al.
8,511,684 B2 8/2013 Grauzer et al.
8,512,146 B2 8/2013 Gururajan et al.
8,548,327 B2 10/2013 Hirth et al.
8,550,464 B2 10/2013 Soltys et al.
8,556,263 B2 10/2013 Grauzer et al.
8,579,289 B2 * 11/2013 Rynda ..... A63F 1/12 273/149 R
8,590,895 B2 * 11/2013 Kwon ..... A63F 1/14 273/148 R
RE44,616 E 12/2013 Blaha et al.
8,602,416 B2 12/2013 Toyama
8,616,552 B2 12/2013 Czyzewski et al.
8,662,500 B2 3/2014 Swanson
8,695,978 B1 4/2014 Cai-Shiang
8,702,100 B2 4/2014 Snow et al.

(56) References Cited

U.S. PATENT DOCUMENTS 8,702,101 B2 4/2014 Scheper et al.
8,720,891 B2 5/2014 Hessing et al.
8,758,111 B2 6/2014 Lutnick
8,777,727 B2 * 7/2014 Jones ..... A61K 9/2059 463/22
8,820,745 B2 9/2014 Grauzer et al.
8,844,931 B2 9/2014 Blaha et al.
8,919,775 B2 12/2014 Wadds et al.
8,969,802 B1 * 3/2015 Blazevic ..... A63F 1/14 250/330
9,101,821 B2 8/2015 Snow
9,220,972 B2 12/2015 Grauzer et al.
9,251,661 B2 2/2016 Tammesoo
9,254,435 B2 * 2/2016 Miller ..... A63F 1/14
9,266,012 B2 2/2016 Grauzer et al.
9,280,866 B2 3/2016 Nayak et al.
9,316,597 B2 4/2016 Blazevic
9,378,766 B2 6/2016 Kelly et al.
9,387,390 B2 7/2016 Downs et al.
9,474,957 B2 10/2016 Haushalter et al.
9,504,905 B2 11/2016 Kelly et al.
9,511,274 B2 12/2016 Kelly et al.
9,539,495 B2 * 1/2017 Scheper ..... A63F 1/00
9,566,501 B2 2/2017 Stasson et al.
9,573,047 B1 * 2/2017 Riordan ..... A63F 1/12
9,679,603 B2 6/2017 Kelly et al.
9,713,761 B2 7/2017 Sampson et al.
9,764,221 B2 9/2017 Swanson
9,901,810 B2 2/2018 Rynda et al.
9,908,034 B2 3/2018 Downs et al.
10,092,820 B2 * 10/2018 Riordan ..... A63F 1/12
10,124,241 B2 11/2018 Stasson et al.
10,238,954 B2 3/2019 Stasson et al.
10,486,055 B2 11/2019 Kelly et al.
10,668,361 B2 6/2020 Stasson et al.
10,933,300 B2 * 3/2021 Helsen ..... A63F 1/12
2001/0036231 A1 11/2001 Easwar et al.
2001/0036866 A1 11/2001 Stockdale et al.
2001/0054576 A1 12/2001 Stardust et al.
2002/0045478 A1 4/2002 Soltys et al.
2002/0045481 A1 4/2002 Soltys et al.
2002/0063389 A1 5/2002 Breeding et al.
2002/0094869 A1 7/2002 Harkham
2002/0107067 A1 8/2002 McGlone et al.
2002/0107072 A1 8/2002 Giobbi
2002/0113368 A1 8/2002 Hessing et al.
2002/0135692 A1 9/2002 Fujinawa
2002/0142820 A1 10/2002 Bartlett
2002/0155869 A1 10/2002 Soltys et al.
2002/0163122 A1 11/2002 Vancura
2002/0163125 A1 11/2002 Grauzer et al.
2002/0187821 A1 12/2002 Soltys et al.
2002/0187830 A1 12/2002 Stockdale et al.
2003/0003997 A1 1/2003 Vuong et al.
2003/0007143 A1 1/2003 McArthur et al.
2003/0048476 A1 3/2003 Yamakawa
2003/0052449 A1 3/2003 Grauzer et al.
2003/0052450 A1 3/2003 Grauzer et al.
2003/0064798 A1 4/2003 Grauzer et al.
2003/0067112 A1 4/2003 Grauzer et al.
2003/0087694 A1 5/2003 Storch
2003/0090059 A1 5/2003 Grauzer et al.
2003/0094756 A1 5/2003 Grauzer et al.
2003/0151194 A1 8/2003 Hessing et al.
2003/0195025 A1 10/2003 Hill
2004/0015423 A1 1/2004 Walker et al.
2004/0100026 A1 5/2004 Emmitt
2004/0108255 A1 6/2004 Johnson
2004/0108654 A1 6/2004 Grauzer et al.
2004/0116179 A1 6/2004 Nicely et al.
2004/0180722 A1 9/2004 Giobbi
2004/0245720 A1 12/2004 Grauzer et al.
2004/0259618 A1 12/2004 Soltys et al.
2005/0012671 A1 1/2005 Bisig
2005/0012818 A1 1/2005 Kiely et al.
2005/0026680 A1 2/2005 Gururajan
2005/0035548 A1 2/2005 Yoseloff et al.
2005/0037843 A1 2/2005 Wells et al.
2005/0040594 A1 2/2005 Krenn et al.
2005/0051955 A1 3/2005 Schubert et al.
2005/0062228 A1 3/2005 Grauzer et al.
2005/0062229 A1 3/2005 Grauzer et al.
2005/0082750 A1 4/2005 Grauzer et al.
2005/0093231 A1 5/2005 Grauzer et al.
2005/0110210 A1 5/2005 Soltys et al.
2005/0113166 A1 5/2005 Grauzer et al.
2005/0113171 A1 5/2005 Hodgson
2005/0119048 A1 6/2005 Soltys et al.
2005/0121852 A1 6/2005 Soltys et al.
2005/0137005 A1 6/2005 Soltys et al.
2005/0148391 A1 7/2005 Tain
2005/0164759 A1 7/2005 Smith et al.
2005/0164761 A1 7/2005 Tain
2005/0192092 A1 9/2005 Breckner et al.
2005/0206077 A1 9/2005 Grauzer et al.
2005/0242500 A1 11/2005 Downs, III
2005/0272501 A1 12/2005 Tran et al.
2005/0277463 A1 12/2005 Knust et al.
2005/0288083 A1 12/2005 Downs, III
2005/0288086 A1 12/2005 Schubert et al.
2006/0027970 A1 2/2006 Kyrychenko
2006/0033269 A1 2/2006 Grauzer et al.
2006/0033270 A1 2/2006 Grauzer et al.
2006/0046853 A1 3/2006 Black
2006/0055114 A1 3/2006 White et al.
2006/0063577 A1 3/2006 Downs et al.
2006/0066048 A1 3/2006 Krenn et al.
2006/0084502 A1 4/2006 Downs et al.
2006/0151946 A1 7/2006 Ngai
2006/0183540 A1 8/2006 Grauzer et al.
2006/0189381 A1 8/2006 Daniel et al.
2006/0199649 A1 9/2006 Soltys et al.
2006/0205508 A1 9/2006 Green
2006/0220312 A1 10/2006 Baker et al.
2006/0220313 A1 10/2006 Baker et al.
2006/0252521 A1 11/2006 Gururajan et al.
2006/0252554 A1 11/2006 Gururajan et al.
2006/0279040 A1 12/2006 Downs et al.
2007/0001395 A1 1/2007 Gioia et al.
2007/0006708 A1 1/2007 Laakso
2007/0015583 A1 1/2007 Tran
2007/0045959 A1 3/2007 Soltys
2007/0049368 A1 3/2007 Kuhn et al.
2007/0057454 A1 3/2007 Fleckenstein
2007/0057469 A1 3/2007 Grauzer et al.
2007/0066387 A1 3/2007 Matsuno et al.
2007/0069462 A1 3/2007 Downs et al.
2007/0072677 A1 3/2007 Lavoie et al.
2007/0111773 A1 5/2007 Gururajan et al.
2007/0148283 A1 6/2007 Harvey et al.
2007/0184905 A1 8/2007 Gatto et al.
2007/0197294 A1 8/2007 Gong
2007/0197298 A1 8/2007 Rowe
2007/0202941 A1 8/2007 Miltenberger et al.
2007/0222147 A1 9/2007 Blaha et al.
2007/0225055 A1 9/2007 Weisman
2007/0233567 A1 10/2007 Daly
2007/0238506 A1 10/2007 Ruckle
2007/0241498 A1 10/2007 Soltys
2007/0259709 A1 11/2007 Kelly et al.
2007/0267812 A1 11/2007 Grauzer et al.
2007/0272600 A1 11/2007 Johnson
2007/0287534 A1 12/2007 Fleckenstein
2007/0290438 A1 12/2007 Grauzer et al.
2007/0298865 A1 12/2007 Soltys
2008/0004107 A1 1/2008 Nguyen et al.
2008/0022415 A1 1/2008 Kuo et al.
2008/0032763 A1 2/2008 Giobbi
2008/0039192 A1 2/2008 Laut
2008/0039208 A1 2/2008 Abrink et al.
2008/0096656 A1 4/2008 Lemay et al.
2008/0111300 A1 5/2008 Czyzewski et al.
2008/0113783 A1 5/2008 Czyzewski et al.
2008/0136108 A1 6/2008 Polay

(56) References Cited

U.S. PATENT DOCUMENTS

| | | | |
|---|---|---|---|
| 2008/0143048 | A1 | 6/2008 | Shigeta |
| 2008/0176627 | A1 | 7/2008 | Brant |
| 2008/0217218 | A1 | 9/2008 | Johnson |
| 2008/0234046 | A1 | 9/2008 | Kinsley |
| 2008/0234047 | A1 | 9/2008 | Nguyen |
| 2008/0248875 | A1 | 10/2008 | Beatty |
| 2008/0284096 | A1 | 11/2008 | Toyama et al. |
| 2008/0315517 | A1 | 12/2008 | Toyama |
| 2009/0026700 | A2 | 1/2009 | Shigeta |
| 2009/0048026 | A1 | 2/2009 | French |
| 2009/0054161 | A1 | 2/2009 | Schubert et al. |
| 2009/0072477 | A1 | 3/2009 | Tseng |
| 2009/0091078 | A1 | 4/2009 | Grauzer et al. |
| 2009/0100409 | A1 | 4/2009 | Toneguzzo |
| 2009/0104963 | A1 | 4/2009 | Burman et al. |
| 2009/0121429 | A1 | 5/2009 | Walsh |
| 2009/0134575 | A1 | 5/2009 | Dickinson et al. |
| 2009/0140492 | A1 | 6/2009 | Yoseloff et al. |
| 2009/0166970 | A1 | 7/2009 | Rosh |
| 2009/0176547 | A1 | 7/2009 | Katz |
| 2009/0179378 | A1 | 7/2009 | Amaitis et al. |
| 2009/0186676 | A1 | 7/2009 | Amaitis et al. |
| 2009/0191933 | A1 | 7/2009 | French |
| 2009/0194988 | A1 | 8/2009 | Wright et al. |
| 2009/0197662 | A1 | 8/2009 | Wright et al. |
| 2009/0224476 | A1 | 9/2009 | Grauzer et al. |
| 2009/0227318 | A1 | 9/2009 | Wright et al. |
| 2009/0227360 | A1 | 9/2009 | Gioia et al. |
| 2009/0250873 | A1 | 10/2009 | Jones |
| 2009/0253478 | A1 | 10/2009 | Walker et al. |
| 2009/0253503 | A1 | 10/2009 | Krise et al. |
| 2009/0267297 | A1 | 10/2009 | Blaha et al. |
| 2009/0283969 | A1 | 11/2009 | Tseng |
| 2009/0298577 | A1 | 12/2009 | Gagner et al. |
| 2009/0302535 | A1 | 12/2009 | Ho |
| 2009/0302537 | A1 | 12/2009 | Ho |
| 2009/0312093 | A1 | 12/2009 | Walker et al. |
| 2009/0314188 | A1 | 12/2009 | Toyama et al. |
| 2010/0013152 | A1 | 1/2010 | Grauzer et al. |
| 2010/0048304 | A1 | 2/2010 | Boesen |
| 2010/0069155 | A1 | 3/2010 | Schwartz et al. |
| 2010/0178987 | A1 | 7/2010 | Pacey |
| 2010/0197410 | A1 | 8/2010 | Leen et al. |
| 2010/0234110 | A1 | 9/2010 | Clarkson |
| 2010/0240440 | A1 | 9/2010 | Szrek et al. |
| 2010/0244376 | A1 | 9/2010 | Johnson |
| 2010/0252992 | A1 | 10/2010 | Sines |
| 2010/0255899 | A1 | 10/2010 | Paulsen |
| 2010/0311493 | A1 | 12/2010 | Miller et al. |
| 2010/0311494 | A1 | 12/2010 | Miller et al. |
| 2010/0314830 | A1 | 12/2010 | Grauzer et al. |
| 2010/0320685 | A1 | 12/2010 | Grauzer et al. |
| 2011/0006480 | A1 | 1/2011 | Grauzer et al. |
| 2011/0012303 | A1 | 1/2011 | Kourgiantakis et al. |
| 2011/0024981 | A1 | 2/2011 | Tseng |
| 2011/0052049 | A1 | 3/2011 | Rajaraman et al. |
| 2011/0062662 | A1 | 3/2011 | Ohta et al. |
| 2011/0078096 | A1 | 3/2011 | Bounds |
| 2011/0079959 | A1 | 4/2011 | Hartley |
| 2011/0105208 | A1 | 5/2011 | Bickley |
| 2011/0130185 | A1 | 6/2011 | Walker |
| 2011/0130190 | A1 | 6/2011 | Hamman et al. |
| 2011/0159952 | A1 | 6/2011 | Kerr |
| 2011/0159953 | A1 | 6/2011 | Kerr |
| 2011/0165936 | A1 | 7/2011 | Kerr |
| 2011/0172008 | A1 | 7/2011 | Alderucci |
| 2011/0183748 | A1 | 7/2011 | Wilson et al. |
| 2011/0230148 | A1 | 9/2011 | Demuynck et al. |
| 2011/0230268 | A1 | 9/2011 | Williams |
| 2011/0269529 | A1 | 11/2011 | Baerlocher |
| 2011/0272881 | A1 | 11/2011 | Sines |
| 2011/0285082 | A1 | 11/2011 | Krenn et al. |
| 2011/0287829 | A1 | 11/2011 | Clarkson et al. |
| 2012/0015724 | A1 | 1/2012 | Ocko et al. |
| 2012/0015725 | A1 | 1/2012 | Ocko et al. |
| 2012/0015743 | A1 | 1/2012 | Lam et al. |
| 2012/0015747 | A1 | 1/2012 | Ocko et al. |
| 2012/0021835 | A1 | 1/2012 | Keller et al. |
| 2012/0034977 | A1 | 2/2012 | Kammler |
| 2012/0062745 | A1 | 3/2012 | Han et al. |
| 2012/0074646 | A1 | 3/2012 | Grauzer et al. |
| 2012/0095982 | A1 | 4/2012 | Lennington et al. |
| 2012/0161393 | A1 | 6/2012 | Krenn et al. |
| 2012/0175841 | A1 | 7/2012 | Grauzer et al. |
| 2012/0181747 | A1 | 7/2012 | Grauzer et al. |
| 2012/0187625 | A1 | 7/2012 | Downs et al. |
| 2012/0242782 | A1 | 9/2012 | Huang |
| 2012/0286471 | A1 | 11/2012 | Grauzer et al. |
| 2012/0306152 | A1 | 12/2012 | Krishnamurty et al. |
| 2013/0020761 | A1 | 1/2013 | Sines et al. |
| 2013/0023318 | A1 | 1/2013 | Abrahamson |
| 2013/0085638 | A1 | 4/2013 | Weinmann et al. |
| 2013/0109455 | A1 | 5/2013 | Grauzer et al. |
| 2013/0132306 | A1 | 5/2013 | Kami et al. |
| 2013/0228972 | A1 | 9/2013 | Grauzer et al. |
| 2013/0241147 | A1 | 9/2013 | McGrath |
| 2013/0337922 | A1 | 12/2013 | Kuhn et al. |
| 2014/0094239 | A1 | 4/2014 | Grauzer et al. |
| 2014/0103606 | A1 | 4/2014 | Grauzer et al. |
| 2014/0145399 | A1 | 5/2014 | Krenn et al. |
| 2014/0171170 | A1 | 6/2014 | Krishnamurty et al. |
| 2014/0175724 | A1 | 6/2014 | Huhtala et al. |
| 2014/0183818 | A1 | 7/2014 | Czyzewski et al. |
| 2015/0021242 | A1 | 1/2015 | Johnson |
| 2015/0196833 | A1 | 7/2015 | Scheper et al. |
| 2015/0196834 | A1 | 7/2015 | Scheper et al. |
| 2015/0238848 | A1 | 8/2015 | Kuhn et al. |
| 2015/0251079 | A1 | 9/2015 | Wright |
| 2015/0290529 | A1 | 10/2015 | Bourbour et al. |
| 2018/0043241 | A1 | 2/2018 | Blaha et al. |
| 2018/0089956 | A1 | 3/2018 | Nagaragatta et al. |
| 2018/0200610 | A1 | 7/2018 | Riordan et al. |
| 2018/0207514 | A1 | 7/2018 | Blaha et al. |

FOREIGN PATENT DOCUMENTS

| | | | |
|---|---|---|---|
| AU | 06978/05 | B2 | 10/1998 |
| AU | 0757636 | B2 | 2/2003 |
| CA | 2266555 | A1 | 4/1998 |
| CA | 2284017 | C | 5/2006 |
| CA | 2612138 | A1 | 12/2006 |
| CA | 2823738 | A1 | 2/2015 |
| CN | 2051521 | U | 1/1990 |
| CN | 1383099 | A | 12/2002 |
| CN | 1824356 | A | 8/2006 |
| CN | 2848303 | Y | 12/2006 |
| CN | 2855481 | Y | 1/2007 |
| CN | 1933881 | A | 3/2007 |
| CN | 2877425 | Y | 3/2007 |
| CN | 101025603 | A | 8/2007 |
| CN | 101044520 | A | 9/2007 |
| CN | 200954370 | Y | 10/2007 |
| CN | 200987893 | Y | 12/2007 |
| CN | 101099896 | A | 1/2008 |
| CN | 101127131 | A | 2/2008 |
| CN | 101134141 | A | 3/2008 |
| CN | 201085907 | Y | 7/2008 |
| CN | 201132058 | Y | 10/2008 |
| CN | 201139926 | Y | 10/2008 |
| CN | 101437586 | A | 5/2009 |
| CN | 100571826 | C | 12/2009 |
| CN | 1771077 | B | 6/2010 |
| CN | 201832397 | U | 5/2011 |
| CN | 102125756 | A | 7/2011 |
| CN | 102170944 | A | 8/2011 |
| CN | 101783011 | B | 12/2011 |
| CN | 102847311 | A | 1/2013 |
| CN | 202724641 | U | 2/2013 |
| CN | 202983149 | U | 6/2013 |
| CN | 103025393 | B | 5/2015 |
| CZ | 0024952 | U1 | 2/2013 |
| DE | 0291230 | C | 4/1916 |
| DE | 2757341 | A1 | 6/1978 |
| DE | 2816377 | A1 | 10/1979 |

(56) References Cited

FOREIGN PATENT DOCUMENTS

| | | | |
|---|---|---|---|
| DE | 3807127 | A1 | 9/1989 |
| EP | 0777514 | B1 | 2/2000 |
| EP | 1194888 | A1 | 4/2002 |
| EP | 1502631 | A1 | 2/2005 |
| EP | 1713026 | A1 | 10/2006 |
| EP | 2228106 | A1 | 9/2010 |
| EP | 1575261 | B1 | 8/2012 |
| FR | 2375918 | A1 | 7/1978 |
| GB | 0289552 | A | 4/1928 |
| GB | 0337147 | A | 10/1930 |
| GB | 0414014 | A | 7/1934 |
| GB | 0672616 | A | 5/1952 |
| GB | 2382567 | A | 6/2003 |
| JP | 10-063933 | A | 3/1998 |
| JP | 11-045321 | A | 2/1999 |
| JP | 2000-251031 | A | 9/2000 |
| JP | 2001-327647 | A | 11/2001 |
| JP | 2002-165916 | A | 6/2002 |
| JP | 2003-154320 | A | 5/2003 |
| JP | 2003-250950 | A | 9/2003 |
| JP | 2005-198668 | A | 7/2005 |
| JP | 2006-092140 | A | 4/2006 |
| JP | 2008-246061 | A | 10/2008 |
| JP | 4586474 | B2 | 11/2010 |
| KR | 2018-0090299 | A | 8/2018 |
| TW | M335308 | U | 7/2008 |
| TW | M357307 | U | 5/2009 |
| TW | M359356 | U | 6/2009 |
| TW | 1345476 | B | 7/2011 |
| TW | I468209 | B | 1/2015 |
| TW | 1481436 | B | 4/2015 |
| WO | 87/00445 | A1 | 1/1987 |
| WO | 87/00764 | A1 | 2/1987 |
| WO | 92/21413 | A1 | 12/1992 |
| WO | 95/28210 | A1 | 10/1995 |
| WO | 96/07153 | A1 | 3/1996 |
| WO | 97/10577 | A1 | 3/1997 |
| WO | 98/14249 | A1 | 4/1998 |
| WO | 98/40136 | A1 | 9/1998 |
| WO | 99/43404 | A1 | 9/1999 |
| WO | 99/52610 | A1 | 10/1999 |
| WO | 99/52611 | A1 | 10/1999 |
| WO | 00/51076 | A1 | 8/2000 |
| WO | 01/56670 | A1 | 8/2001 |
| WO | 02/05914 | A1 | 1/2002 |
| WO | 01/78854 | A3 | 2/2002 |
| WO | 2003/004116 | A1 | 1/2003 |
| WO | 03/26763 | A1 | 4/2003 |
| WO | 2004/067889 | A1 | 8/2004 |
| WO | 2004/112923 | A1 | 12/2004 |
| WO | 2006/031472 | A2 | 3/2006 |
| WO | 06/39308 | A2 | 4/2006 |
| WO | 2007/117268 | A1 | 10/2007 |
| WO | 2008/005285 | A2 | 1/2008 |
| WO | 2008/005286 | A2 | 1/2008 |
| WO | 2008/006023 | A2 | 1/2008 |
| WO | 2008/091809 | A2 | 7/2008 |
| WO | 2009/067758 | A1 | 6/2009 |
| WO | 2009/137541 | A2 | 11/2009 |
| WO | 2010/052573 | A2 | 5/2010 |
| WO | 2010/055328 | A1 | 5/2010 |
| WO | 2010/117446 | A1 | 10/2010 |
| WO | 2012/053074 | A1 | 4/2012 |
| WO | 2013/019677 | A1 | 2/2013 |
| WO | 2016/058085 | A9 | 5/2016 |

OTHER PUBLICATIONS

PCT International Search Report and Written Opinion, PCT/US2012/48706, dated Oct. 16, 2012, 12 pages.

PCT International Search Report for International Application No. PCT/US2007/022858, dated Apr. 18, 2008.

PCT International Search Report for International Application No. PCT/US2003/015393, dated Oct. 6, 2003, 2 pages.

PCT International Search Report for PCT/US2005/034737 dated Apr. 7, 2006, 1 page.

PCT International Search Report for PCT/US2007/022894, dated Jun. 11, 2008, 3 pages.

Philippines Office Action, for Philippines Application No. 1/2018/501139, dated Apr. 8, 2021, 3 pages.

Philippines Patent Application Formality Examination Report—Philippines Patent Application No. 1-2006-000302, dated Jun. 13, 2006.

Press Release for Alliance Gaming Corp., Jul. 26, 2004—Alliance Gaming Announces Control with Galaxy Macau for New MindPlay Baccarat Table Technology, 2 pages, http://biz.yahoo.com/prnews.

Prototype Glossary and Timelines; *Shuffle Tech International* v. *Scientific Games Corp., et al.* 1:15-cv-3702 (N.D. III) (May 2017) pp. 1-4.

Scarne's Encyclopedia of Games by John Scarne, 1973, "Super Contract Bridge", p. 153.

Service Manual/User Manual for Single Deck Shufflers: BG1, BG2 and BG3 by Shuffle Master (copyright) 1997, 151 page.

SHFL Entertainment, Inc. Docket No. 60, Opening Claim Construction Brief, filed in Nevada District Court Case No. 2:12-cv-01782 with exhibits, Aug. 8, 2013, p. 1-125.

Shuffle Master Gaming, Service Manual, ACE(trademark) Single Deck Card Shuffler, (1998), 63 pages.

Shuffle Master Gaming, Service Manual, Let It Ride Bonus (Register) With Universal Keypad, 112 pages, (Copyright) 2000 Shuffle Master, Inc.

Shuffle Master's Reply Memorandum in Support of Shuffle Master's Motion for Preliminary Injunction for *Shuffle Master, Inc.* vs. *VendingDala Corporation*, In the U.S. District Court, District of Nevada, No. CV-S-04-1373-JCM-LRL, Nov. 29, 2004.

Shuffle Master, Inc. (1996) Let It Ride, The Tournament, User Guide, 72 pages.

Singapore Patent Application Examination Report—Singapore Patent Application No. SE 2008 01914 A, dated Jun. 18, 2008, 9 pages.

Solberg, Halvard; Deposition; *Shuffle Tech International* v. *Scientific Games Corp., et al.* 1:15-cv-3702 (N.D. III.); Oct. 18, 2016; pp. 187, 224-246, 326-330, 338-339, 396; Baytowne Reporting; Panama City, FL.

Specification of Australian Patent Application No. 31577/95 filed Jan. 17, 1995, Applicants: Rodney G. Johnson et al.; Card Handling Apparatus.

Statement of Relevance of Cited References, Submitted as Part of a Third-Party Submission Under 37 CFR 1.290 on Dec. 7, 2012 (12 pages).

TableScanner "Accounting & Cage". Product Information Datasheets [online]. Advansys, 2013. Retrieved on Oct. 11, 2016 from the Internet: <URL: http://advansys.si/products/tablescanner/accounting-cage/> (4 pages).

TableScanner "Casino Management System". Product Information Datasheets [online], Advansys, 2013. Retrieved on Oct. 11, 2016 from the Internet: <URL: http://advansys.si/> (6 pages).

TableScanner "Multisite". Product Information Datasheets [online]. Advansys, 2013. Retrieved on Oct. 11, 2016 from the Internet: <URL: http://advansys.si/products/tablescanner/multisite/> (3 pages).

TableScanner "Player Tracking". Product Information Datasheets [online]. Advansys, 2013. Retrieved on Sep. 23, 2016 from the Internet: <URL: http://advansys.si/products/tablescanner/player-tracking/> (4 pages).

TableScanner "Table Management system". Product Information Datasheets [online], Advansys, 2013. Retrieved on Oct. 11, 2016 from the Internet: <URL: http://advansys.si/products/tablescanner/> (4 pages).

TAG Archives: Shuffle Machine, Gee Wiz Online, (Mar. 25, 2013), 4 pages.

Taiwanese Office Action and Search Report from Taiwanese Application No. 10410,643, dated Oct. 4, 2018, 15 pages.

Taiwanese Office Action and Search Report from Taiwanese Application No. 104122818, dated Apr. 29, 2019, 17 pages.

Taiwanese Office Action and Search Report from Taiwanese Application No. 106133407, dated Sep. 4, 2018, 9 pages.

(56) References Cited

OTHER PUBLICATIONS

Tbm=pts&hl=en Google Search for card handling device with storage area, card removing system pivoting arm and processor http://www.google com/?tbm=pts&hl=en; Jul. 28, 2012, 2 pages.
Tracking the Tables, by Jack Bularsky, Casino Journal, May 2004, vol. 17, No. 5, pp. 44-47.
TYM @ A Glance—Table Games Yield Management, TYM Live Product Information Datasheets [online]. TANGAM Systems, 2016. Retrieved on Oct. 3, 2016 from the Internet: <URL: http://tangamgaming.com/wp-content/uploads/2016/12/TG_TYMGIance_2016-V4-1.pdf> (2 pages).
United States Court of Appeals for the Federal Circuit Decision Decided Dec. 27, 2005 for Preliminary Injuction for *Shuffle Master, Inc.* vs. *VendingData Corporation*, In the U.S. District Court, District of Nevada, No. CV-S-04-1373-JCM-LRL.
VendingData Corporation's Answer and Counterclaim Jury Trial Demanded for *Shuffle Master, Inc.* vs. *VendingData Corporation*, In the U.S. District Court, District of Nevada, No. CV-S-04-1373-JCM-LRL, Oct. 25, 2004.
VendingData Corporation's Opposition to Shuffle Master Inc.'s Motion for Preliminary Injection for *Shuffle Master, Inc.* vs. *VendingData Corporation*, In the U.S. District Court, District of Nevada, No. CV-S-04-1373-JCM-LRL, Nov. 12, 2004.
VendingData Corporation's Responses to Shuffle Master, Inc.'s First set of interrogatories for *Shuffler Master, Inc.* vs. *VendingData Corporation*, In the U.S District Court, District of Nevada, No. CV-S-04-1373-JCM-LRL, Mar. 14, 2005.
Weisenfeld, Bernie; Inventor betting on shuffler; Courier-Post; Sep. 11, 1990; 1 page.
DVD labeled Exhibit 1. This is a DVD taken by Shuffle Master personnel of the live operation of a CARD One2Six (Trademark) Shuffler (Oct. 7, 2003).
DVD labeled Luciano Decl. Ex. K is (see Binder 2-1, p. 215/237, Luciano Decl. para.14): A video demonstration (11 minutes) of a Luciano Packaging prototype shuffler.
DVD labeled Solberg Decl. Ex. C, which is not a video at all, is (see Binder 4-1, p. 34/206, Solberg Deck, para.8): Computer source code for operating a computer-controlled card shuffler (an early Roblejo prototype card shuffler) and Descriptive comments of how the code works.
Error Back propagation, http://willamette.edu~gorr/classes/cs449/backprop.html(4 pages), Nov. 13, 2008.
European Communication pursuant to Article 94(3) EPC for European Application No. 15744793.9, dated Mar. 21, 2019, 5 pages.
European Examination Report for European Application No. 07 853 071.4, dated Aug. 10, 2018, 7 pages.
European Examination Report for European Application No. 02 780 410, dated Jan. 25, 2010, 5 pages.
European Examination Report for European Patent Application No. 16168060.8, dated Feb. 22, 2018, 6 pages.
European Examination Report from European Application No. 17163607.9, dated Oct. 4, 2018, 3 pages.
European Extended Search Report and Written Opinion from European Application No. 18195983.4, dated Jan. 29, 2019, 10 pages.
European Extended Search Report from European Application No. 19209594.1, dated Feb. 28, 2020, 8 pages.
European Patent Application Search Report—European Patent Application No. 06772987.1, dated Dec. 10, 2009, 5 pages.
European Search and Opinion for European Application No. 19166074.5, dated Jul. 19, 2019, 7 pages.
European Search Report and Written Opinion from European Application No. 18199796.6, dated Apr. 5, 2019, 6 pages.
European Search Report for European Application No. 17163607.9 dated Sep. 15, 2017, 6 pages.
Fine, Randall A., "Talking Tables", dated Apr. 25, 2012. Global Gaming Business Magazine, vol. 11, No. 5, May 2012. Retrieved on Oct. 3, 2016 from the Internet: <URL: https://ggbmagazine.com/issue/vol-11-no-5-may 2012/article/talking-ables> (4 pages).
Gola, Steve; Deposition; *Shuffle Tech International* v. *Scientific Games Corp., et al.* 1:15-cv-3702 (N.D. III.); Oct. 13, 2016; pp. 1, 9-21, 30-69, 150-167, 186-188, 228-231, 290-315,411; Henderson Legal Services, Inc. Washington, DC.
Gros, Roger; New Card Management System To Be Tested At Bally's Park Place; Casino Journal; Apr. 1989; 5 pages.
http://www.google.com/search?tbm=pts&q=Card+handling+device+with+input+and- +outpu . . . , Jun. 8, 2012.
http://www.google.com/search?tbm=pts&q=shuffling+zone+onOopposite+site+of+input+... Jul. 18, 2012.
http://www.ildado.com/casino_glossary.html, Feb. 1, 2001, p. 1-8.
International Invitation to Pay Additional Fees and Partial Search Report for International Application PCT/US2019/048442, dated Dec. 6, 2019, 10 pages.
International Preliminary Report on Patentability Chapter 1 for PCT/US19/50436, dated Mar. 16, 2021, 8 pages.
International Preliminary Report on Patentability, for International Application No. PCT/US2019/027460, dated, Mar. 9, 2021, 10 pages.
International Search Report from International Application No. PCT/US2019/048442, dated Jan. 28, 2020, 6 pages.
International Search Report from International Application No. PCT/US2019/050436, dated Dec. 12, 2019, 4 pages.
International Written Opinion from International Application No. PCT/IB2017/055810, dated Jan. 8, 2018, 8 pages.
International Written Opinion from International Application No. PCT/US2019/027460, dated Aug. 12, 2019, 9 pages.
International Written Opinion from International Application No. PCT/US2019/048442, dated Jan. 28, 2020, 9 pages.
International Written Opinion from International Application No. PCT/US2019/050436, dated Dec. 12, 2019, 7 pages.
Litwiller, Dave, CCD vs. CMOS: Facts and Fiction reprinted from Jan. 2001 Issue of Photonics Spectra, Laurin Publishing Co. Inc. (4 pages).
Macau Office Action and Search Report from Macau Application No. 1/1240, dated Aug. 15, 2018, 14 pages with English translation.
Macau Office Action and Search Report from Macau Application No. I/1123, dated Feb. 14, 2019, 14 pages.
Macau Office Action and Search Report from Macau Application No. I/1128, dated Dec. 27, 2018, 18 pages.
Malaysian Patent Application Substantive Examination Adverse Report—Malaysian Patent Application Serial No. PI 20062710, dated May 9, 2009, 4 pages.
NEON Product Information Datasheets [online], "Enterprise Casino Management, Table Management System, Mobile, Gaming". Intelligent Gaming, 2014. Retrieved on Oct. 12, 2016 from the Internet: <URL: http://www.intelligentgaming.co.uk/products/neon-enterprise/> (4 pages).
Olsen, Eddie; Automatic Shuffler ready' for Atlantic City experiment; Blackjack Confidential; Jul./Aug. 1989; pp. 5-7.
PCT International Preliminary Examination Report for International Patent Application No. PCT/US02/31105 dated Jul. 28, 2004, 9 pages.
PCT International Search Report and Written Opinion for International Application No. PCT/US2007/023168, dated Sep. 12, 2008, 8 pages.
PCT International Search Report and Written Opinion for PCT/US07/15035, dated Sep. 29, 2008, 6 pages.
PCT International Search Report and Written Opinion for PCT/US07/15036, dated Sep. 23, 2008, 6 pages.
PCT International Search Report and Written Opinion of the International Searching Authority for PCT/GB2011/051978, dated Jan. 17, 2012, 11 pages.
PCT International Search Report and Written Opinion of the International Searching Authority for PCT/US2010/001032, dated Jun. 16, 2010, 11 pages.
PCT International Search Report and Written Opinion of the International Searching Authority for PCT/US05/31400, dated Sep. 25, 2007, 12 pages.
PCT International Search Report and Written Opinion of the International Searching Authority for PCT/US11/59797, dated Mar. 27, 2012, 14 pages.
PCT International Search Report and Written Opinion of the International Searching Authority for PCT/US13/59665, dated Apr. 25, 2014, 21 pages.

(56) References Cited

OTHER PUBLICATIONS

PCT International Search Report and Written Opinion of the International Searching Authority for PCT/US2008/007069, dated Sep. 8, 2008, 10 pages.
PCT International Search Report and Written Opinion, PCT Application No. PCT/US2013/062391, dated Dec. 17, 2013, 13 pages.
PCT International Search Report and Written Opinion, PCT Application No. PCT/US2015/022158, dated Jun. 17, 2015, 13 pages.
PCT International Search Report and Written Opinion, PCT Application No. PCT/US2015/025420, dated Oct. 2, 2015, 15 pages.
"i-Deal," Bally Technologies, Inc., (2014), 2 pages.
"Playtech Retail begins roll out of Neon across Grosvenos 55 UK Casinos" Playtech, Apr. 21, 2016. Retrieved on Oct. 11, 2016 from the Internet: <URL https://www.playtech.com/news/latest_news_and_prs/ playtech_retail_begins_roll_out_of_neon_across_grosvenor_s_55_uk_casinos> (1 page).
"Shufflers—SHFL entertainment", Gaming Concepts Group, (2012), 6 pages.
"TableScanner (TM) from ADVANSYS", Casino Inside Magazine, No. 30, pp. 34-36 (Dec. 2012) (4 pages).
1/3 B/W CCD Camera Module EB100 by EverFocus Electronics Corp., Jul. 31, 2001, 3 pgs.
Ace, Single Deck Shuffler, Shuffle Master, Inc., (2005), 2 pages.
Australian Examination Report for Australian Application No. 2016277702, dated Jul. 12, 2018, 3 pages.
Australian Examination Report for Australian Application No. 2008202752, dated Sep. 25, 2009, 2 pages.
Australian Examination Report for Australian Application No. 2010202856, dated Aug. 11, 2011, 2 pages.
Australian Examination Report from Australian Application No. 2017204115, dated Dec. 20, 2018, 4 pages.
Australian Examination Report, for Australian Application No. 2016363815, dated Feb. 3, 2021,4 pages, with English Translation.
Australian Provisional Patent Application for Australian Patent Application No. PM7441, filed Aug. 15, 1994, Applicants: Rodney G. Johnson et al., Tille: Card Handling Apparatus, 13 pages.
Automatic casino card shuffle, Alibaba.com, (last visited Jul. 22, 2014), 2 pages.
Bally Systems Catalogue, Ballytech.com/systems, 2012, 13 pages.
Canadian Office Action for Canadian Application No. 2,886,633, dated Nov. 1, 2018, 4 pages.
Canadian Office Action for Canadian Application No. 2,985,255 dated Jul. 25, 2019, 4 pages.
Canadian Office Action from Canadian Application No. 2,995,664, dated Jun. 4, 2019, 5 pages.
CasinoTracTableTrac Services. Product Information Datasheet [online], CasinoTrac, 2015. Retrieved on Oct. 12, 2016 from the Internet: <URL: http://www.tabletrac.com/?pageid=15#prettyPhoto> (3 pages).
Chinese First Office Action and Search Report from Chinese Application No. 201580027851.8, dated Mar. 4, 2019, 9 pages.
Chinese Office Action and Search Report from Chinese Application No. 201310361850.X, dated Oct. 10, 2018, 9 pages.
Chinese Search Report for Chinese Application No. 201580027851.8, dated Feb. 22, 2019, 1 page.
Christos Stergiou and Dimitrios Siganos, "Neural Networks," http://www.doc.ic.ac.uk/~nd/surprise_96/journal/vol4/cs11/report.html (13 pages), Dec. 15, 2011.
Complaint filed in the matter of SHFL entertainment, *In*. v. *DigiDeal Corporation*, U.S. District Court, District of Nevada, Civil Action No. CV 2:12-cv-01782-GMC-VCF, Oct. 10, 2012, 62 pages.
CONNECT2TABLE Administrator Manual, Jan. 7, 2013 (82 pages).
CONNECT2TABLE Connect2Table System Summary, generated Oct. 21, 2016 (2 pages).
CONNECT2TABLE Quick Installation Guide, Feb. 20, 2013 (36 pages).
CONNECT2TABLE User Manual, Feb. 7, 2013 (35 pages).
Documents submitted in case of *Shuffle Master, Inc*. v. *Card Austria, et al*., Case No. CV-N-0508-HDM-(VPC) Consolidated with Case No. CV-N-02-0244-ERC-(RAM)), May 6, 2003, scan of (color pages, for clarity, Part 18 of 23 color copies from Binder 1).
Documents submitted in case of *Shuffle Master, Inc*. v. *Card Austria, et al*., Case No. CV-N-0508-HDM-(VPC) Consolidated with Case No. CV-N-02-0244-ERC-(RAM)), May 6, 2003, scan of (color pages, for clarity, Part 19 of 23 color copies from Binder 3).
Documents submitted in case of *Shuffle Master, Inc*. v. *Card Austria, et al*., Case No. CV-N-0508-HDM-(VPC) Consolidated with Case No. CV-N-02-0244-ERC-(RAM)), May 6, 2003, scan of (color pages, for clarity, Part 20 of 23 color copies from Binder 4).
Documents submitted in case of *Shuffle Master, Inc*. v. *Card Austria, et al*., Case No. CV-N-0508-HDM-(VPC) Consolidated with Case No. CV-N-02-0244-ERC-(RAM)), May 6, 2003, scan of (color pages, for clarity, Part 21 of 23 color copies from Binder 6).
Documents submitted in case of *Shuffle Master, Inc*. v. *Card Austria, et al*., Case No. CV-N-0508-HDM-(VPC) Consolidated with Case No. CV-N-02-0244-ERC-(RAM)), May 6, 2003, scan of (color pages, for clarity, Part 22 of 23 color copies from Binder 8, part 1 of 2).
Documents submitted in case of *Shuffle Master, Inc*. v. *Card Austria, et al*., Case No. CV-N-0508-HDM-(VPC) (Consolidated with Case No. CV-N-02-0244-ERC-(RAM)), May 6, 2003, Part 15 of 23 (Binder 8, 3 of 5).
Documents submitted in case of *Shuffle Master, Inc*. v. *Card Austria, et al*., Case No. CV-N-0508-HDM-(VPC) (Consolidated with Case No. CV-N-02-0244-ERC-(RAM)), May 6, 2003, Part 16 of 23 (Binder 8, 4 of 5).
Documents submitted in case of *Shuffle Master, Inc*. v. *Card Austria, et al*., Case No. CV-N-0508-HDM-(VPC) (Consolidated with Case No. CV-N-02-0244-ERC-(RAM)), May 6, 2003, Part 17 of 23 (Binder 8, 5 of 5).
Documents submitted in the case of *Shuffle Master, Inc*. v. *6Card Austria, et al*., Case No. CV-N-0508-HDM-(VPC) (Consolidated with Case No. CV-N-02-0244-ERC-(RAM)), May 6, 2003, Part 7 of 23 (Binder 4, 1 of 2).
Documents submitted in the case of *Shuffle Master, Inc*. v. *Card Austria, et al*.. Case No. CV-N-0508-HDM-(VPC) (Consolidated with Case No. CV-N-02-0244-ERC-(RAM)), May 6, 2003, Part 1 of 23 (Master Index and Binder 1, 1 of 2).
Documents submitted in the case of *Shuffle Master, Inc*. v. *Card Austria, et al*., Case No. CV-N-0508-HDM-(VPC) (Consolidated with Case No. CV-N-02-0244-ERC-(RAM)), May 6, 2003, Part 10 of 23 (Binder 6, 2 of 2).
Documents submitted in the case of *Shuffle Master, Inc*. v. *Card Austria, et al*., Case No. CV-N-0508-HDM-(VPC) (Consolidated with Case No. CV-N-02-0244-ERC-(RAM)), May 6, 2003, Part 11 of 23 (Binder 7, 1 of 2).
Documents submitted in the case of *Shuffle Master, Inc*. v. *Card Austria, et al*., Case No. CV-N-0508-HDM-(VPC) (Consolidated with Case No. CV-N-02-0244-ERC-(RAM)), May 6, 2003, Part 12 of 23 (Binder 7, 2 of 2).
Documents submitted in the case of *Shuffle Master, Inc*. v. *Card Austria, et al*., Case No. CV-N-0508-HDM-(VPC) (Consolidated with Case No. CV-N-02-0244-ERC-(RAM)), May 6, 2003, Part 13 of 23 (Binder 8, 1 of 5).
Documents submitted in the case of *Shuffle Master, Inc*. v. *Card Austria, et al*., Case No. CV-N-0508-HDM-(VPC) (Consolidated with Case No. CV-N-02-0244-ERC-(RAM)), May 6, 2003, Part 14 of 23 (Binder 8, 2 of 5).
Documents submitted in the case of *Shuffle Master, Inc*. v. *Card Austria, et al*., Case No. CV-N-0508-HDM-(VPC) (Consolidated with Case No. CV-N-02-0244-ERC-(RAM)), May 6, 2003, Part 3 of 23 (Binder 2, 1 of 2).
Documents submitted in the case of *Shuffle Master, Inc*. v. *Card Austria, et al*., Case No. CV-N-0508-HDM-(VPC) (Consolidated with Case No. CV-N-02-0244-ERC-(RAM)), May 6, 2003, Part 4 of 23 (Binder 2, 2 of 2).
Documents submitted in the case of *Shuffle Master, Inc*. v. *Card Austria, et al*., Case No. CV-N-0508-HDM-(VPC) (Consolidated with Case No. CV-N-02-0244-ERC-(RAM)), May 6, 2003, Part 5 of 23 (Binder 3, 1 of 2).
Documents submitted in the case of *Shuffle Master, Inc*. v. *Card Austria, et al*., Case No. CV-N-0508-HDM-(VPC) (Consolidated with Case No. CV-N-02-0244-ERC-(RAM)), May 6, 2003, Part 6 of 23 (Binder 3, 2 of 2).

(56) References Cited

OTHER PUBLICATIONS

Documents submitted in the case of *Shuffle Master, Inc*. v. *Card Austria, et al*., Case No. CV-N-0508-HDM-(VPC) (Consolidated with Case No. CV-N-02-0244-ERC-(RAM)), May 6, 2003, Part 8 of 23 (Binder 4, 2 of 2).
Documents submitted in the case of *Shuffle Master, Inc*. v. *Card Austria, et a*l., Case No. CV-N-0508-HDM-(VPC) (Consolidated with Case No. CV-N-02-0244-ERC-(RAM)), May 6, 2003, Part 9 of 23 (Binder 5 having no contents; Binder 6, 1 of 2).
DVD Labeled "Luciano Deel. Ex. K". This DVD includes the video taped live Declaration of Mr. Luciano taken during preparation of litigation (Oct. 23, 2003).
DVD labeled Morrill Decl. Ex. A:. This is the video taped live Declaration of Mr. Robert Morrill, a lead trial counsel for he defense, taken during preparation for litigation. He is describing the operation of the Roblejo Prototype device. See Roblejo patent in 1449 or of record (Jan. 15, 2004).
Canadian Office Action for Canadian Application No. 3,033,280, dated Apr. 14, 2021, 4 pages.
Taiwan Examination Report, for Taiwan Application No. 106131789, dated Mar. 31, 2021, 19 pages with English Translation.

* cited by examiner

CARD-HANDLING DEVICES AND RELATED METHODS, ASSEMBLIES, AND COMPONENTS

CROSS-REFERENCE TO RELATED APPLICATION

This application claims the benefit under 35 U.S.C. § 119(e) of U.S. Provisional Patent Application Ser. No. 62/911,907, filed Oct. 7, 2019, the disclosure of which is hereby incorporated herein in its entirety by this reference.

TECHNICAL FIELD

The disclosure relates to card-handling devices and related assemblies, components, and methods. In particular, embodiments of the disclosure relate to card-handling devices, card input portions of card-handling devices, card output portions of card-handling devices, card-shuffling carousels of card-handling devices, and methods of shuffling cards.

BACKGROUND

Wagering games are often based on the outcome of randomly generated arrangements of cards. Such games are widely played in gaming establishments and, often, a single deck or multiple decks of fifty-two (52) playing cards may be used to play the game. Gaming using multiple decks of playing cards may include, for example, six to ten decks used in games such as blackjack and baccarat and one or two decks of playing cards used in games such as single and double deck blackjack. Many other specialty games may use single or multiple decks of cards, with or without jokers and with or without selected cards removed or special cards added.

From the perspective of players, the time the dealer must spend in shuffling diminishes the excitement of the game. From the perspective of casinos, shuffling time reduces the number of hands played and specifically reduces the number of wagers placed and resolved in a given amount of time, consequently reducing casino revenue. Casinos would like to increase the amount of revenue generated by a game without changing the game or adding more tables. One option to increase revenue is to decrease the time the dealer spends handling and shuffling playing cards. This may be accomplished by using one set of cards to administer the game while shuffling a second set of cards. Other options include decreasing shuffling time.

The desire to decrease shuffling time has led to the development of mechanical and electromechanical card-shuffling devices. Such devices increase the speed of shuffling and dealing, thereby increasing actual playing time. Such devices also add to the excitement of a game by reducing the amount of time the dealer or house has to spend in preparing to play the game.

BRIEF SUMMARY

Some embodiments of the present disclosure may include a card-handling device. The card-handling device may include a card intake configured to receive playing cards. The card-handling device may further include a card output configured to provide at least some of the playing cards to a user. The card-handling device may also include a card imaging device positioned between the card intake and the card output. The card imaging device may be configured to identify whether a card face of the at least some of the playing cards are positioned in an expected orientation or whether the card face is in an unexpected orientation comprising one or more flipped cards. The card-handling device may further include a card-flipping apparatus configured to reorient the one or more flipped cards in order to return the card face of the one or more flipped cards to the expected orientation.

Some embodiments of the present disclosure may include a method of handling flipped cards. The method may include receiving one or more playing cards in a card input of a card-handling device. The method may further include transporting the one or more playing cards from the card input to a card-shuffling apparatus of the card-handling device. The method may also include imaging the one or more playing cards with an imaging apparatus between the card input and the card-shuffling apparatus. The method may further include identifying flipped cards of the one or more playing cards. The method may also include supplying the one or more playing cards to the card-shuffling apparatus. The method may also include inverting the flipped cards in a card-flipping apparatus. The method may further include outputting at least some of the one or more playing cards from the card-shuffling apparatus.

Another embodiment of the present disclosure may include a method of handling non-conforming cards. The method may include receiving cards into a card-handling device at a card input. The method may also include imaging the cards as the cards are transported between the card input and a card output of the card-handling device. The method may further include identifying non-conforming cards. The method may also include placing the non-conforming cards in a designated location in a card-shuffling apparatus. The method may further include shuffling an order of the cards in the card-shuffling apparatus. The method may also include outputting at least one card to the card output after the at least one card has been shuffled by the card-shuffling apparatus. The method may further include outputting the non-conforming cards from the designated location separately from the cards.

BRIEF DESCRIPTION OF THE DRAWINGS

While the specification concludes with claims particularly pointing out and distinctly claiming embodiments of the present disclosure, the advantages of embodiments of the disclosure may be more readily ascertained from the following description of embodiments of the disclosure when read in conjunction with the accompanying drawings in which:

DETAILED DESCRIPTION

Figure 1:
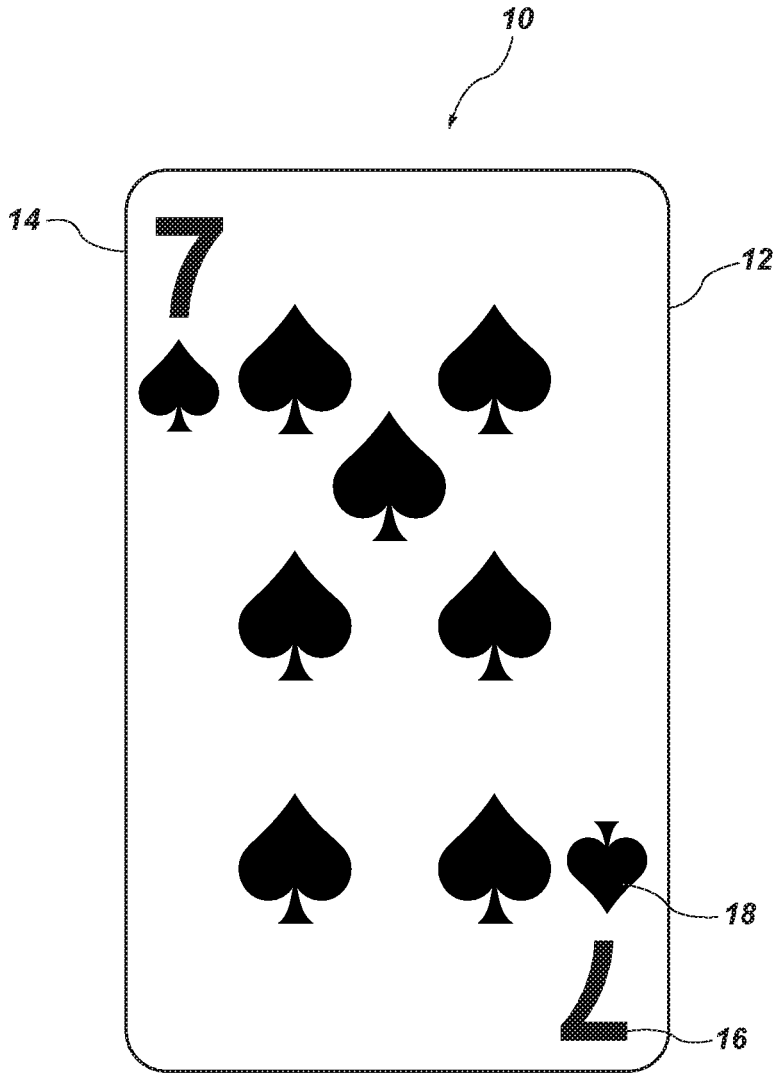
FIG. 1 shows a planar view of a front of a card.

The illustrations presented herein are not meant to be actual views of any particular card-handling device or component thereof, but are merely idealized representations employed to describe illustrative embodiments. The drawings are not necessarily to scale. Elements common between figures may retain the same numerical designation.

As used herein, any relational term, such as "first," "second," "over," "beneath," "top," "bottom," "underlying," "up," "down," etc., is used for clarity and convenience in understanding the disclosure and accompanying drawings, and does not connote or depend on any specific preference, orientation, or order, except where the context clearly indicates otherwise. For example, these terms may refer to an orientation of elements of the card-handling device relative to a surface of a table on which the card-handling device may be positioned, mounted, and/or operated (e.g., as illustrated in the figures).

As used herein, the terms "vertical" and "horizontal" may refer to a drawing figure as oriented on the drawing sheet, and are in no way limiting of orientation of an apparatus, or any portion thereof, unless it is apparent that a particular orientation of the apparatus is necessary or desirable for operation in view of gravitational forces. For example, when referring to elements illustrated in the figures, the terms "vertical" or "horizontal" may refer to an orientation of elements of the card-handling device relative to a table surface of a table to which the card-handling device may be mounted and operated.

As used herein, the term "and/or" means and includes any and all combinations of one or more of the associated listed items.

As used herein, the terms "substantially," "approximately," or "about" in reference to a given parameter means and includes to a degree that one skilled in the art would understand that the given parameter, property, or condition is met with a degree of variance, such as within acceptable manufacturing tolerances, or wherein the variance is with respect to a general parameter, such as an orientation. For example, a parameter that is substantially met may be at least about 90% met, at least about 95% met, at least about 99% met, or even 100% met. In another example, a direction (e.g., parallel, perpendicular, down, up, etc.) that is substantially met may be +/−20° from the direction, such as +/−10° from the direction, or +/−1° from the direction.

FIG. 1 shows a front (e.g., face) of a card 10. The card 10 may have a first long edge 12 (e.g., first lateral edge) and an opposite long edge 14 (e.g., opposite lateral edge). The front of the card 10 may include card value information, such as a rank 16 and/or a suit 18 (e.g., hearts, diamonds, clubs, or spades). The rank 16 and suit 18 may be positioned in substantially the same position on the front of each card 10 in a deck of cards. A standard deck of cards may include about fifty-two cards with about thirteen cards in each of four different suits.

Figure 2:
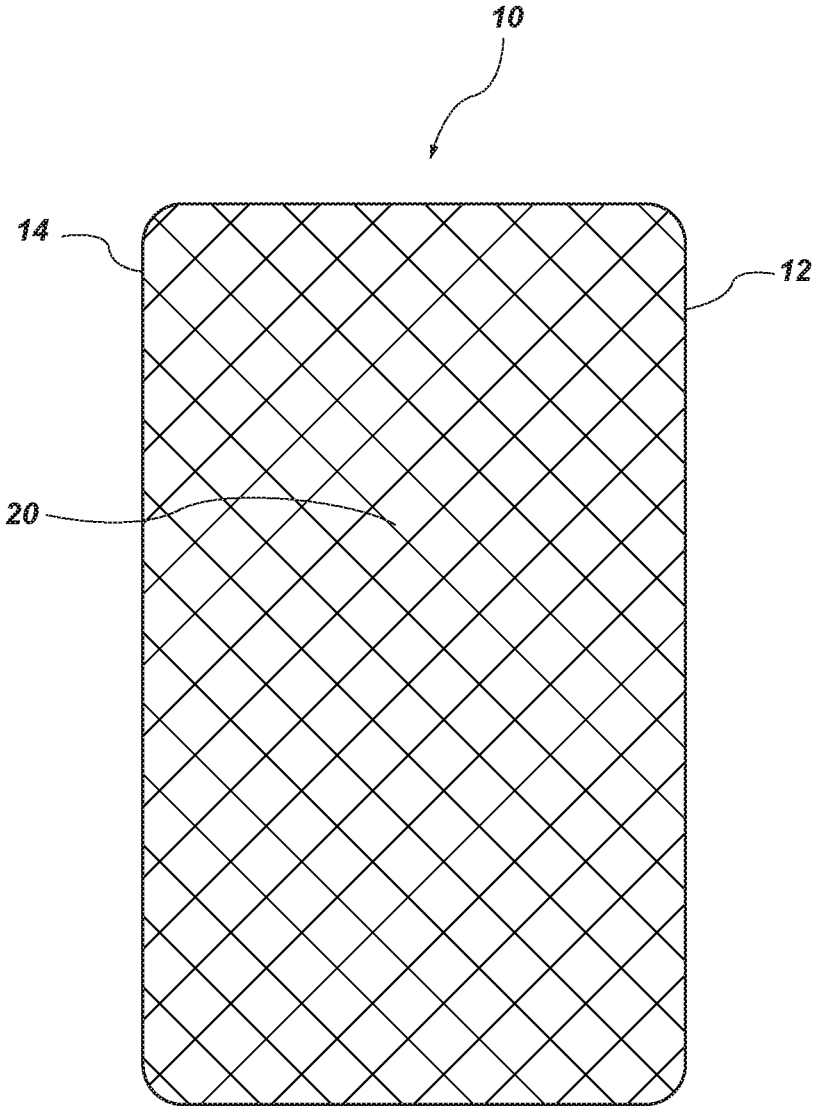
FIG. 2 shows a planar view of a back of the card in FIG. 1.

FIG. 2 illustrates a back of an embodiment of the card 10. The back of the card 10 may be substantially free from identifying markings (e.g., indication of a value of the card). For example, the back of the card 10 may be substantially the same for all of the cards 10 in a deck of cards. In some embodiments, the back of the card 10 may include a pattern 20, such as a diamond pattern 20, as shown in FIG. 2. In some embodiments, the back of the card 10 may include an image or graphic, such as a logo. In some embodiments, the back of the card 10 may be a solid color.

During the course of a game using a deck of playing cards, such as poker, black jack, baccarat, etc. a dealer may provide cards to a group of players and collect the cards after each game or round. The collected cards may be placed into a discard pile. The discard pile may be reshuffled before entering game play again. Some establishments may use an automatic shuffler at the table to shuffle the discarded cards. In some embodiments, the automatic shuffler may be configured to shuffle multiple decks of cards to substantially prevent cheating such as card counting. For example, some establishments may use continuous shufflers such as, the Shuffle Star shuffler as described in U.S. Patent Application Publication No. U.S. 2018/0243642 A1, the disclosure of which is hereby incorporated herein in its entirety by this reference. Some automatic shufflers may be configured to shuffle a card orientation as well to substantially prevent other types of cheating such as edge sorting. For example, some automatic shufflers may include components configured to rotate cards within the automatic shuffler, such as the automatic shufflers described in U.S. patent application Ser.

No. 16/132,090, filed Sep. 14, 2018, PCT Application No. PCT/US19/027460, filed Apr. 15, 2019, and U.S. patent application Ser. No. 16/457,357, filed Jun. 28, 2019, the disclosure of each of which is hereby incorporated herein in its entirety by this reference.

When placing the cards in the discard pile and/or the infeed area of a shuffling device, the dealer should reorient the cards face-down such that the cards are all oriented in the same way. However, cards are frequently reinserted into the shuffling devices in the wrong face orientation. In additional embodiments, a new deck of cards may include cards in an erroneous orientation. Regardless of the case, cards inserted with the wrong face orientation may cause delays or errors in the automatic shufflers. For example, a card inserted in the wrong face orientation may cause the shuffling devices to stop the shuffle and alert the dealer through an error message or to abort the shuffle entirely resulting in a delay for the associated gaming table. Some embodiments of the present disclosure may enable a shuffling device to handle a card with the wrong face orientation without stopping or aborting the shuffle.

Figure 3:
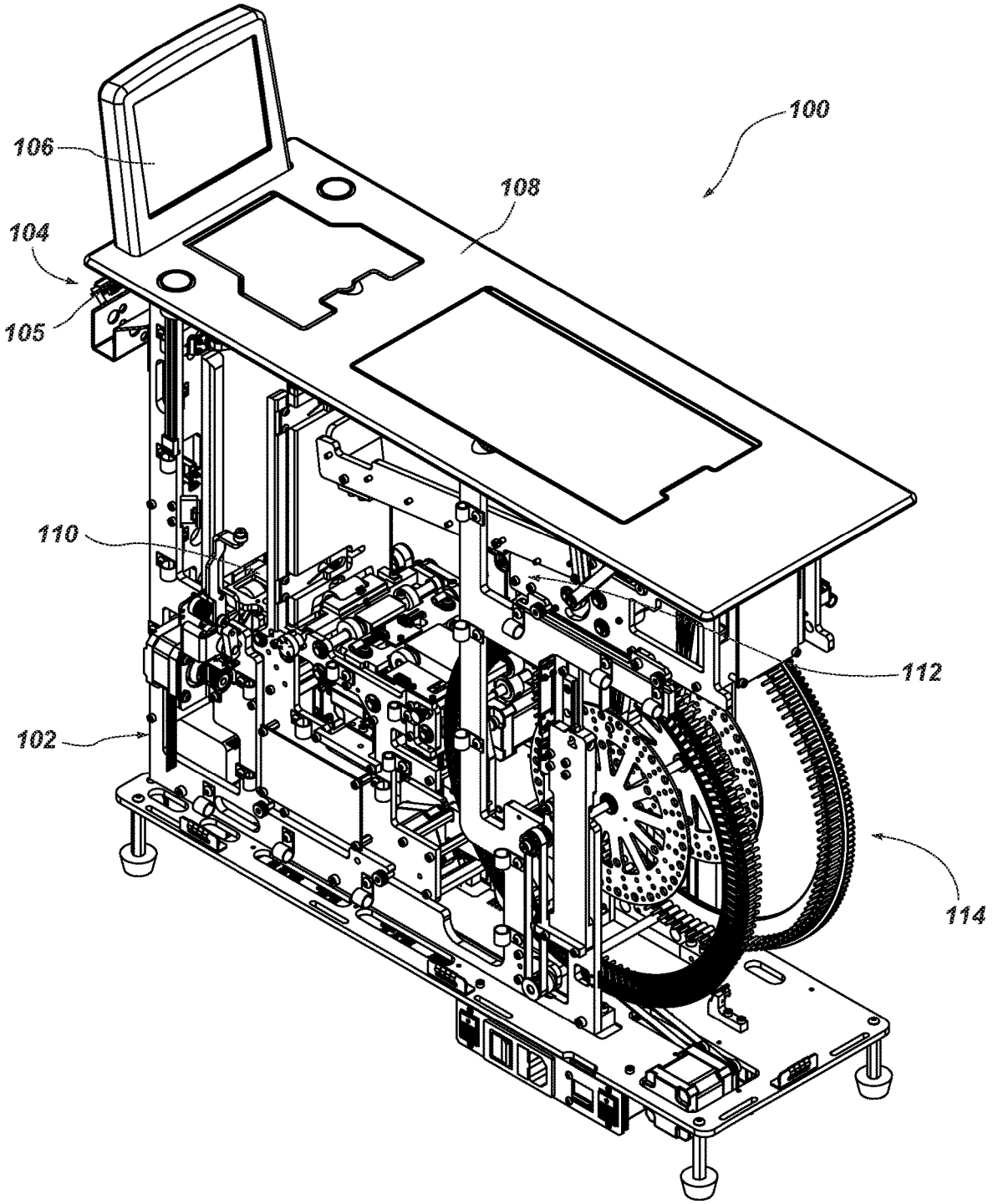
FIG. 3 shows an isometric view of an embodiment of the present disclosure with covers removed to show the internal mechanism.

FIG. 3 shows a perspective view of a card-handling device 100, according to an embodiment of the present disclosure, having portions of one or more housings (e.g., side covers, panels, etc.) of the card-handling device 100 removed to show interior components of the card-handling device 100. The card-handling device 100 may be configured to be mounted with at least a majority of the card-handling device 100 beneath a level of a gaming structure, for example, a table surface (e.g., a gaming table surface) of a table (e.g., a gaming table) and to deliver shuffled playing cards to the table surface and/or receive playing cards to be shuffled from or proximate the table surface. The card-handling device 100 may include a frame structure 102, a control system 104 in communication with one or more displays 105, 106, and a substantially flat top surface 108 that may be substantially co-planar with the table surface when placed for use with the table. In some embodiments, the control system 104 may include an integrated control panel and/or display 105, which may be utilized by an operator (e.g., a dealer) to operate the card-handling device 100. The integrated control panel and/or display 105 may be positioned to face in a direction toward an expected position of the operator. In some embodiments, the display 106 may be positioned to face in a direction toward an expected position of the players at a gaming surface or table and may be utilized to display game related information (e.g., games odds, game table limits, advertisements, etc.) to the players.

As discussed herein, any disclosure regarding the functioning of the card-handling device 100 and associated components may be performed (e.g., automatically performed without operator intervention) by one or more portions (e.g., local or remote portions) of the card-handling device 100 (e.g., one or more processors of the control system 104, optionally along with associated memory). In other embodiments, the functions may be at least partially performed by (e.g., by inputting one or more commands into the control system 104 or manually), or assisted by, the operator.

Figure 4:
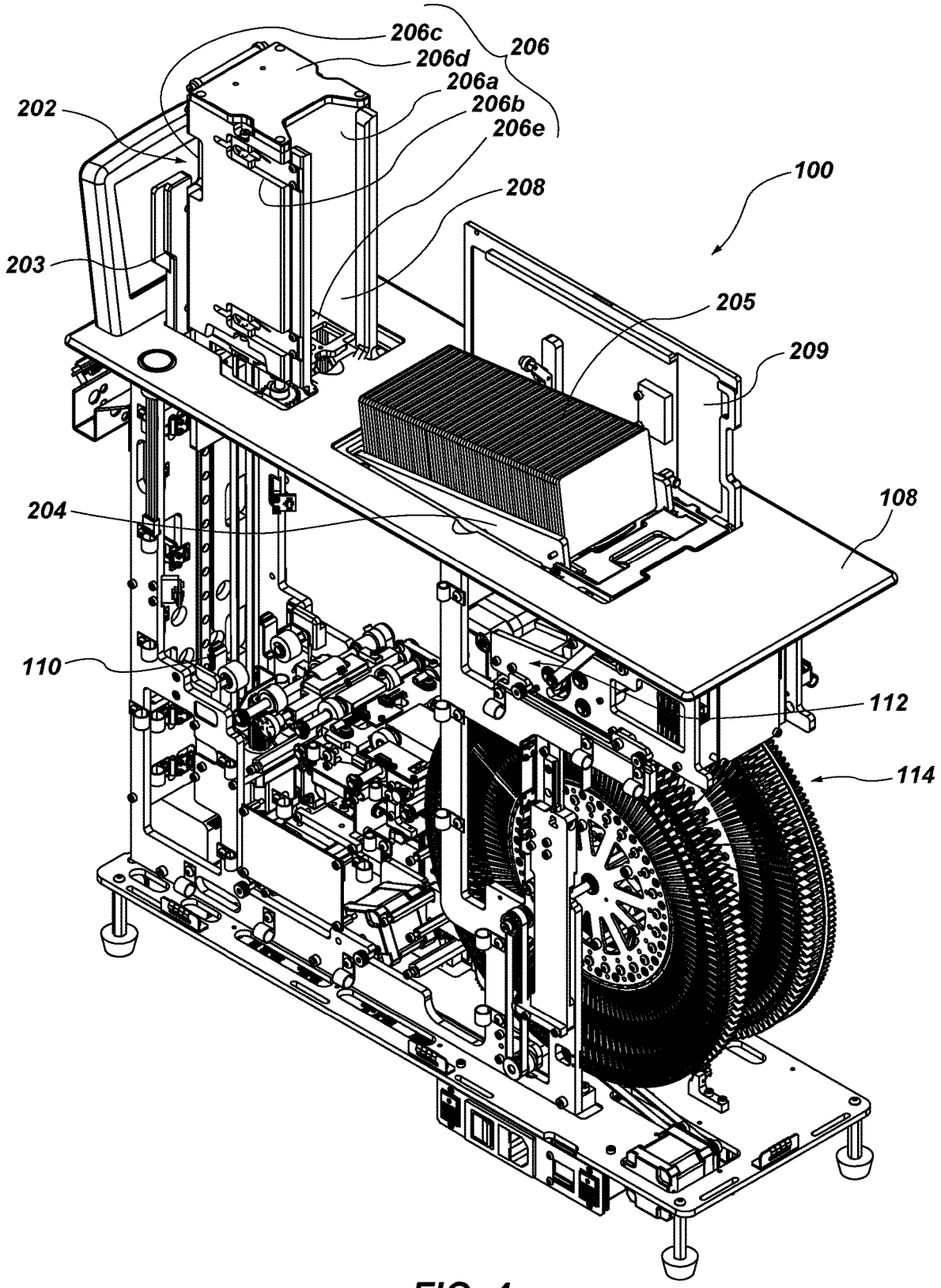
FIG. 4 shows an isometric view of an embodiment of the present disclosure with covers removed to show the internal mechanism.

FIG. 4 shows a perspective view of the card-handling device 100, according to an embodiment of the present disclosure, having portions of one or more housings (e.g., covers) of the card-handling device 100 removed to show interior components of the card-handling device 100. The card-handling device 100 may include a card input portion 110 and a card output portion 112. A set of shuffled cards 205 are shown in the output portion 112. In some embodiments, the card input portion 110 may be configured to move (e.g., elevate) a card intake area 202 toward (e.g., above) the top surface 108 when an operator (e.g., dealer) needs to interact with the card input portion 110, such as, for example, to insert playing cards that are ready to be shuffled into the card intake area 202. The card input portion 110 may retract the card intake area 202 below the top surface 108, as shown in FIG. 3, when the operator does not need to interact with the card input portion 110, or when the playing cards collected in the card intake area 202 are to be shuffled. In some embodiments, the card output portion 112 may be configured to elevate a card outlet 204 and hold a group of shuffled cards 205 above the top surface 108 when an operator needs to interact with the card output portion 112, such as, for example, to remove playing cards 205 that have been shuffled from the card outlet 204 for insertion into a shoe, or to enter the cards 205 directly into game play (e.g., dealing or drawing). The card outlet 204 may retract the card outlet 204 below the top surface 108, as shown in FIG. 3, when the operator does not need to interact with the card outlet 204. When the playing cards collected in the card-shuffling apparatus 114 have been shuffled and are ready to be inserted into the card outlet 204 for reentry into game play, the card outlet 204 may be elevated.

Figure 5:
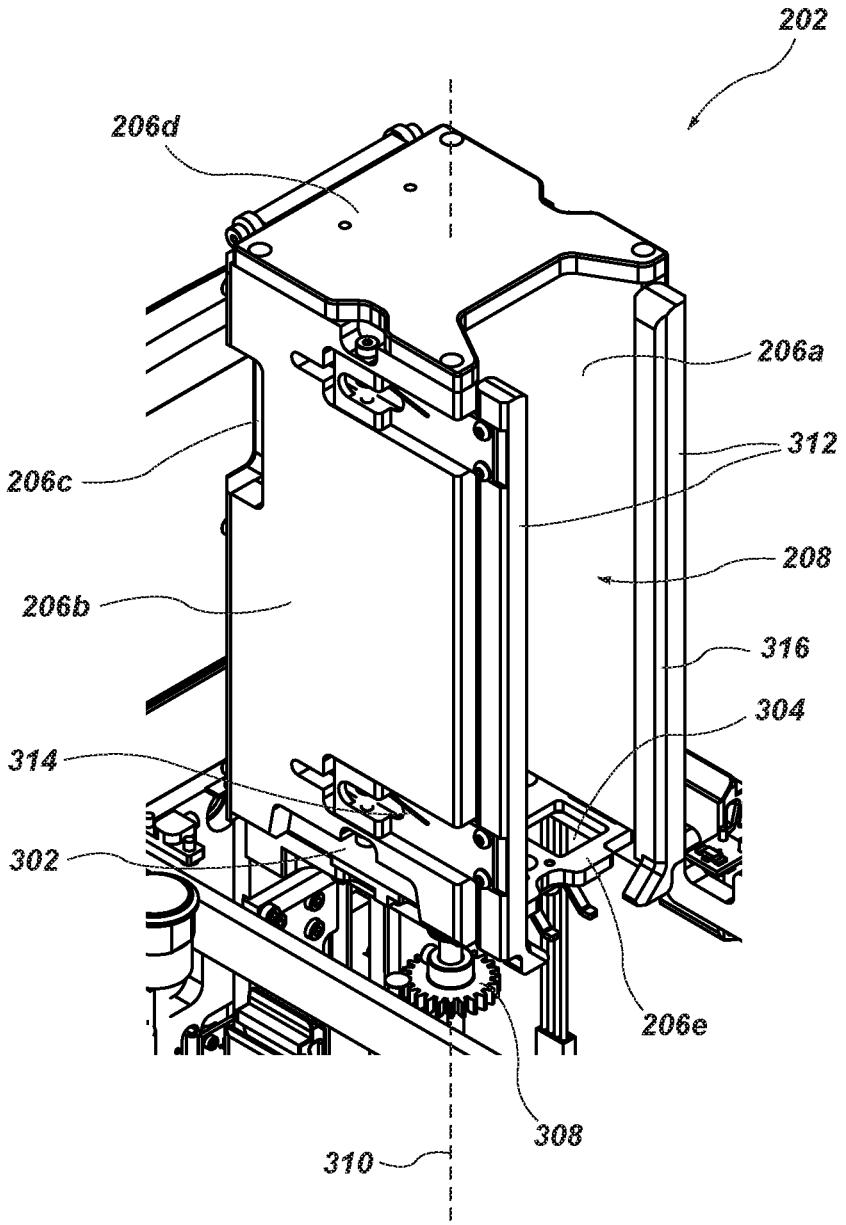
FIG. 5 shows an isometric view of a card intake area according to an embodiment of the present disclosure.

In some embodiments as shown in FIG. 5, the card intake area 202 may have a partially enclosed internal volume, for example, defined by at least two walls 206. For example, the card intake area 202 may have a first sidewall 206*a* and a second sidewall 206*b*, such that the playing cards can only be placed in the card intake area 202 in one orientation. In some embodiments, the card intake area 202 may include a back wall 206*c* to regulate the uniformity of the stack of playing cards in the intake area 202 by providing a uniform stop when cards are placed in the intake area 202. In some embodiments, the card intake area may include a top wall 206*d* (e.g., a fixed top wall 206*d*) and or a bottom wall 206*e* further defining the intake area. In other embodiments, the top wall 206*d* may be rotatable to open an upper portion of the card intake area 202 for access from above. In some embodiments, the card intake area 202 may include an open face 208 sized and configured to enable cards to be placed within the card intake area 202. In some embodiments, the open face 208 may be a front face of the card intake area 202. In some embodiments, the open face may be a top face. In other embodiments, the open face may be more than one face of the card intake area 202, such as, for example, the front face and a side face, wherein the card intake area 202 is defined by a first sidewall 206*a* and a back wall 206*c*, a first sidewall 206*a*, a back wall 206*c*, and a top wall 206*d*, or any other combination of walls 206. In some embodiments, the card intake area 202 may be defined by walls 206 on every face. For example, the card intake area may be defined by a first sidewall 206*a*, a second sidewall 206*b*, a back wall 206*c*, a top wall 206*d*, a bottom wall 206*e*, and a front wall. In some embodiments, at least one of the walls 206 may include an open area (e.g., slot, aperture, hole, cutout, or gap) and/or may be movable to enable the playing cards to be inserted into the card intake area. In some embodiments, the sidewalls 206*a*, 206*b* may coincide with a long dimension of the playing cards (e.g., longitudinal axis) and the back wall 206*c* may coincide with a short dimension of the playing cards (e.g., lateral axis).

In some embodiments, the card intake area 202 may be configured to hold up to 650 playing cards, such as, between about 50 playing cards and about 650 playing cards, or between about 500 playing cards and about 600 playing cards, or about 520 playing cards (e.g., about ten decks of cards with or without extra cards, such as wild or other special cards).

In some embodiments, the card intake area 202 and card outlet 204 may be configured to elevate and retract relative to the top surface 108 of the card-handling device 100. The card intake area 202 and card outlet 204 may retract below the gaming surface, such that the card-handling device 100 with the exception of display 106, has a minimal, if any profile above the gaming surface, as shown in FIG. 3 (e.g., may be positioned entirely below the top surface 108). A lid 203 as shown in FIG. 4 may open and close to enable the card intake area 202 to be elevated over the top surface 108 and to enclose the card intake area 202 in the card-handling device 100 when the card intake area 202 is retracted. In some embodiments, the lid 203 may rotate between open and closed positions (e.g., on a hinge). In other embodiments, the lid 203 may move in a different manner, for example, the lid 203 may be coupled to the card intake area 202 (e.g., at top wall 206*d*) and may translate above the top surface 108 as the card intake area 202 is elevated. An outlet lid 209 may open and close to enable the card outlet 204 to be elevated over the top surface 108 and to enclose the card output portion 112 in the card-handling device 100 when the card outlet 204 is retracted. In some embodiments, the outlet lid 209 may rotate between open and closed positions. In other embodiments, the outlet lid 209 may move in a different manner, for example, the outlet lid 209 may be coupled to the card outlet 204 and may translate above the top surface 108 as the card outlet 204 is elevated.

Maintaining a low profile while not in use may reduce the area required for the card-handling device to be used in or adjacent to gaming tables, which may reduce the size required for a gaming table to occupy. In some embodiments, the card-handling device 100 may have a profile such that the top surface 108 may be incorporated into the gaming surface with the game being played on at least a portion of the top surface 108 of the card-handling device 100, which may result in the dedicated space for the card-handling device 100 in the surface of the gaming table being reduced and/or eliminated. In other embodiments, the card-handling device may be placed adjacent to a gaming table on the dealer side thereof, and supported by the gaming table via a bracket system or on the casino floor with height-adjustable legs or a pedestal.

FIG. 5 shows an isometric view of the card intake area 202 of the card-handling device 100 in an elevated position. In some embodiments, the card intake area 202 may include at least one sidewall 206*a*, 206*b*, a back wall 206*c*, a top wall 206*d*, and a bottom wall 206*e*. In some embodiments, a gap 302 may be defined between at least one of the sidewalls 206*a*, 206*b* and the bottom wall 206*e* (e.g., both of the sidewalls 206*a*, 206*b*). The gap 302 may be large enough that at least one card may pass through the gap 302 in order to be moved further into the card-handling device 100 for a shuffling operation. In some embodiments, the gap 302 may be defined in at least one of a back wall 206*c* and/or a front wall.

In some embodiments, the bottom wall 206*e* may include at least one aperture 304 (e.g., void, opening, hole, etc.). In some embodiments, the at least one aperture 304 may allow the card input portion 110 (FIG. 4) of the card-handling device 100 to interface with unshuffled cards stored within the card intake area 202, when the card intake area 202 has been rotated about axis 310 by about ninety degrees such that the gap 302 faces towards the card-shuffling mechanism, as shown in FIG. 5. For example, idler and/or pick-off rollers 610 (FIG. 8) may protrude through the at least one aperture 304 to interface with at least one card that may be resting on the bottom wall 206*e* in order to move the at least one card through the gap 302 and out of the card intake area 202.

Referring back to FIG. 5, in some embodiments, the card intake area 202 includes an open face 208 for receiving unshuffled cards. This open face 208 may face in a direction, as illustrated in FIG. 5, during card loading. During card distribution, this open face may be positioned 90 degrees from the direction illustrated in FIG. 5. In some embodiments, the open face 208 may include retention brackets 312 configured to secure the cards within the card intake area 202 during rotation of the card intake area 202. For example, the retention brackets 312 may be automated such that, when the card intake area 202 arrives in the elevated position, the retention brackets 312 may open providing a substantially enlarged area in the open face 208 for inputting unshuffled cards. Before the card intake area 202 retracts, the retention brackets 312 may close at least partially blocking the open face 208 such that the unshuffled cards when in a horizontal position cannot be inserted or removed through the open face 208. The retention brackets 312 may then secure the unshuffled cards within the card intake area 202 during the elevating and/or retracting motion of the card intake area 202, and during rotation. In some embodiments, the retention brackets 312 may be manually operated by the operator. For example, the operator may input a command into the control system 104 (FIG. 3, which may include an input and a display) to open and/or close the retention brackets 312 or the operator may directly manipulate the retention brackets 312 between open and closed or secured positions.

In some embodiments, the retention brackets 312 may have biasing elements 314 (e.g., springs, resilient members, compressible fluid, etc.) configured to bias the retention brackets 312 toward a closed position. In some embodiments, the retention brackets 312 may have an angular face 316, such that, when the operator inserts the unshuffled cards between the retention brackets 312 the retention brackets 312 are forced into an open position by the interface between the unshuffled cards and the angular face 316 of the retention brackets 312. The biasing elements 314 may return the retention brackets 312 to a closed position after the unshuffled cards have passed through the open face 208 between the retention brackets 312.

In some embodiments, the card intake area 202 may include a rotational input 308 (e.g., spindle, gear, shaft, differential, motor, gearbox, or cog). The rotational input 308 may be configured to rotate the card intake area 202 about a vertical axis 310 of the card intake area 202.

Figure 6:
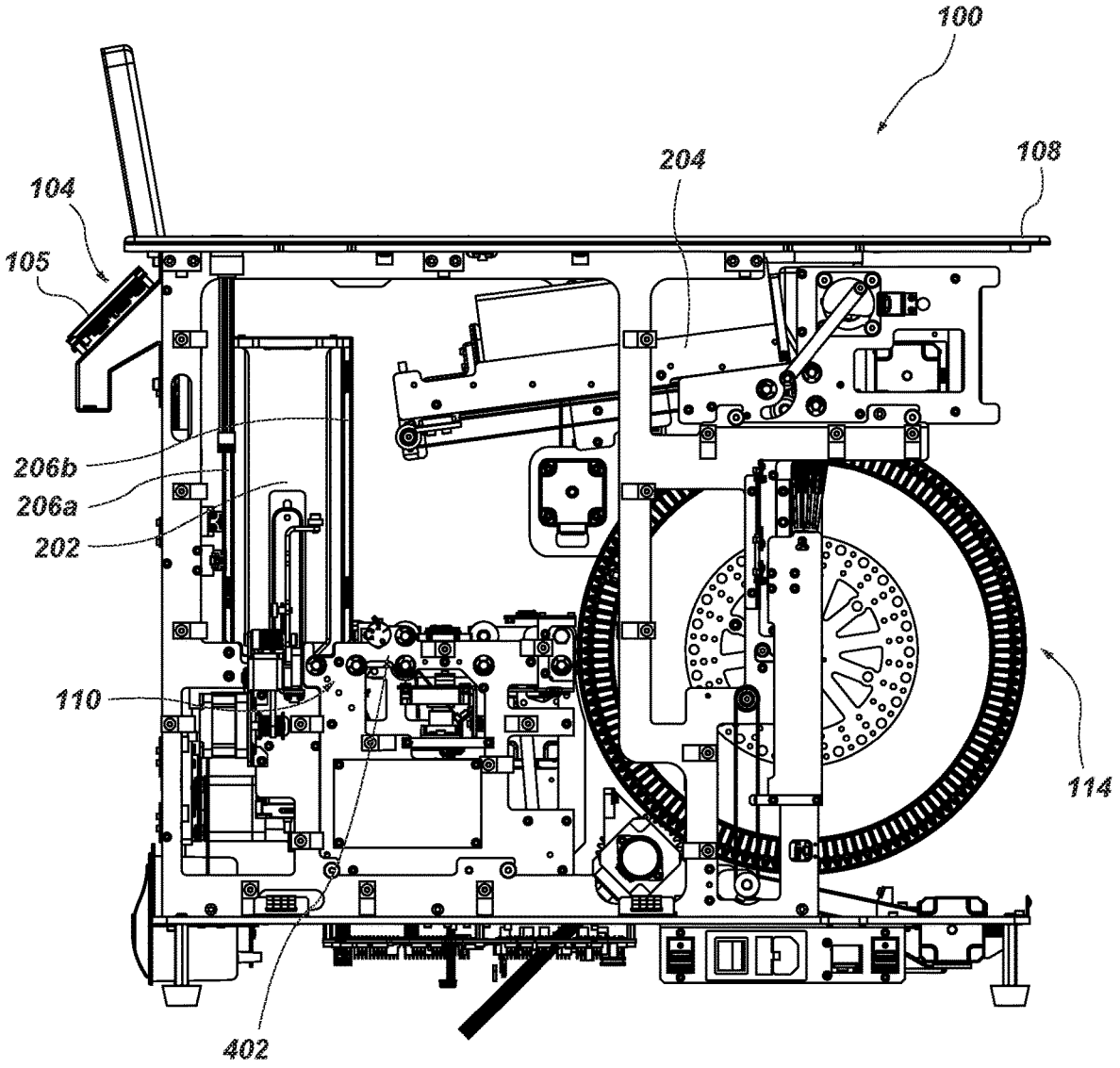
FIG. 6 shows an elevational side view of an embodiment of the present disclosure with covers removed to show the internal mechanism.

FIG. 6 shows an elevational side view of the card-handling device 100 with the card intake area 202 in a retracted position within the card-handling device 100. In some embodiments, the card intake area 202 may rotate such that, in the retracted position, the sidewalls 206*a*, 206*b* are in a front and back location relative to the card-handling device 100. For example, the card intake area 202 may rotate at least 90°, such as, for example, ±90°, ±270° as the card intake area 202 retracts into the retracted position and/or after the card intake area 202 is in the retracted position. In some embodiments, when the card intake area 202 is in the retracted position the card intake area 202 may be integrated into the card input portion 110. In some embodiments, the card input portion 110 may include a first card feed system 402 configured to transport the playing cards from the card intake area 202 to the card-shuffling apparatus 114. The playing cards may exit the card intake area 202 through the one of the gaps 302 (FIG. 5) in the sidewalls 206*a*, 206*b* (e.g., the gap 302 facing a first card feed system 402 leading to a shuffling apparatus).

Figure 7:
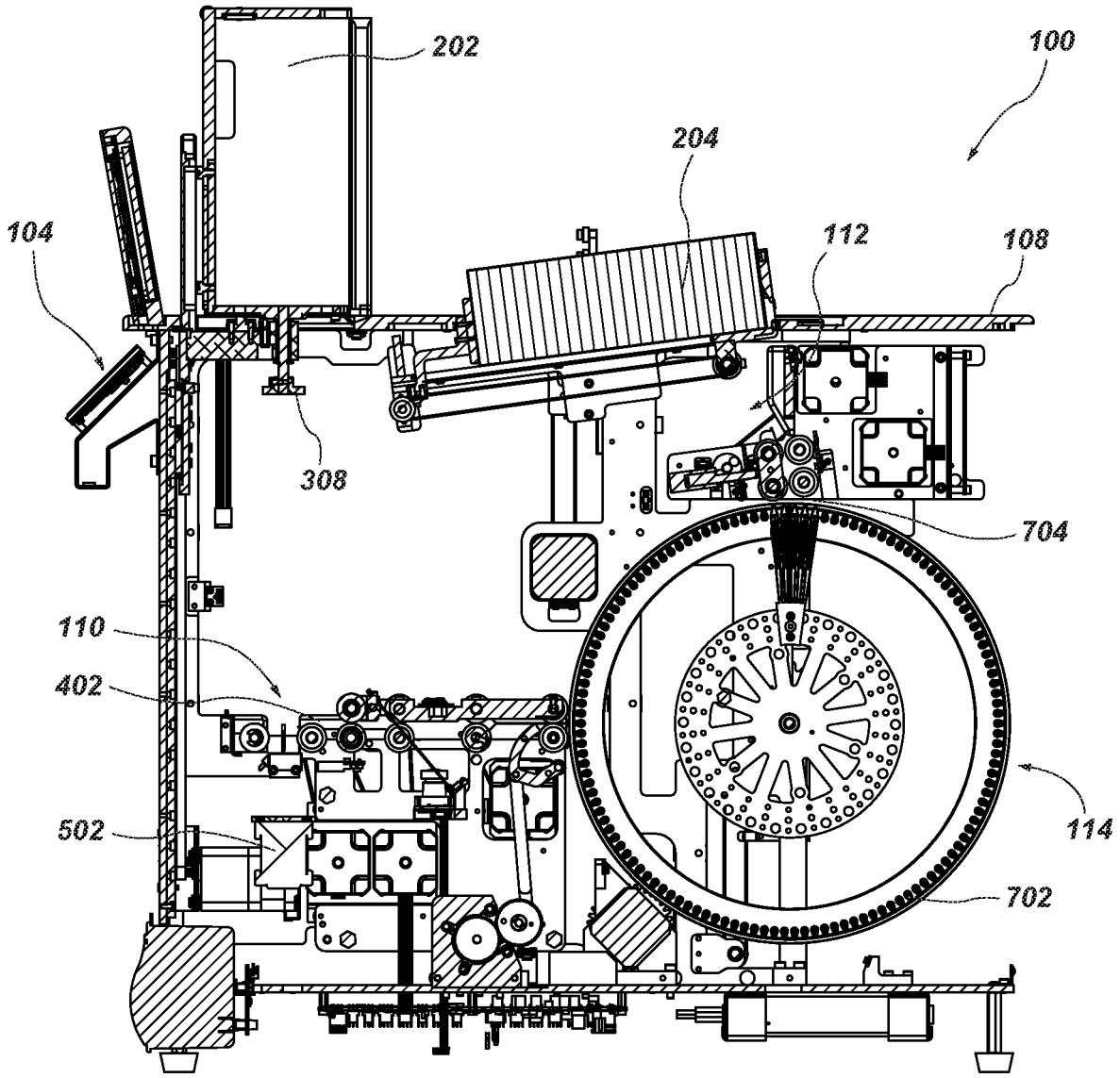
FIG. 7 show a section view of an elevational side view of an embodiment of the present disclosure.

FIG. 7 is an elevational side section view of the card-handling device 100 with both the card intake area 202 and the card outlet 204 in the elevated position. As depicted the rotational drive 502 for the card intake area 202 may remain integral to the other components of the card input portion 110, such as the first card feed system 402. The rotational drive 502 may only engage the rotational input 308 when the card intake area 202 is in the retracted position. In some embodiments, the first card feed system 402 may be substantially aligned in a substantially horizontal plane. For example, the playing cards may exit the card intake area 202 in a substantially horizontal plane and may continue through the first card feed system 402 and into the card-shuffling apparatus 114 in the same substantially horizontal plane.

Figure 8:
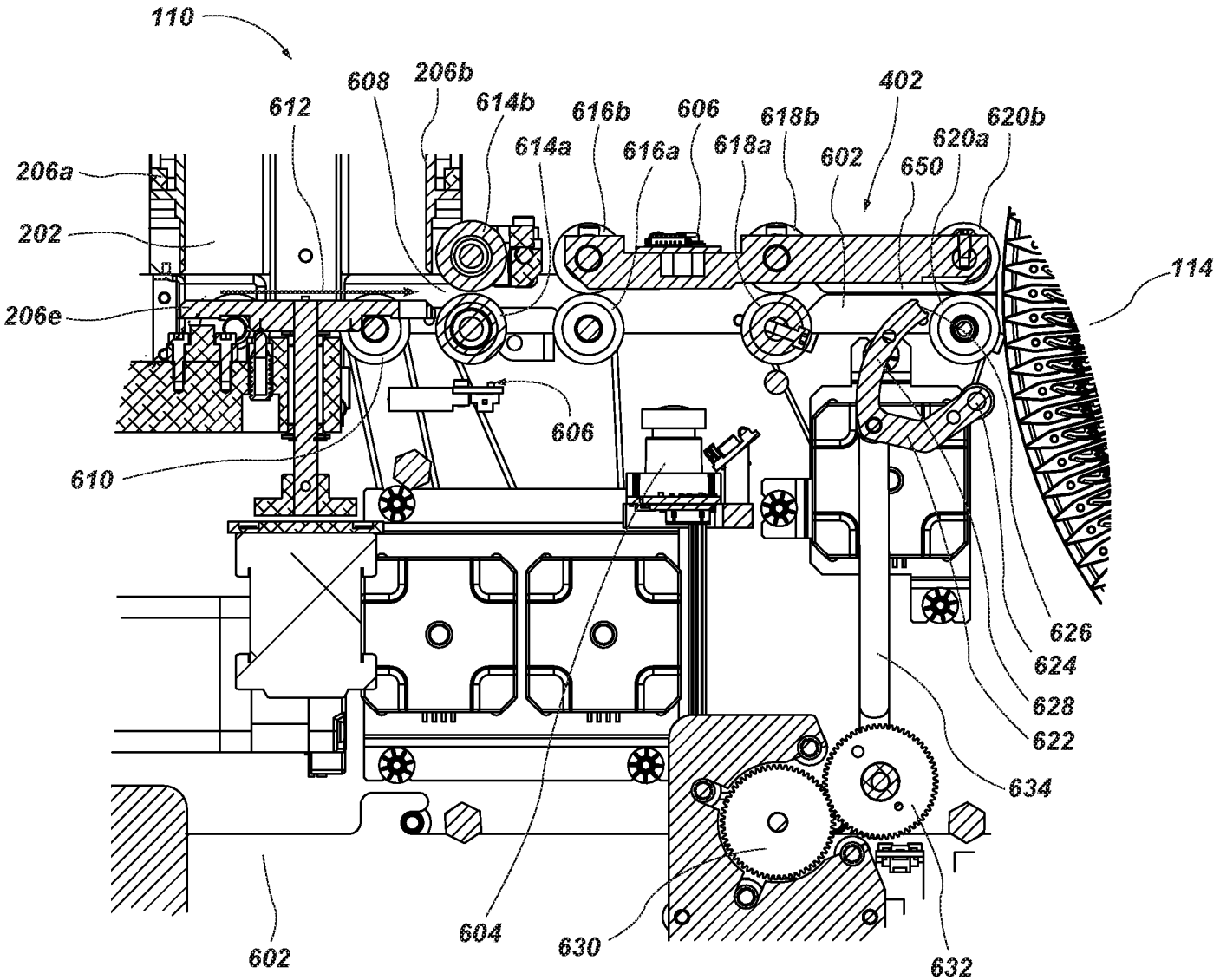
FIG. 8 shows an enlarged view of a section view of a card input portion according to an embodiment of the present disclosure.

FIG. 8 shows an enlarged view of the card input portion 110 from the side section view of the card-handling device 100. The card input portion 110 may include the first card feed system 402, a first frame assembly 602, a card-imaging system 604, and one or more sensors 606. The first card feed system 402 may include a first card pathway 608 (e.g., pathway along which playing cards move through the card input portion 110). The first card pathway 608 may lead from the card intake area 202 of the card input portion 110 to the card-shuffling apparatus 114 (e.g., a carousel). The first card feed system 402 may include a set of pick-off rollers 610 that may transport playing cards individually from the card intake area 202 to the first card pathway 608 in a direction indicated by arrow 612. In some embodiments, the pick-off rollers 610 may protrude through the at least one aperture 304 (FIG. 5) in the bottom wall 206*e* of the card intake area 202. The pick-off rollers 610 may remove the playing cards individually from a bottom area of the card intake area 202 through the gaps 302 (FIG. 5) in the sidewalls 206*a*, 206*b*. Additional pairs of rollers 614*a*, 614*b*, 616*a*, 616*b*, 618*a*, 618*b*, 620*a*, and 620*b* may act to displace playing cards from the card intake area 202 to the card-shuffling apparatus 114 (e.g., one card at a time). For example, a stack of unshuffled playing cards may be placed in the card intake area 202, and the set of pick-off rollers 610 of the first card feed system 402 may remove playing cards (e.g., individually) from a bottom of (e.g., beneath) the stack of unshuffled playing cards and pass the playing cards to the additional pairs of rollers 614*a*, 614*b*, 616*a*, 616*b*, 618*a*, 618*b*, 620*a*, and 620*b*, some of which may be brake rollers. The additional pairs of rollers 614*a*, 614*b*, 616*a*, 616*b*, 618*a*, 618*b*, 620*a*, and 620*b* may transport the playing cards to the card-shuffling apparatus 114. As discussed above, the card intake area 202 may be configured to receive one or more decks of playing cards (e.g., one, two, four, six, eight, ten decks of cards, etc.) at a time.

In some embodiments, the card-imaging system 604 may be oriented along the first card pathway 608 of the first card feed system 402. The first card feed system 402 may transport playing cards past the card-imaging system 604, and the card-imaging system 604 may capture identifying information of each playing card as each playing card moves along the first card pathway 608 before insertion into the card-shuffling apparatus 114. For example, the card-imaging system 604 may include a camera or line scanning device that captures an image or scan of each card. In some embodiments, the card-imaging system 604 may comprise one or more of the imaging devices described in U.S. Pat. No. 7,933,448 to Downs, issued Apr. 26, 2011, in U.S. Pat. No. 7,764,836 to Downs et al., issued Jul. 27, 2010, or in U.S. Pat. No. 8,800,993 B2 to Blaha et al., issued Aug. 12, 2014, the disclosure of each of which is incorporated herein in its entirety by this reference. In some embodiments, the card-imaging system 604 may not need to capture an image of an entire card, but may detect only rank and suit information, indicia (e.g., markings) on the playing cards, such as, for example, a lot number, a casino identifier, a shoe number, a shift number, a table number, bar code, glyph, any other known type of special marking, or combinations thereof. In some embodiments, the control system 104 (FIG. 3) of the card-handling device 100 may receive signals from the card-imaging system 604 to determine rank and/or suit of each playing card being read or sensed by the card-imaging system 604. The control system 104 (FIG. 3) of the card-handling device 100 may store at least some data related to each playing card (e.g., an inventory of the playing cards handled by the card-handling device 100, a complete card set composition, etc.) in a memory portion of the control system 104 (FIG. 3). Stored data may be compared to data collected at the card-imaging system 604 or another location in the card-handling device 100. For example, the card-imaging system 604 may be used in conjunction with a second card-imaging system that may capture the same information in another location (e.g., the card-shuffling apparatus 114, an associated card-dispensing device, such as a shoe) or with stored values from a previous imaging event to keep an inventory of the playing cards and/or verify the constitution of a group of cards.

In some embodiments, the one or more sensors 606 of the card input portion 110 may be oriented proximate the card intake area 202 and may be used to sense whether playing cards are present in the card intake area 202 or whether playing cards are being passed from the card intake area 202 to the first card pathway 608. Furthermore, the sensor 606 may be configured to send signals to the control system 104 (FIG. 3) and inform the control system 104 (FIG. 3) that playing cards are present in the card intake area 202. Furthermore, the control system 104 (FIG. 3) may be configured to initiate a shuffling cycle (e.g., process of shuffling playing cards with the card-handling device 100) when the card intake area 202 is in the retracted position and the sensor 606 detects the presence of cards in the card intake area 202. In some embodiments, the sensor 606 may include at least one of an optical sensor and an infrared sensor.

In some embodiments, the card input portion 110 may include a restricted portion 650 of the first card pathway 608. For example, the restricted portion 650 may restrict a lateral and/or longitudinal dimension of the card pathway 608 in order to restrict unwanted movement (e.g., bending) of the cards as they moved toward and into the card-shuffling apparatus 114.

In some embodiments, the card input portion 110 may include an elongated packer arm 622. The elongated packer arm 622 may rotate about a packer arm shaft 624 and a pushing surface 626 of a pusher arm 628 of the elongated packer arm 622 may translate partially along the first card pathway 608 of the first card feed system 402 to ensure proper loading of the playing cards into the card-shuffling apparatus 114. A motor 630 may rotate an eccentric cam member 632, which may, cause the elongated packer arm 622 to rock back and forth along an arc-shaped path through a connector link 634.

In some embodiments, the elongated packer arm 622 may be used to provide additional force to a trailing end of a playing card along the first card pathway 608 as the playing card leaves the pair of rollers 620*a*, 620*b*. For example, the elongated packer arm 622 may be located in the card-handling device 100 such that the pushing surface 626 of the pusher arm 628 of the elongated packer arm 622 may abut against a trailing edge of a playing card and force the playing card at least substantially completely into the card-shuffling apparatus 114. In some embodiments, the elongated packer arm 622 may be similar to the devices disclosed in the aforementioned U.S. Pat. Nos. 6,659,460, 7,766,332, and 8,800,993 B2, the disclosures of each of which are incorporated herein in their entireties by this reference.

Figure 9:
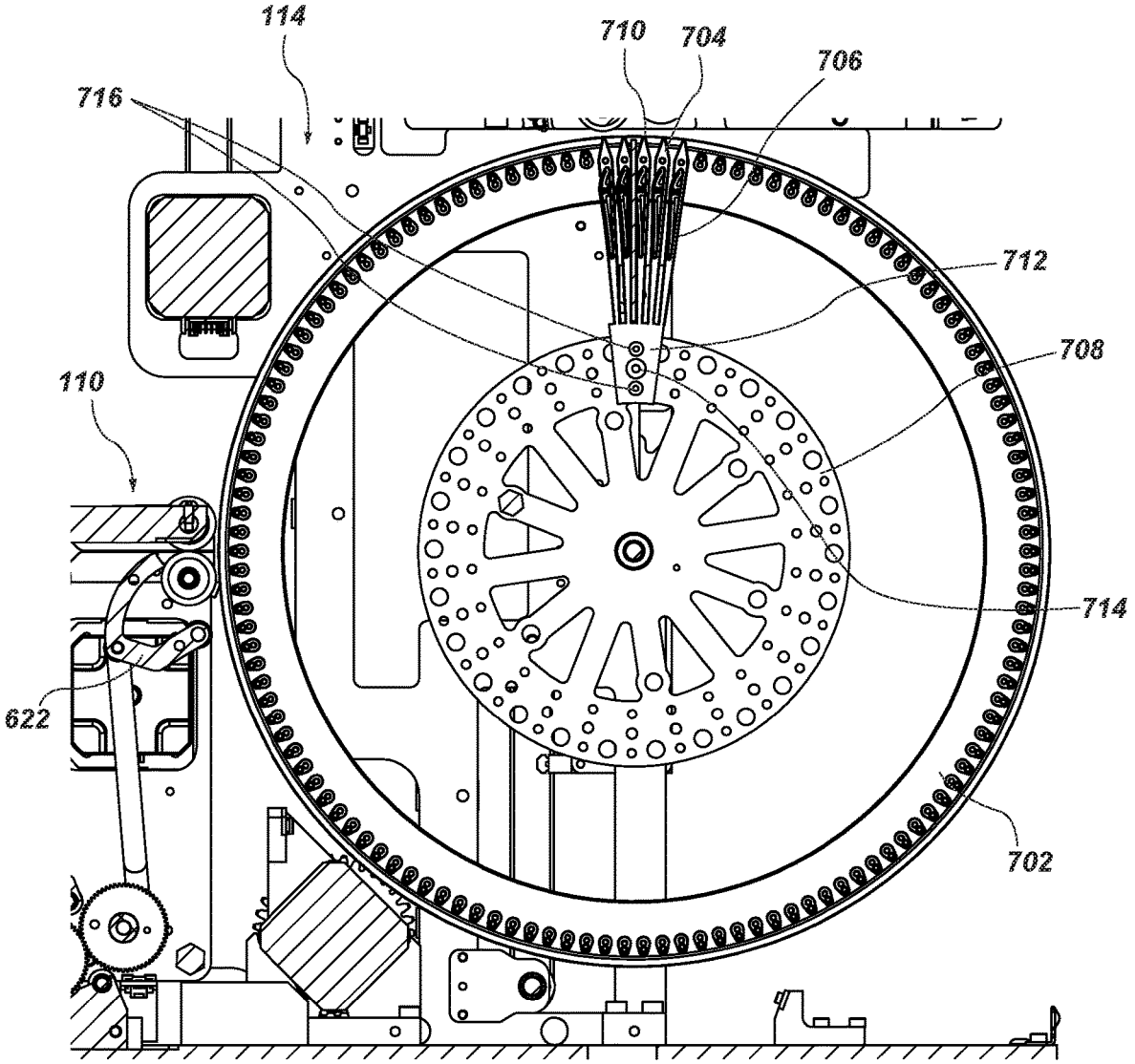
FIG. 9 shows an enlarged view of a section view of a card-shuffling apparatus according to an embodiment of the present disclosure.

FIG. 9 shows an enlarged view of the card-shuffling apparatus 114 from the cross-sectional side view of the card-handling device 100 of FIG. 7. In some embodiments, the card-shuffling apparatus 114 may include a multi-compartment carousel 702 and the packer arm 622. The multi-compartment carousel 702 may be circular in shape (e.g., annular). The multi-compartment carousel 702 of the card-shuffling apparatus 114 may have a number of compartments 704 (e.g., apertures, securing portions, etc.) defined between spaced pairs of adjacent fingers 706 (e.g., adjacent arms, etc.) extending from a rotatable center member 708. Each compartment 704 may be defined between two spaced pairs of adjacent fingers 706 of the multi-compartment carousel 702. The fingers 706 may each include a beveled edge 710 that enables and guides insertion of playing cards on top of or below playing cards previously deposited in the compartments 704 by the first card feed system 402 (FIG. 8) of the card input portion 110. The beveled edges 710 may include flat, angled surfaces or curved surfaces. Card edges of playing cards may contact the beveled edges 710 and may be deflected and guided into the compartments 704. In some embodiments, the adjacent fingers 706 may include a biasing element (e.g., spring, leaf spring, inverted spring, inverted leaf spring, resilient member, etc.) providing biasing pressure between the adjacent fingers 706 for assisting in holding playing cards securely within the compartments 704 after the playing cards are inserted into the multi-compartment carousel 702. In some embodiments, each compartment 704 may be sized and shaped to hold between one and ten playing cards, such as between two and seven playing cards, between one and five playing cards or between four and five playing cards.

In some embodiments, the compartments 704 may be modular. For example, the multi-compartment carousel 702 may be defined by a number of compartment modules 712 extending radially from the rotatable center member 708. In some embodiments, the compartment modules 712 may be individually removable from the rotatable center member 708. For example, each compartment module 712 may be secured to the rotatable center member 708 with hardware (e.g., screws, bolts, nuts, studs, pins, etc.), clamps (e.g., toggle clamps, latch clamps, spring clamps, screw clamps, etc.), or latches (e.g., draw latch, pin and tube latch, toggle latch, barrel latch, rotary latch, etc.).

The compartment modules 712 may be coupled to center member 708 by one or more fasteners 714 (e.g., bolts, screws, etc.). In some embodiments, the compartment modules 712 may include one or more adjustment features 716 that may be utilized to alter the orientation of the compartment modules 712 relative to adjacent compartment modules 712 and/or relative to the center member 708.

Figure 10:
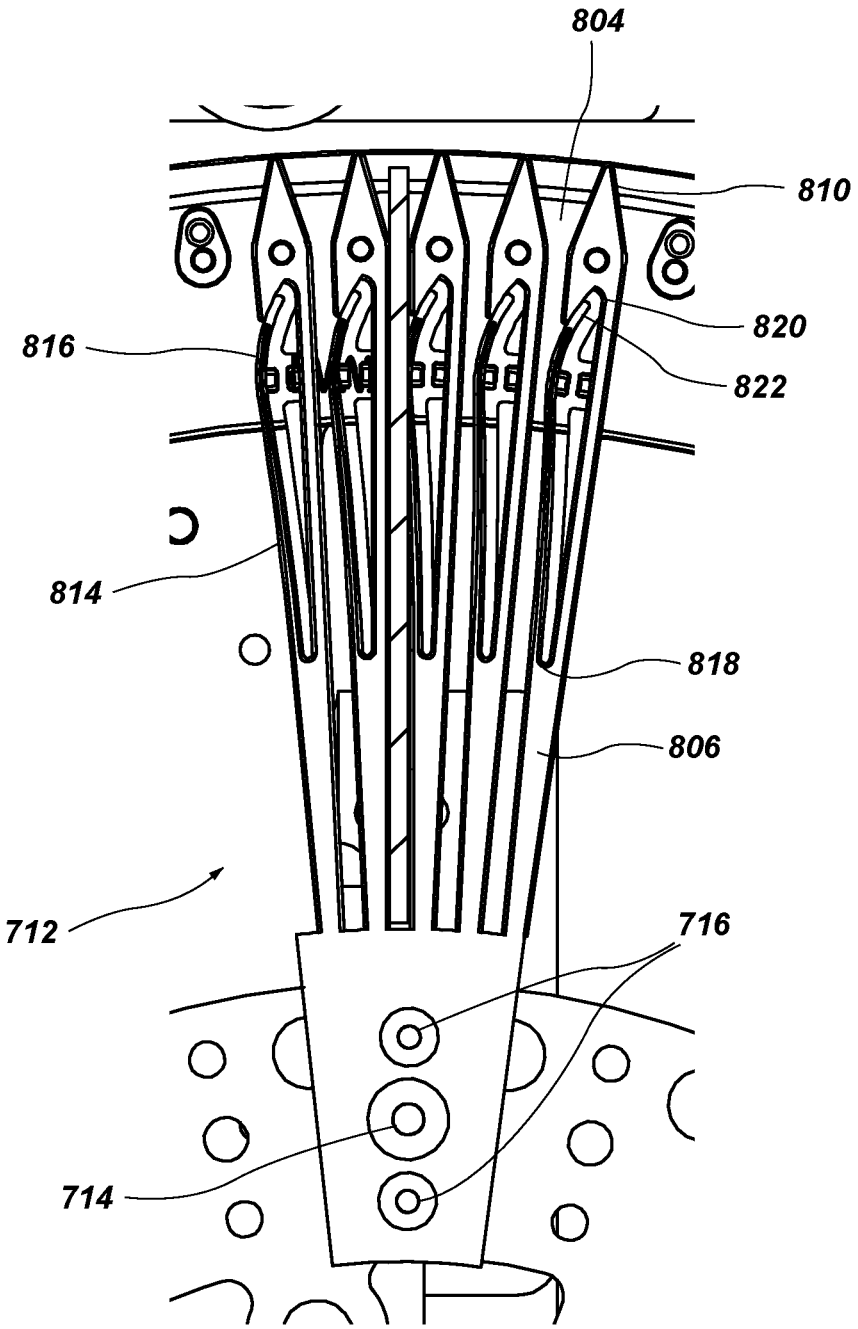
FIG. 10 shows an enlarged view of a compartment module according to an embodiment of the present disclosure.

FIG. 10 shows an enlarged view of a compartment module 712 of the multi-compartment carousel 702 of FIG. 9. In some embodiments, the compartment module 712 may include at least one aperture 804 defined between at least two arms 806. In some embodiments, the arms 806 may have a beveled leading edge 810 configured to guide playing cards into the apertures 804 between the arms 806.

In some embodiments, the arms 806 may include a biasing element 814 configured to secure the playing cards within the apertures 804. In some embodiments, the biasing element 814 may be formed from a resilient material configured to bow at least partially outward from the arm 806 intruding into the aperture 804. For example, the biasing element 814 may be a length of resilient material forming an arc with an apex 816 of the arc located within the aperture 804 in a direction away from the arm 806. In some embodiments, the biasing element 814 may be separate from the arm 806. The arm 806 may include a bottom retention 818 and a top retention 820 configured to retain the ends 822 of the biasing element 814. In some embodiments, the biasing element 814 may be a resilient material spanning between the top retention 820 and the bottom retention 818. In some embodiments, at least one of the top retention 820 and the bottom retention 818 may be configured to provide a floating retention of the biasing element 814 such that an end of the biasing element 814 may move relative to the arm 806. For example, the distal end 822 of the biasing element 814 may move inward away from the aperture 804 while still being restricted from moving outward into the aperture 804 beyond a selected distance. When the biasing element 814 is fully extended such that an apex 816 of the biasing element 814 is the largest distance from the arm 806, as permitted by the arms 806, the distal end 822 may be in a first position within the top retention 820. When playing cards are inserted into the aperture 804, the apex 816 may move toward the arm 806 and the floating retention in the top retention 820 may allow the distal end 822 of the biasing element 814 to move to a second position.

In some embodiments, the apertures 804 may each include a sensor to determine when the aperture 804 is full (e.g., has the maximum number of playing cards it is configured to hold by sensing the position of the biasing element 814). In some embodiments, the sensor may include a pair of contacts, a magnetic switch, reed switch, pressure switch, proximity switch, etc. In some embodiments, the control system 104 (FIG. 3) may track the number of cards loaded into each aperture 804 and determine which apertures 804 are full based on the tracking information.

In some embodiments, the control system 104 (FIG. 3) may control which aperture 804 receives the playing cards and may determine which apertures 804 are full and which apertures 804 can receive playing cards. In some embodiments, the control system 104 may trigger the ejection of playing cards into the card output portion 112 (FIG. 4) responsive to information obtained and/or stored by the control system 104 (e.g., a record of where cards have been loaded in a shuffling event, input from the sensors, etc.). For example, the control system 104 (FIG. 3) may trigger the ejection based on a percentage of full apertures 804. In some embodiments, the control system 104 (FIG. 3) may trigger the ejection responsive to a number of full apertures 804, such as between about one-hundred full apertures 804 and about two-hundred full apertures 804, between about one-hundred twenty full apertures 804 and about one-hundred-thirty full apertures 804, or about one-hundred-twenty-five full apertures 804. In some embodiments, the control system 104 (FIG. 3) may only trigger the ejection when every aperture 804 is full. In some embodiments, the control system 104 (FIG. 3) may trigger an ejection only from an aperture 804 that is full, resulting in ejection of cards only from full apertures 804.

Although the card-handling device 100 of the present disclosure describes the card-shuffling apparatus 114 including a multi-compartment carousel 702, the card-shuffling apparatus 114 may include any suitable shuffling mechanism such as, for example, those disclosed in U.S. Pat. No. 5,676,372 to Sines et al. that issued Oct. 14, 1997, U.S. Pat. No. 6,254,096 to Grauzer et al. that issued Jul. 3, 2001, U.S. Pat. No. 6,651,981 to Grauzer et al. that issued Nov. 25, 2003, and U.S. Pat. No. 6,659,460 to Blaha et al. that issued Dec. 9, 2003, the disclosures of each of which are incorporated herein in their entireties by this reference. In some embodiments, the card-shuffling apparatus 114 may have a wheel or carousel design that may be somewhat similar to the card-shuffling devices disclosed in the aforementioned and incorporated by reference U.S. Pat. No. 8,800,993 B2.

In some embodiments, the card-shuffling apparatus 114 may operate, in at least one operational mode, as a continuous shuffling machine. In other words, the card-shuffling apparatus 114 may be configured to continuously receive cards (e.g., after each round of play) and may continuously shuffle cards and provide cards to the dealer without unloading unused cards. In contrast, batch shuffling the one or more decks of cards involves unloading the entire set of cards (e.g., continuously or in a group) after each shuffling cycle before the cards are shuffled again. However, in a continuous mode, the card-shuffling apparatus 114 may shuffle the playing cards such that playing cards discarded and reinserted into the card-handling device 100 from a previous round have a chance of appearing (e.g., being dealt) in the next round.

In some embodiments, the card-shuffling apparatus 114 may operate, in at least one operational mode, as a batch shuffling machine or to verify and/or sort a group or deck of playing cards. For example, the card-shuffling apparatus 114 may be configured to shuffle a complete set or "shoe" of one or more decks of cards (e.g., one, two, four, six, eight, ten decks of cards, etc.) and then provide the cards from those decks to the dealer for insertion into a shoe (e.g., one card at a time, one hand at a time, etc.) until the set of cards is depleted, or a cut card is reached.

Referring to FIGS. 6, 7, and 10, in some embodiments, the card-handling device 100 (e.g., via the capacity of multi-compartment carousel 702) may enable a sorting operation that may be performed even when a relatively large amount of cards (e.g., six decks, eight decks, ten decks, twelve decks, variations in between, or more decks of cards) are required to be sorted in the card-handling device 100. For example, the card-handling device 100 may identify and load one or more cards in each compartment 704 (e.g., one to two, three, four, five, or more cards). As one or more cards are placed in a compartment 704, the next card received (e.g., from the card intake area 202) may be placed in the currently aligned compartment 704, if the card fits the desired sorting sequence (e.g., a sequence each deck by rank and suit). If the card does not fit the desired sequence in the currently aligned compartment 704, the multi-compartment carousel 702 may be moved to align a compartment 704 including a card or cards that meet the desired sorting sequence or to align a new compartment lacking any cards in order to load the current card from the card intake area. In some embodiments, during the sorting process, the card-handling device 100 may offload any compartments 704 that contain cards the match the desired sequence of the cards in the card outlet 204 so that those compartment may again be utilized for new cards in the sorting. This process may continue until all cards are sorted and delivered to the card outlet 204.

Figure 11:
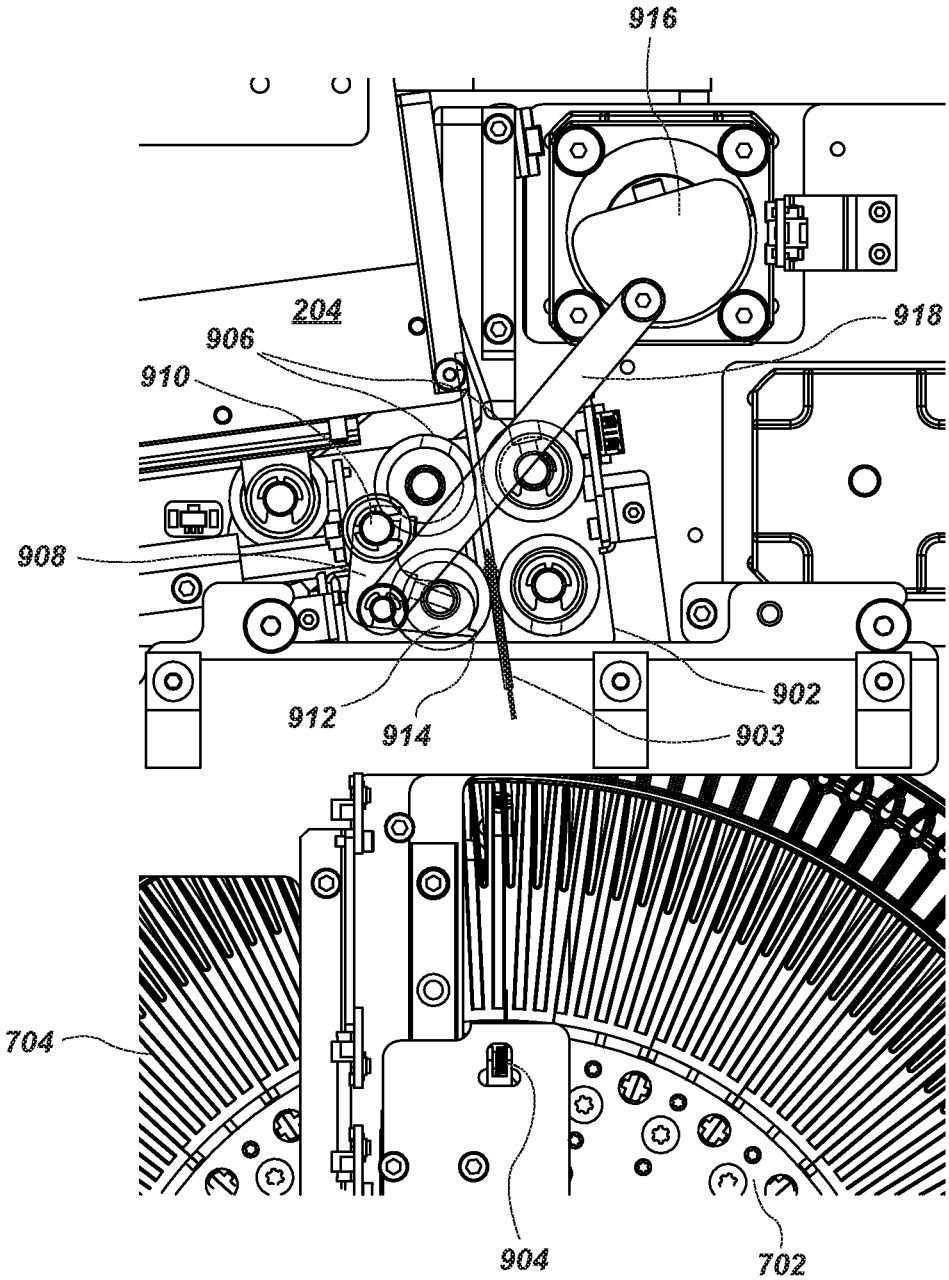
FIG. 11 shows an enlarged view of a card output portion according to an embodiment of the present disclosure with additional covers removed to show the internal mechanism.

FIG. 11 shows an enlarged view of the card output portion 112 of the card-handling device 100 (FIG. 3). A card transfer system 902 of the card-shuffling apparatus 114 may transfer playing cards from the multi-compartment carousel 702 to the card outlet 204 of the card output portion 112 of the card-handling device 100 along a second card pathway 903 when the card outlet 204 is in the retracted position. In some embodiments, the multi-compartment carousel 702 may include an ejector 904. The ejector 904 may be configured to unload groups of cards from the compartments 704 as a set into the card transfer system 902, unless there is only one card in the compartment, and then only one card is unloaded. The ejector 904 may be configured to unload the compartments 704 sequentially in a compartment 704 by compartment 704 manner. For example, the ejector 904 may unload a first compartment 704 completely before unloading a second compartment 704. In some embodiments, the second compartment 704 may be a compartment 704 adjacent to the first compartment 704. In other embodiments, the second compartment 704 may be a randomly selected compartment 704 and may not be a compartment 704 adjacent to the first compartment 704. In some embodiments, the ejector 904 may not unload the compartments 704 in a compartment 704 by compartment 704 manner. Rather, the ejector 904 may unload playing cards from the compartments 704 in a randomized (e.g., non-sequential) order. The ejector 904 may unload fewer than all cards in a compartment 704 at the same time. For example, the ejector 904 may unload one or more playing cards from a first compartment 704 without unloading other playing cards in the first compartment 704 and then may unload one or more playing cards from a second compartment 704 (e.g., with or without unloading other playing cards in the second compartment 704). In some embodiments, the ejector 904 may unload the playing cards one-at-a-time. In other embodiments, the ejector 904 may unload multiple playing cards at a time.

In some embodiments, the ejector 904 and the card transfer system 902 may be located at a top portion of the multi-compartment carousel 702. For example, the ejector 904 may unload playing cards into the card transfer system 902 when the compartment 704 retaining the playing cards is in a substantially vertical orientation within the multi-compartment carousel 702. In some embodiments, the ejector 904 and card transfer system 902 may be located about 90° of rotation about the axis of the multi-compartment carousel 702 from the first card feed system 402 (FIG. 8) such that the cards being unloaded from the compartments 704 are in an orientation transverse to an orientation of the cards when they are inserted into the compartments 704.

In some embodiments, the card transfer system 902 may include a plurality of rollers 906. The rollers 906 may displace playing cards from the multi-compartment carousel 702 to the card outlet 204 along the second card pathway 903. In some embodiments, the card transfer system 902 may include a packer arm 908. The packer arm 908 may include a packer arm pivot 910, an extended arm 912, and a finger 914. For example, the packer arm 908 may be driven by an eccentric packer motor 916 through a connecting link 918. The packer arm 908 may rotate about the packer arm pivot 910 translating the extended arm 912 and the finger 914 partially along the second card pathway 903. In some embodiments, the finger 914 may be configured to engage with a trailing edge of a group of playing cards to ensure proper loading of the playing cards into the card outlet 204.

As depicted, the card outlet 204 may be configured to store the playing cards 205 in a similar orientation to the orientation in which the cards leave the card-shuffling apparatus 114. The card outlet 204 may be configured to store the playing cards in a substantially horizontal stack, such that the cards are in a vertical orientation (e.g., lateral or longitudinal edges of the cards extend in a substantially horizontal direction) with each card face positioned substantially vertically (e.g., where a height of the stack of cards is slanted to extend along a major length of the card output portion 112 in a direction along the top surface 108) next to an adjacent card with the major faces of the cards lying in a plane substantially transverse to the top surface 108. The card outlet 204 may be configured to substantially support the cards on at least two sides of the cards.

As depicted, the card outlet 204 may be configured to elevate and retract above and below the top surface 108 of the card-handling device 100. For example, the card outlet 204 may retract below the top surface 108 of the card-handling device 100 to be in closer proximity to the card-shuffling apparatus 114 while cards are transferred from the multi-compartment carousel 702 to the card outlet 204. In some embodiments, the card outlet 204 may be elevated above the top surface 108 of the card-handling device 100 when it has a complete set of one or more decks of cards (e.g., one, two, four, six, eight, ten decks of cards, etc.) that may be loaded in a card-dispensing device, such as, a card shoe. In some embodiments, the card outlet 204 may be elevated above the top surface 108 of the card-handling device 100 when the operator needs to enter additional cards into gameplay, such as, to load the cards in a card shoe or to deal or draw cards individually or as a group of cards. In some embodiments, the card outlet 204 may remain in the elevated position above the top surface 108 of the card-handling device 100 until the entire group of cards has been removed from the card outlet 204.

Figure 12:
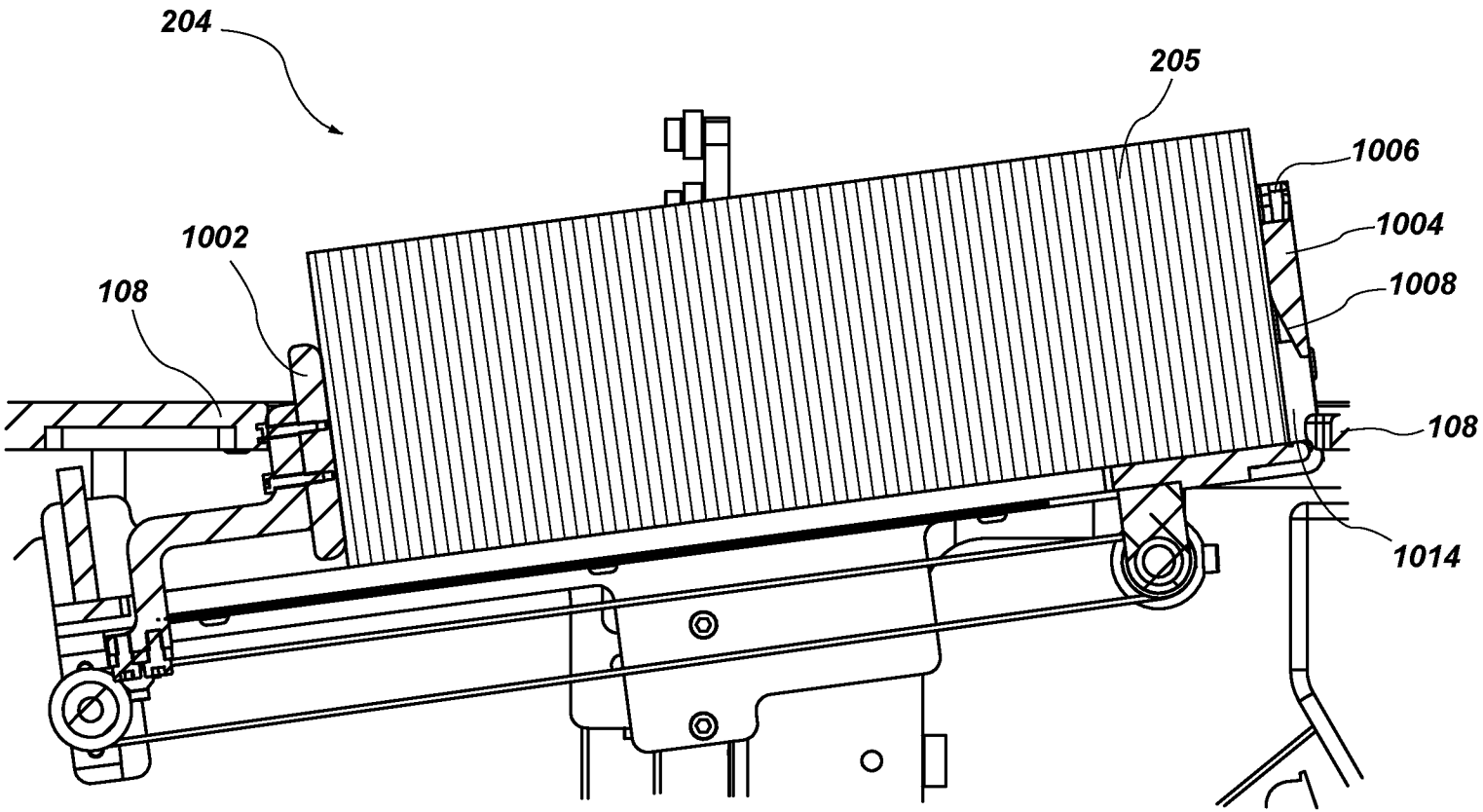
FIG. 12 shows an enlarged view of a section view of a card outlet storage container according to an embodiment of the present disclosure.

FIG. 12 shows a close up view of the card outlet 204 of the card-handling device 100. In some embodiments, the card outlet 204 may be configured to hold up to six-hundred fifty cards 205, such as between about fifty cards and about six-hundred-fifty cards, between about five-hundred cards and six-hundred cards, or about five-hundred-twenty cards (e.g., ten decks of cards).

In some embodiments, cards may be provided to the card outlet 204 (e.g., in the retracted position within the card-handling device 100 (FIG. 3)) by the card transfer system 902 (FIG. 11) may be added from an area below the card outlet 204. For example, a portion of the card outlet 204 (e.g., door or gate 1004) may define a card passage 1014 (e.g., opening, slot, etc.) in a lower portion of the gate 1004. The card passage 1014 may enable cards to pass through the card passage 1014 from the card transfer system 902 (FIG. 11) into the card outlet 204. In some embodiments, the gate 1004 may further define an angled surface 1008 configured to guide the cards being inserted through the card passage 1014 into the area within the card outlet 204. For example, the angled surface 1008 may provide a surface on which the card may slide to insert the card between a front area of the stack of playing cards 205 within the card outlet 204 and the gate 1004.

In some embodiments, the card outlet 204 may be configured to vary the internal volume of the card outlet 204. For example, the card outlet 204 may include a movable guide 1002. The movable guide 1002 may reduce the internal volume of the card outlet 204 when a number of cards to be placed in the card outlet 204 is, at least initially, less than the full capacity of the card outlet 204. The movable guide 1002 may be retracted to increase the internal volume of the card outlet 204 gradually as cards are loaded into the card outlet 204 to increase the capacity of the card outlet 204.

The card outlet 204 may be configured to present (e.g., release) a predetermined number of cards (e.g., all of the cards) to the operator such that the operator can withdraw (e.g., draw, slide, remove, etc.) the cards from the card outlet 204. For example, the card outlet 204 may include the movable guide 1002 and the gate 1004 on an end of the card outlet 204. In some embodiments, the gate 1004 may be configured to open a specified amount to enable a specific number of cards to be withdrawn past the gate 1004 (e.g., to enable an entirety of the cards 205 to slide over the gate 1004, which is substantially flush with the top surface 108 (FIG. 4) when in the open position). The gate 1004 may include a securing mechanism 1006 (e.g., a magnetic latch and a hinge) to secure the gate 1004 in place when cards are not being withdrawn. For example, a force provided by an operator sliding the cards 205 may overcome the magnetic latch and move the gate into the open, flush position. The operator may then continue sliding the cards 205 over the gate 1004 to the top surface 108 in order to further process the cards 205 (e.g., by cutting the decks of cards, moving the decks of cards into a shoe, etc.).

In some embodiments, one or more cards may be placed into the card infeed area of the shuffler in a flipped over orientation (e.g., where the back and the front of the card are arranged opposite the adjacent cards) and/or one or more cards may flip over inside the shuffler after card feeding. Although house procedures may require the dealer to reorient the cards face-down before depositing the cards into the card infeed area of the shuffler, cards are frequently reinserted into the shuffler in the wrong face orientation. Cards inserted with the wrong face orientation may cause delays or errors in an automatic shuffler. For example, as described above, an automatic card shuffler may be configured to read and/or recognize cards to verify that a shuffled set of cards is complete (e.g., there are not extra or fewer cards in the set). A card inserted in the wrong face orientation may cause the automatic shuffler to alert the dealer through an error message or to abort the entire shuffle resulting in a delay for the associated gaming table. In some embodiments, cards may be inserted in the card infeed area face-down and any cards in the stack that are face-up may be detected and handled such that the shuffling can be completed without restarting the entire shuffle.

Cards may be received in the card infeed area of a card shuffler as a set, preferably with a majority of cards in a normal face-to-back orientation with an adjacent card. If any card or cards are in a face-to-face orientation in the card intake area of the shuffler, prior to methods of the present disclosure, the shuffle is at risk of being aborted or otherwise being ineffective.

Even when the dealer orients all of the card faces in the same direction, the cards can still reorient inside of the card shuffler. For example, properly oriented cards may flip over during card handling internal to the machine.

When a card that is faced in the wrong orientation (e.g., a flipped card) is read by the card reader, the camera may image the card back instead of the card front causing a misread condition. In some examples, the card recognition system may be incapable of reading the card. In other examples, the card recognition system may be configured to read the card back and generate a signal that causes the processor to issue a signal indicating that a card back has been sensed (e.g., instead of the card face), indicating a flipped card condition. In both examples, the card recognition system fails to read a card face and generates a signal of this condition.

In the embodiments of the shuffling structures described above, cards move substantially horizontally, face down, along a card path from the card intake into the card-shuffling mechanism. Before insertion into a shuffling mechanism, such as a compartment of a carousel in a carousel type shuffler, the card face may be read by a camera imaging system located along the card path. When a card face is flipped over, the card back is imaged instead, causing the processor to recognize the condition of a failure to read a card face. For example, the card recognition system may be trained to identify only rank and suit values and any card that lacks these features is identified as a non-conforming card requiring special handling. For example, jokers may require special handling in a game that does not utilize jokers, such as blackjack. In some embodiments, flipped cards may be treated as special cards, sorted out, and presented to a dealer such that the dealer may manually remove them from an end of the shuffled set.

Figure 13:
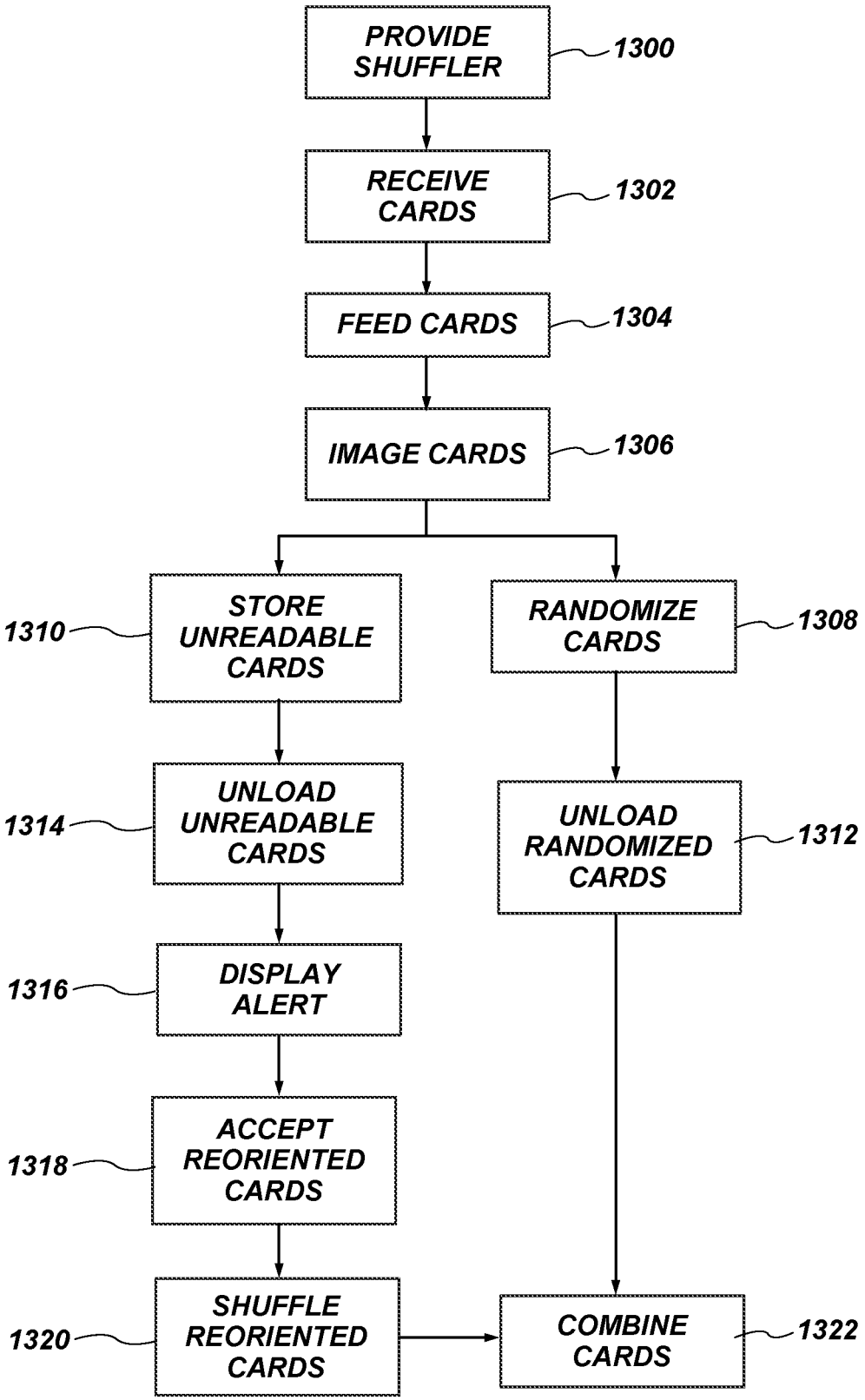
FIG. 13 is a process diagram for the shuffling of playing cards according to an embodiment of the present disclosure.

FIG. 13 is a process flow diagram illustrating acts of an example method of altering a face orientation of cards being shuffled in an automatic card shuffler is illustrated. The method comprises the act of providing an automatic card shuffler at operation 1300. The example shuffler may include a user display, a card intake, a card outlet, a card-shuffling apparatus, a card path between the card intake and the card output, a card imaging system, and a processor for controlling the card imaging system, the user display and an operation of the card shuffler, such as the embodiments described above with respect to FIGS. 3 through 12. In some embodiments, the card-shuffling apparatus may include multiple compartments, wherein at least one compartment is designated for receiving cards that the imaging system has identified as lacking card face information. In some embodiments, card face information may include conventional rank and suit symbols, conventional rank or suit symbols or a special marking indicating rank and suit, or a special marking indicating rank or suit value. Examples of special markings include infrared (IR) ink markings, nano markings, barcode markings, encrypted codes, unencrypted codes, and the like.

For purposes of this disclosure, card imaging systems that are capable of reading a card back, or a card imaging system that is incapable of reading a card back are referred to as a card imaging system that failed to read card face data. Cards that were not recognized as having card face markings for purposes of this disclosure are unimaged cards. These cards can be flipped cards, cut cards, promotional cards, jokers, and/or any other cards that do not belong in the card set.

In some embodiments, a plurality of cards may be received in the card intake area of a card shuffler at operation 1302. The card shuffler may be configured to shuffle cards. The shuffler may operate as a batch shuffler or a continuous shuffler. The cards inputted for shuffling may be arranged in a stack, such as a vertical stack with card faces located in horizontal planes. In other examples, the stack may be horizontal, with card faces located in vertical planes. Alternatively, the stack may be tipped with respect to the vertical slightly to stabilize the stack. The cards are generally arranged face-to-back, but there may be one or more cards in the stack that are oriented in a face-to-face orientation with an adjacent card. In other words, in the process of gathering cards from the gaming table, the dealer may fail to reorient all cards face-down before inserting the cards into a discard rack or into the card intake area of the shuffler.

Each card may be individually fed from the stack into the card shuffler automatically at operation 1304. For example, cards may be individually fed from one end of the stack, such as from the bottom of the stack when the stack of card is vertical. In some embodiments, cards may be removed with blades from the center of the stack. The blades may randomly select a location in the stack to eject the card.

At operation 1306, cards may be imaged. An example of a suitable card imaging device is described in detail above. The cards may be imaged in the card infeed area, along the card path or if cards are moved out of the shuffling apparatus individually, between the shuffling apparatus and the card output area.

Card face information may be read at operation 1306 by the card imaging system. In some embodiments, at least a portion of a card face of each card is read as the card is being fed into the shuffling apparatus. In some embodiments, cards are read between the card infeed area and the card-shuffling mechanism from an elevation beneath a horizontal card path. In other embodiments, the bottom card is read while in the stationary position in the card infeed area. In some embodiments, card faces are oriented face-down on the card path, and cards are read as they move. In other embodiments, cards are read before movement, or are caused to pause at a card reading station and are imaged when the card is stationary.

Cards may move individually along the card path after imaging and may then be shuffled at operation 1308 by a card-shuffling apparatus.

For example, at operation 1308, cards that have recognizable card face information may be inserted into randomly or pseudo-randomly selected compartments in the card-shuffling apparatus. In one example, cards may be fed individually into a compartment of a shuffling carousel. A compartment may be first randomly or pseudo-randomly selected by the processor and aligned with a stationary card feed mechanism in order to receive a card. In some embodiments, cards may move horizontally into a radial compartment aligned with a horizontally disposed card feeder, the compartment being part of a carousel shuffling mechanism, such as the structure described more fully above. The carousel may be configured to rotate about horizontal axis and may be driven with a drive mechanism such as a stepper motor. The particulars of an example card-shuffling mechanism are described above.

As described above, when a card face is not recognized by the card imaging system, indicating at a minimum that there is a problem with a card, the processor directs the card-shuffling mechanism to handle that card differently as compared to the other cards being shuffled. At operation 1310, cards that are unimaged may be inserted into one or more designated compartments in the carousel. In contrast, all cards that were read (and recognized) to identify at least one of rank or suit may be handled in a manner such that the cards are randomly or pseudo-randomly shuffled at operation 1308. For example, under processor control, all readable cards may be randomly inserted into randomly selected compartments until a maximum number of cards has been reached in the randomly selected compartment. When the compartment reaches its maximum, the full compartment may be excluded from the next random selection process. In some embodiments, when all cards in the card input area have been randomly or pseudo-randomly distributed to a compartment, the card-shuffling apparatus may begin a card unloading process by moving groups of imaged cards from the compartments into a card output area as shown in operation 1312. The unloading process can be done randomly or sequentially. Sequential unloading causes the shuffling operation to be performed at a faster speed as opposed to using randomly selected compartment unloading procedures. Random unloading, on the other hand increases randomness. In some embodiments, random unloading may use a random number generator, such as Quantum Random Number Generation (QRNG) to randomly select the compartment and/or card in the compartment to unload.

All readable, randomized cards may be unloaded into the card outlet. In some embodiments, a stack of shuffled cards may be formed in the card outlet, with each card in the stack in a face-to-back orientation. In some embodiments, the stack may be substantially horizontal with card faces in a substantially vertical plane. In other embodiments, the stack may be substantially vertical with the card faces in a substantially horizontal plane.

At the end of the card distribution process, if any unreadable cards are present in a designed compartment of the shuffling mechanism, those cards may be unloaded last at operation 1314 from the at least one designated compartment and combined with the set of cards in the card output. In other embodiments, the unreadable cards may be reoriented prior to any shuffling and then shuffled along with the entire set of cards once reoriented.

The processor may direct the display to issue a warning or an alert at operation 1316 that there are cards in the card output that have not been examined. If the cards are flipped over, the processor may direct the display to instruct the operator to reorient the cards and reinsert them into the card input area.

Any cards delivered to the card output area should be examined to determine if they are cut cards, flipped cards or extraneous cards. The dealer may then remove any cards that do not belong in the deck, reorient the flipped cards and activate the shuffler to re-feed the cards. At operation 1318, the reoriented cards are accepted in the card infeed area of the shuffler. The shuffler may then shuffle the reoriented cards at operation 1320. Shuffled cards are then combined at operation 1322 with the set of shuffled cards in the card output to form a complete set of shuffled cards in face-to-back orientation.

At operation 1314, when unimaged cards are combined in the card output, a horizontal stack of shuffled cards may be formed with card faces aligned in a vertical plane and the flipped cards may be added to one end of the stack. When the stack of cards is elevated and exposed to the dealer, the dealer can visually observe that the cards on the end of the stack are flipped over or are not part of the set. In other examples, the shuffled stack may be vertical, with card faces in a horizontal plane, and the dealer must remove the flipped and/or wrong cards after the bottom of the set is exposed.

When unreadable cards or cards that lack card face data are sensed at operation 1306, the processor may cause the user display to display an alert at operation 1316 that there are cards in the wrong card face orientation in the card outlet that require manual reorientation, or that there are unknown cards in the shuffler, or both. In some embodiments, the processor may delay the display of the alert and/or instruction until the unloading cycle begins, until the unloading cycle ends or during unloading. In other embodiments, the instruction may be delayed until the flipped cards or unknown cards are physically delivered to the card output. The processor may further cause the display to display an instruction for the user to manually reorient the face of the flipped card or cards, and optionally to press a button to reactivate the shuffler.

In some embodiments, one or more manually reoriented cards may be accepted back in the card intake, wherein the reoriented cards are positioned in the correct face orientation for card imaging. Accepted cards may then be automatically fed from the card intake into the card shuffler. The activation of the shuffling process may be by user input or it may occur when the device senses cards accepted in the card input area. The reoriented cards may be shuffled, and the shuffled cards unloaded into the card outlet and combined with the incomplete shuffled set of cards in the card output to form a complete set of shuffled cards, each card having a card face-to-back orientation with an adjacent card. Cards that are fed into the shuffler in the wrong face orientation or cards that flipped over internal to the card shuffler may be reoriented and separately randomized after reorientation without aborting the entire shuffle. Avoiding the long process of reshuffling may save the casino valuable time and prevent revenue loss by reducing the time needed to shuffle a large set of cards.

Figure 14:
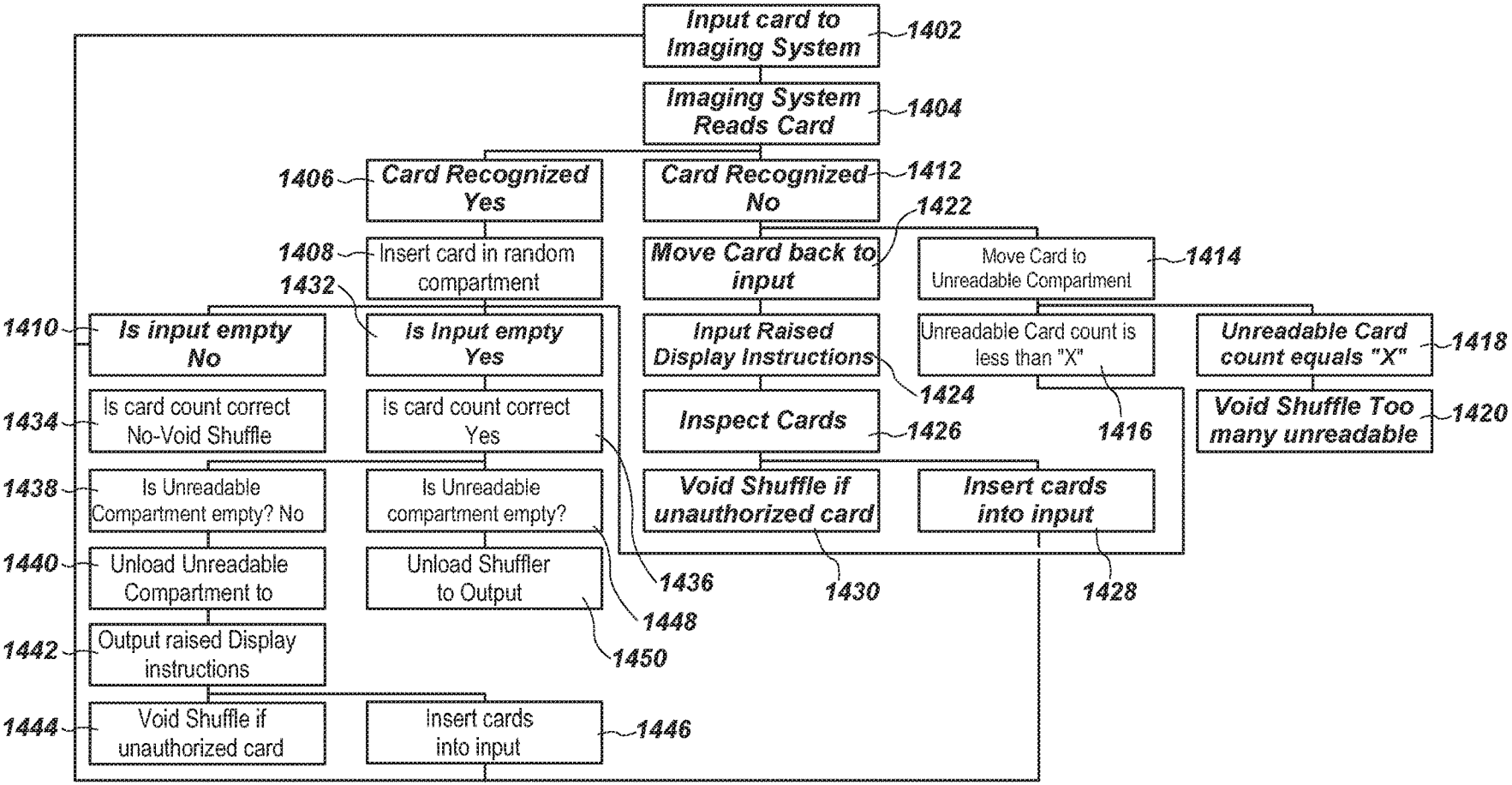
FIG. 14 is a process diagram for the shuffling of playing cards according to an embodiment of the present disclosure.

FIG. 14 illustrates a flow chart representative of an embodiment of a method of addressing flipped cards. The method includes the act of inputting cards from a card intake at act 1402. The card intake may be part of an example shuffler and may further include a user display, a card outlet, a card-shuffling apparatus, a card path between the card intake and the card output, a card imaging system, and a processor for controlling the card imaging system, the user display and an operation of the card shuffler, such as the embodiments described above with respect to FIGS. 3 through 12.

A card may be fed past an imaging system or camera in act 1402. The imaging system may read the card in act 1404. The imaging system may be configured to recognize a rank and/or suit of the card or another identifying feature of the card. For example, the camera of the imaging system may be focused on a portion of the card where the both the rank and the suit of each card are positioned. If the imaging system recognizes a rank and suit of the card, the card may be shuffled in a normal shuffling operation. The card may proceed to the shuffling apparatus in act 1406.

As described above, the shuffling apparatus may include multiple compartments for receiving the cards. The shuffling apparatus may insert the card into a random compartment of the shuffling apparatus in act 1408. For example, the compartments may be arranged circumferentially about a wheel. The wheel may rotate to a random position relative to the input and receive the card in the compartment that is adjacent to the card in the random position. The random position of the wheel may be determined by an algorithm such as a random number generator, mathematical algorithm, timer, etc.

After the card is inserted into the random compartment, the processor may check a sensor in the card intake to verify if there are more unshuffled cards in the card intake in act 1410. If the intake still has more cards, the process may repeat, feeding the next card past the imaging system in act 1402 and reading the card in act 1404. If the imaging system cannot read the card, the card may be flagged for special handling in act 1412. An unrecognized card may be a flipped card where the back of the card is facing the imaging system. In some embodiments, an unrecognized card may also include jokers, promotional cards, cut cards, unauthorized cards, damaged cards, unreadable cards, or other non-playable cards.

After a card is flagged for special handling, the card may be moved to a designated compartment in act 1414. The designated compartment may be one or more specific compartments of the multiple compartments of the shuffling apparatus. The designated compartment may only receive cards flagged for special handling. The designated compartment may have a limited capacity similar to the other compartments of the shuffling apparatus. For example, the designated compartment may hold between about 1 and about 10 unrecognized cards.

In some embodiments, the number of unrecognized cards may be checked against a threshold number of unrecognized cards. The threshold may be defined by the number of decks being shuffled. For example, if the shuffler is handling between one deck and five decks the threshold may be between about one card and about ten cards, such as between about two cards and about seven cards or about five cards. If the number of decks being shuffled is between five decks and ten decks, the threshold may be between about one card and about twenty cards, such as between about five cards and about fifteen cards, or about ten cards. In some embodiments, the threshold may be defined by the capacity of the designated compartment. For example, if two compartments are designated for unrecognized cards, the threshold may be the capacity of the two designated compartments.

If the number of unrecognized cards is less than the threshold number of unrecognized cards (if a threshold number is implemented) in act 1416, the process may continue to repeat feeding cards past the imaging system and shuffling the cards or flagging and separating unreadable cards. If the number of unrecognized cards is greater than the threshold number of unrecognized cards in act 1418, the processor may cause the shuffler to output the unreadable cards and void the shuffle in act 1420. After the shuffle is voided, the processor may cause the shuffler to output all of the cards that are in the multiple compartments of the shuffling apparatus and return any cards that had not yet been inserted into the shuffling apparatus to the input. The dealer may then remove the cards. In some embodiments, the dealer may replace the cards with the same number of new decks of cards. In some embodiments, the dealer may address the unreadable cards and reinsert the cards into the card intake and restart the shuffling process.

In some embodiments, an unrecognized card may trigger a different operation rather than transferring the unrecognized card to the designated compartment in act 1414. For example, the processor may move the unrecognized card back to the input in act 1422 and provide an alert and/or instructions to the dealer based on the unrecognized card in act 1424. The dealer may inspect the cards in act 1426 and correct any problems such as reorienting cards, removing cards, etc. Once the problems have been corrected the dealer may reinsert the cards into the card input in act 1428 and the process may continue to repeat. In additional embodiments, the dealer may discover a problem that may require the shuffle to be voided in act 1430. For example, if the dealer discovers an unauthorized card, such as a card that does not match the other cards, a different type of card, etc., the dealer may void the shuffle and replace the cards. In some embodiments, the processor may proceed to move the unrecognized card back to the input in act 1422 when the first card is unrecognized. For example, if a new deck of cards is inserted into the card intake without removing Jokers, or other non-playable cards from the deck of cards, the shuffler may return the cards to the input to enable the dealer to correct the error before the shuffle begins. In another example, if the cards are placed in the card intake such that the entire stack of cards is upside down (e.g., flipped), the shuffler may return the cards to the input to enable the dealer to correct the orientation before the shuffler is forced to void the shuffle. In another embodiment, the shuffler may return the unrecognized card to the card intake if the card intake is otherwise empty, enabling the dealer to take actions to correct the card without taking the time to pass the card through the shuffler to the output.

After the shuffler has processed all of the cards present in the card intake, the processor may verify that the card intake is empty in act 1432. If the card intake is empty, the count of cards that passed over the imaging system may be verified against the number of cards that were expected (e.g., the number of cards that corresponds with the number of decks in the shuffler). If the number of cards does not match, the shuffler may void the shuffle in act 1434 and output all of the cards from the shuffler enabling the dealer to replace the cards or take another avenue of corrective action.

If the number of cards is correct in act 1436, the processor may check the designated compartment for cards. If the designated compartment includes unrecognized cards, the processor may alert the dealer that there are unrecognized cards in the shuffler in act 1438. The processor may then output the unrecognized cards from the shuffling apparatus to the card output in act 1440. The processor may then instruct the dealer to inspect the unrecognized cards in act 1442. For example, a display on the shuffler may provide the dealer with instructions to correct any problems with the cards, such as reorienting the cards, and to place the corrected cards in the card intake in act 1446. In some embodiments, the dealer instructions may include instructions to void the shuffle and replace the cards if an unauthorized card is found in the unrecognized cards in act 1444. In some embodiments, the instructions may enable the dealer to select the option of adding the unrecognized cards to the shuffled cards or voiding the shuffle based on the contents of the unrecognized cards by making a selection on the display, such as pressing a button, making a selection on a touch screen, etc.

If the unrecognized cards are flipped cards, the dealer may correct the orientation of the cards and place them in the card intake. Once the unrecognized cards are shuffled into the other cards that are in the shuffling apparatus through the same process discussed above, the processor may again verify that the card intake is empty in act 1432. When the processor also verifies that the designated compartment is empty in act 1448, the processor may cause the shuffler to output the shuffled cards into the card output in act 1450. In some embodiments, the dealer may correct the orientation of the cards and manually place the cards into the shuffled cards at random locations. In some embodiments, the dealer may correct the orientation of the cards and place the cards along with the shuffled cards into the card intake and re-initialize the shuffling process. In some embodiments, the dealer may correct the orientation of the cards and place the cards along with a select number of the shuffled cards, such as between about 20 and about 60 shuffled cards, into the card intake and re-initialize the shuffling process with the select number of cards.

Figure 15:
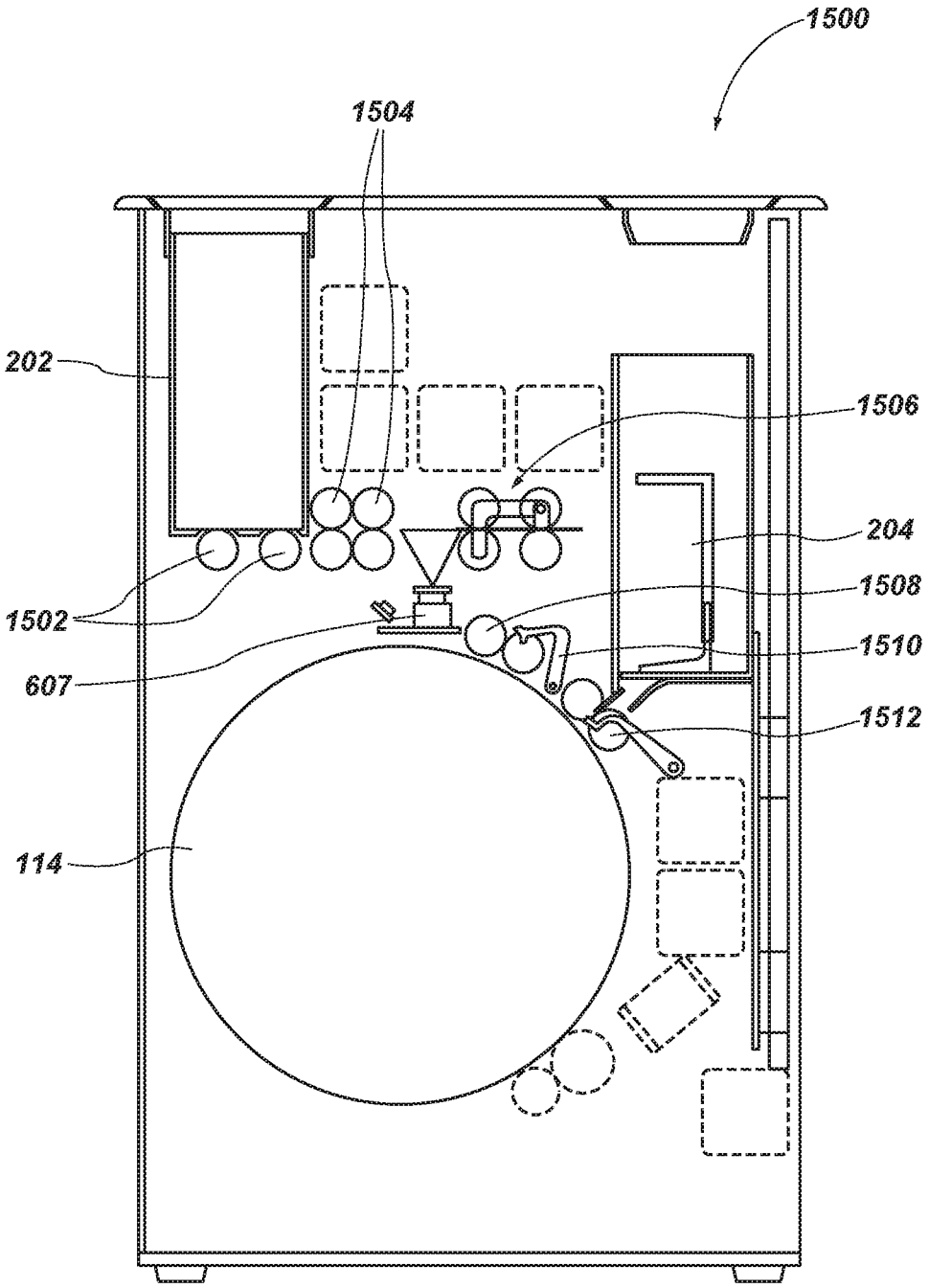
FIG. 15 shows an elevational side view of an embodiment of the present disclosure with covers removed to show the internal mechanism.

FIG. 15 shows another embodiment of a card handling device 1500. The card handling device 1500 may include a card intake area 202, a card outlet 204, and a card-shuffling apparatus 114, such as, for example, the multi-compartment carousel 702 described above with respect to FIG. 9. The cards may be removed from the card intake area 202 by a set of pick-off rollers 1502. One or more sets of transition rollers 1504 may transfer the cards from the pick-off rollers to a switching apparatus 1506. The cards may pass over a card-imaging system 604 as described above. The switching apparatus 1506 may be configured to orient the cards for insertion into the card-shuffling apparatus 114 as, for example, discussed below, by reorienting the faces of the cards and/or the lateral edges of the cards relative to the card-shuffling apparatus 114. The cards may be inserted into the card-shuffling apparatus 114 with insertion rollers 1508 and/or a packer arm 1510. After being shuffled in the card-shuffling apparatus 114, the card may be removed from the card-shuffling apparatus 114 through exit rollers 1512 and inserted into the card outlet 204.

As discussed below, the switching apparatus discussed herein (e.g., switching apparatus 1506) may be utilized to rotate cards about multiple axes (e.g., by inverting the face of the cards and/or by rotating lateral edges of the cards) and then may supply the cards to another portion of the card-handling device. In some embodiments, the direction of card travel may be preserved (e.g., into a card-shuffling area as discussed below or to a card output in a card verification mode). In additional embodiments, the path of the cards may be in substantially one direction where the cards are rotated, as necessary and provided to a card-shuffling area in a shuffling mode as or directly to a card output in a card verification mode.

Figure 16C:
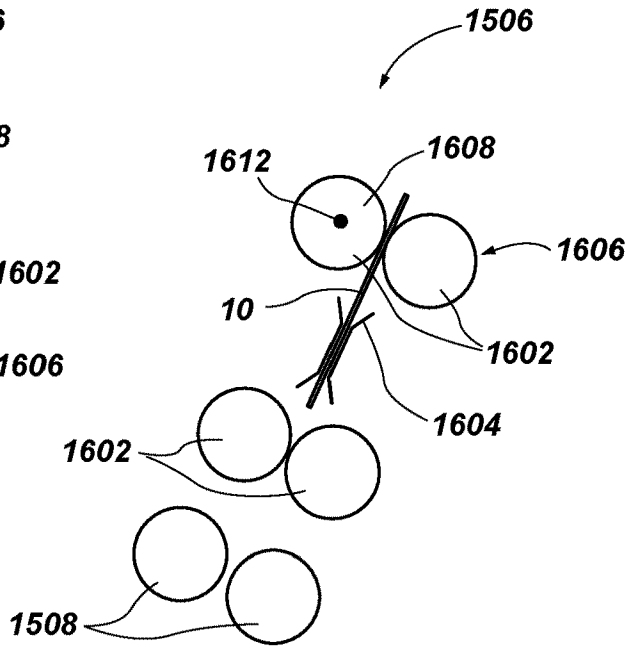
FIG. 16C shows an enlarged view of the switching apparatus of FIGS. 16A and 16B in a third orientation.
Figure 16B:
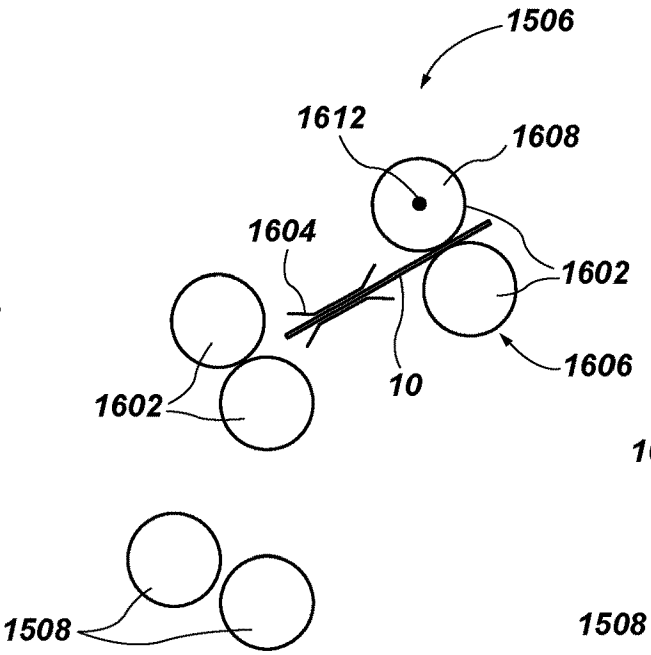
FIG. 16B shows an enlarged view of the switching apparatus of FIG. 16A in a second orientation.
Figure 16A:
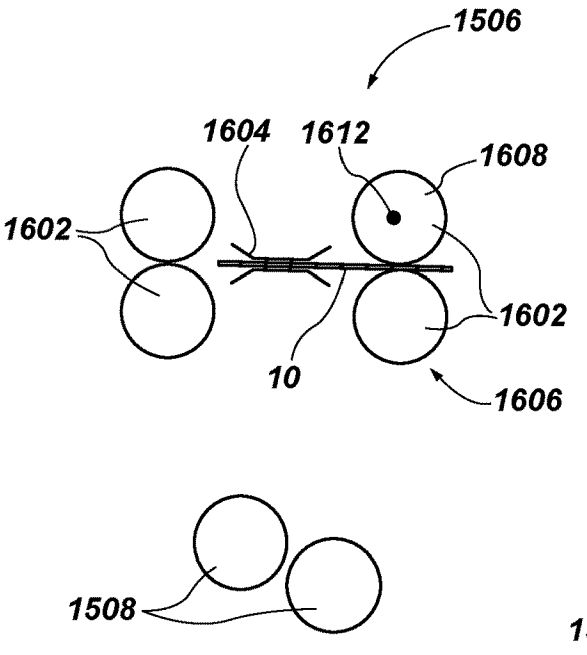
FIG. 16A shows an enlarged view of a switching apparatus according to an embodiment of the present disclosure.

FIGS. 16A-16C illustrate enlarged views of an embodiment of the switching apparatus 1506. The switching apparatus 1506 may include guide rollers 1602 and, optionally, one or more guide plates 1604. The switching apparatus 1506 may also include a pivot roller 1608. A card 10 may enter the switching apparatus 1506 through at least one of the guide rollers 1602 and the guide plates 1604. When a card enters the switching apparatus 1506, the switching roller set 1606 may be in a first position illustrated in FIG. 16A. In the first position the guide rollers 1602 and the guide plates 1604 may be substantially aligned with the transition rollers 1504 (FIG. 15), such as a parallel orientation, such that the card 10 may pass through the transition rollers 1504, over the card-imaging system 604, and into the switching apparatus 1506.

After the card 10 passes into the guide rollers 1602 and/or the guide plates 1604, the switching apparatus 1506 may rotate about a rotational axis 1612 of the pivot roller 1608 changing an angle of the card 10 relative to the transition rollers 1504 and the card-imaging system 604. The switching apparatus 1506 may move to a second position, illustrated in FIG. 16B, where the card 10 and the switching apparatus 1506 are not aligned (e.g., where a direction of intended card travel is no longer in the same orientation or plane, etc.) with one or more sets of adjacent rollers. During the rotation, the card may be held in one or both sets of guide rollers 1602, in the guide plates 1604, or combinations thereof.

The switching apparatus 1506 may further move relative to the pivot roller 1608 until the switching apparatus 1506 is in substantially the same orientation (e.g., where a direction of intended card travel is in the same orientation or plane) as the insertion rollers 1508 in a third position, as illustrated in FIG. 16C. The switching apparatus 1506 may then transport the card 10, in a second reverse direction, from the switching apparatus 1506 to the insertion rollers 1508. The insertion rollers 1508 may then facilitate the insertion of the card 10 into the card-shuffling apparatus 114.

In some embodiments, the switching apparatus 1506 may be configured to rotate one or more of the cards about a minor axis of the cards. The minor axis of the cards may be an axis extending in a direction substantially perpendicular to a face of the cards. For example, the switching apparatus 1506 may rotate one or more of the cards such that an orientation of the lateral edges of the card is changed as described in further detail below.

Figure 17C:
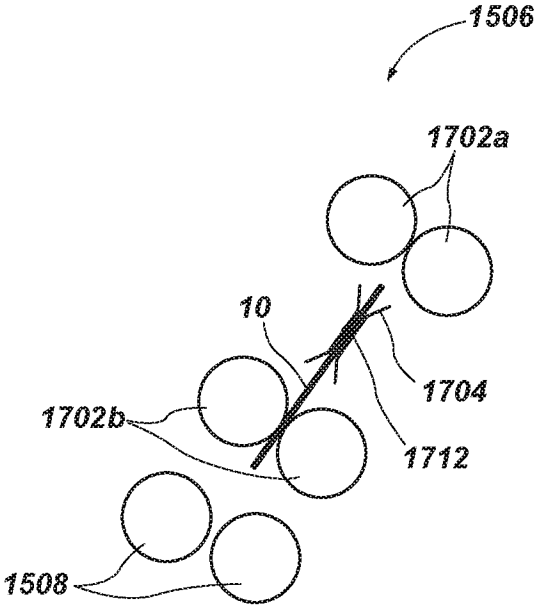
FIG. 17C shows an enlarged view of the switching apparatus of FIGS. 17A and 17B in a third orientation.
Figure 17B:
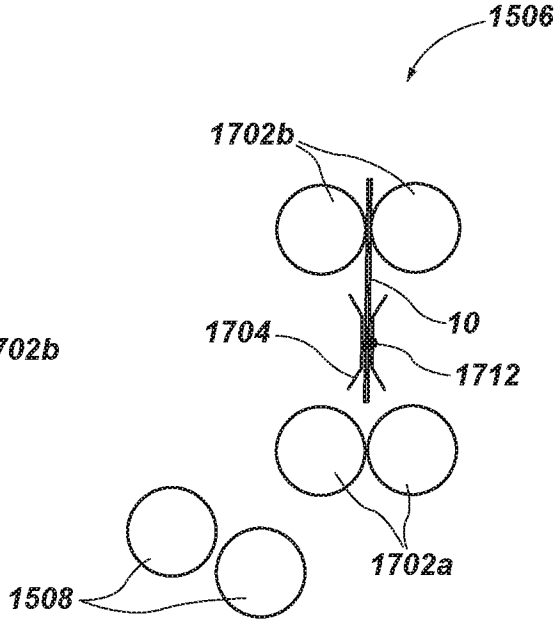
FIG. 17B shows an enlarged view of the switching apparatus of FIG. 17A in a second orientation.
Figure 17A:
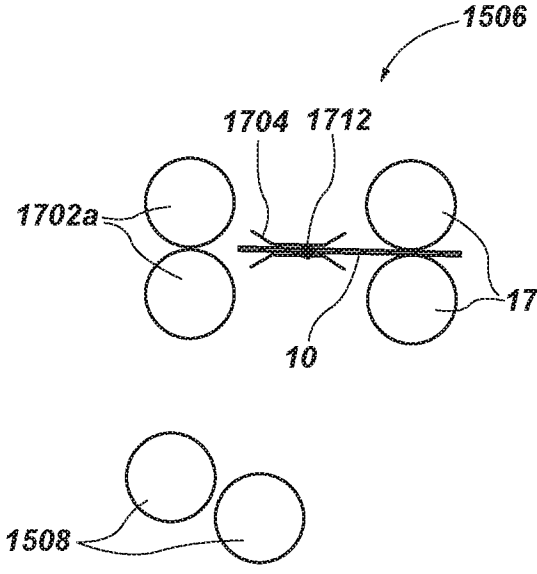
FIG. 17A shows an enlarged view of a switching apparatus according to an embodiment of the present disclosure.

FIGS. 17A-17C illustrate enlarged views of an embodiment of the switching apparatus 1506. The switching apparatus 1506 may include a first set of guide rollers 1702*a* and one or more guide plates 1704. The switching apparatus 1506 may also include a second set of guide rollers 1702*b*. A card 10 may enter the switching apparatus 1506 through the first set of guide rollers 1702*a* and the guide plates 1704. When a card enters the switching apparatus 1506, the switching apparatus 1506 may be in a first position illustrated in FIG. 17A. In the first position the first set of guide rollers 1702*a*, the guide plates 1704, and the second set of guide rollers 1702*b* may be in substantially aligned with the transition rollers 1504 (FIG. 15), such as a parallel orientation, such that the card 10 may pass through the transition rollers 1504, over the card-imaging system 604, and into the switching apparatus 1506.

After the card 10 is positioned within the switching apparatus 1506, the switching apparatus 1506 may rotate about an axis of rotation 1712. The axis of rotation 1712, may be located at a point along the path of the card 10. For example, the axis of rotation 1712, may be located at a central point in the switching apparatus 1506, such as between the guide plates 1704. In some embodiments, the switching apparatus 1506 may rotate similar to the embodiment of the switching apparatus 1506 illustrated in FIG. 16, such that the first set of guide rollers 1702*a* substantially align with the insertion rollers 1508, enabling the card 10 to be input into the shuffling apparatus through the insertion rollers 1508. As above, during the rotation, the card may be held in one or both sets of guide rollers 1702*a*, 1702*b*, in the guide plates 1604, or combinations thereof.

Locating the axis of rotation 1712 along the path of the card 10 may enable the switching apparatus 1506 to flip the card 10 (e.g., rotate the card 10 180 degrees) relative to another component along the path of the card 10 and maintain the card 10 in substantially the same position relative to the other components along the path of the card 10. For example, the switching apparatus 1506 may rotate (e.g., counterclockwise relative to FIGS. 17A-17C) about the axis of rotation 1712 past the insertion rollers 1508 to a second position illustrated in FIG. 17B. For example, if the card-imaging system 604 detects a flipped card the switching apparatus 1506 may rotate past the insertion rollers 1508 to flip the card relative to the insertion rollers 1508. The switching apparatus 1506 may proceed to rotate until the second set of guide rollers 1702*b* are substantially aligned with the insertion rollers 1508 as illustrated in FIG. 17C. The card 10 may thereby be flipped 180 degrees relative to the insertion rollers 1508. In some embodiments, the switching apparatus may rotate to the position illustrated in FIG. 17C by rotating in an opposite direction (e.g., clockwise relative to FIGS. 17A-17C), such that the second set of guide rollers 1702*b* may be substantially aligned with the insertion rollers after a rotation of less than 180 degrees.

In some embodiments, the insertion rollers 1508 may be substantially horizontally aligned with the transition rollers 1504, first set of guide rollers 1702*a*, second set of guide rollers 1702*b*, and the guide plates 1704 such that the card 10 may pass from the transition rollers 1504 through the switching apparatus 1506 to the insertion rollers 1508 without rotating the switching apparatus 1506. The switching apparatus 1506 may rotate 180 degrees about the axis of rotation 1712 to correct flipped cards before passing the cards to the insertion rollers 1508.

In some embodiments, the switching apparatus 1506 may be configured to rotate a flipped card about 180 degrees about the axis of rotation 1712 relative to the transition rollers 1504 and/or the card-imaging system 604. The switching apparatus 1506 may then feed the card 10 in reverse over the card-imaging system 604. The card-imaging system 604 may image the card 10 a second time to verify that flipping the card 10 corrected the orientation of the card 10. For example, the card-imaging system 604 may identify an unrecognized card as a flipped card because the back side of the card 10 was imaged where there is no identifying markings. Other cards may also be unrecognized due to the absence of identifying markings such as jokers, promotional cards, cut cards, etc. The other cards may lack identifying markings on both sides of the cards. Therefore, passing the card 10 over the card-imaging system 604 a second time may enable the card-imaging system to identify and/or separate unrecognizable cards from flipped cards.

Referring also to FIG. 15, in some embodiments, the switching apparatus 1506 may be located adjacent the exit rollers 1512. For example, the cards may be removed from the card intake area 202 by a set of pick-off rollers 1502. One or more sets of transition rollers 1504 may transfer the cards from the pick-off rollers 1502 to the insertion rollers 1508 and/or the packer arm 1510 for insertion into the card-shuffling apparatus 114. After being shuffled in the card-shuffling apparatus 114, the card may be removed from the card-shuffling apparatus 114 through exit rollers 1512 and transferred into the switching apparatus 1506. The switching apparatus 1506 may then selectively rotate the cards and insert the cards into the card outlet 204.

In some embodiments, the switching apparatus 1506 may be configured to correct an orientation of the cards. For example, if a card is unrecognizable, the switching apparatus 1506 may be configured to invert the card and return the card to the imaging system 604 to verify that the orientation was corrected.

Figure 18:
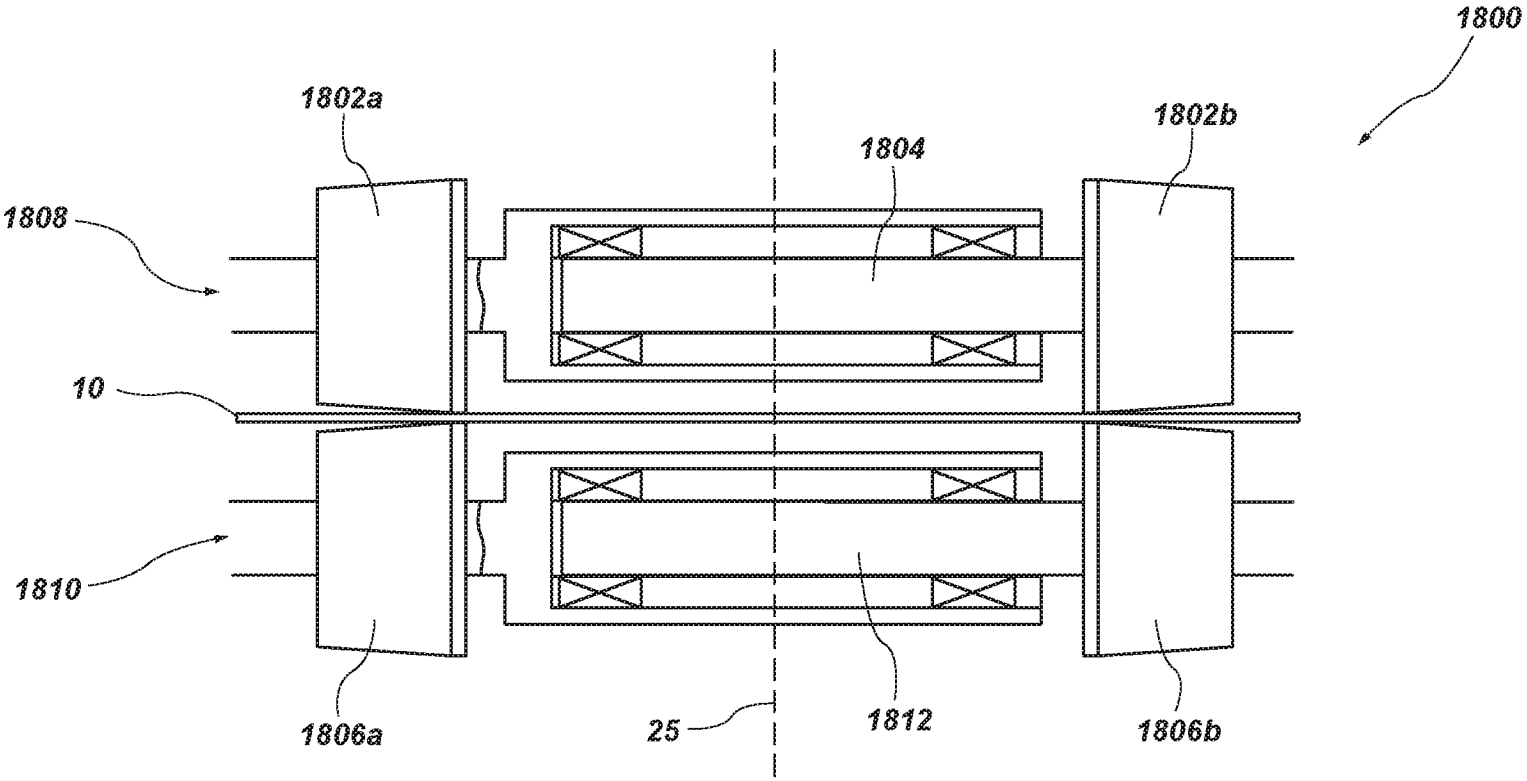
FIG. 18 shows an enlarged view of a roller set from an elevational front view.

FIG. 18 illustrates an enlarged front view of a roller set 1800. The roller set 1800 may be positioned in a card handling device (e.g., card-handling devices 100, 1500) between the card infeed area 1502 and the card outlet 204. For example, the roller set 1800 may be part of the switching apparatus 1506, may be positioned proximate, and/or may replace a pair of the transition rollers 1504 (FIG. 15) positioned between the card infeed area 1502 and the card-shuffling apparatus 114. In another example, the roller set 1800 may be positioned between the card-shuffling apparatus 114 and the card outlet 204, for example, where cards are unloaded one at a time from the card-shuffling apparatus 114 or another type or randomization device.

The roller set 1800 may include a primary roller 1808 and a secondary roller 1810. The primary roller 1808 may include a first wheel 1802*a* and a second wheel 1802*b* separated by a shaft 1804. The secondary roller 1810 may include a first wheel 1806*a* and a second wheel 1806*b* separated by a shaft 1812. In some embodiments, the first wheels 1802*a*, 1806*a* and the second wheels 1802*b*, 1806*b* may be configured to move independently. For example, when receiving a card 10 into the roller set 1800 or transporting the card 10 from the roller set 1800, the first wheels 1802*a*, 1806*a* and the second wheels 1802*b*, 1806*b* may move in substantially the same direction such that the card 10 moves along a substantially straight path into or out of the roller set 1800. The roller set 1800 may be configured to rotate the card 10 about a minor axis 25 of the card 10. When rotating the card 10 the first wheels 1802*a*, 1806*a* may rotate in a direction opposite the rotation of the second wheels 1802*b*, 1806*b* such that the card 10 rotates about the minor axis 25. In some embodiments, the one or more first wheels 1802*a*, 1806*a* or the second wheels 1802*b*, 1806*b* may be driven (e.g., by a motor) during rotation of the card 10 while the other set of wheels are not driven (e.g., rotate freely).

Figure 19B:
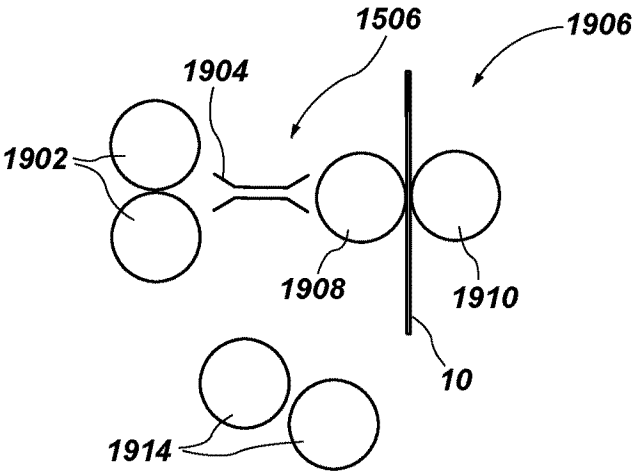
FIG. 19B shows an enlarged view of the switching apparatus of FIG. 19A in a second orientation.
Figure 19A:
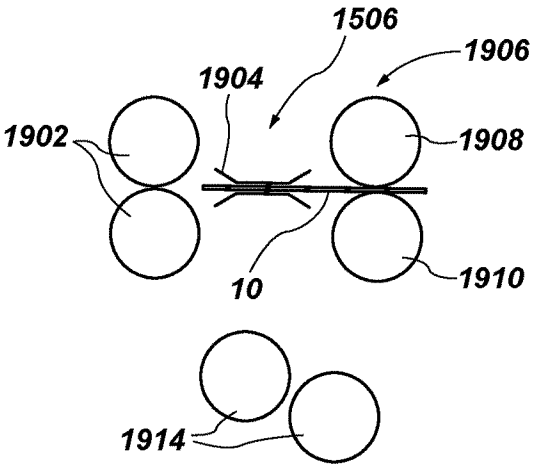
FIG. 19A shows an enlarged view of a switching apparatus according to an embodiment of the present disclosure.
Figure 19D:
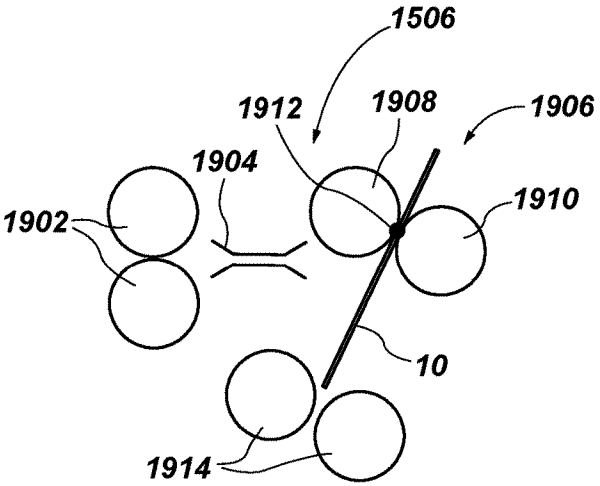
FIG. 19D shows an enlarged view of the switching apparatus of FIGS. 19A, 19B, and 19C in a fourth orientation.
Figure 19C:
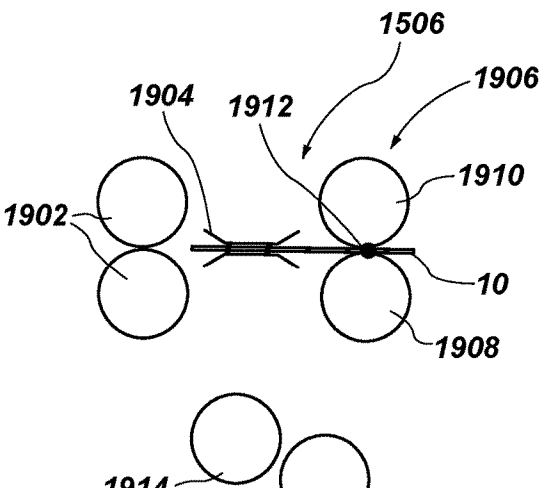
FIG. 19C shows an enlarged view of the switching apparatus of FIGS. 19A and 19B in a third orientation.

FIGS. 19A, 19B, and 19C illustrate another embodiment of a switching apparatus 1506. The switching apparatus 1506 may include guide rollers 1902 and one or more guide plates 1904. The switching apparatus 1506 may also include a switching roller set 1906. The switching roller set 1906 may include a first directional roller 1908 and a second directional roller 1910. A card 10 may enter the switching apparatus 1506 through at least one of the guide rollers 1902 and the guide plates 1904. When a card enters the switching apparatus 1506, the switching roller set 1906 may be in a first position illustrated in FIG. 19A. In the first position the switching roller set 1906 may be in substantially the same orientation as the guide rollers 1902, such as a parallel orientation, such that the card 10 may pass through the guide rollers 1902 and/or the guide plates 1904 and into the switching roller set 1906.

After the card 10 passes through the guide rollers 1902 and/or the guide plates 1904, the switching roller set 1906 may drive the card 10 into the switching roller set 1906 until the card 10 is no longer in the guide rollers 1902 or the guide plates 1904 (e.g., no longer contacting the guide rollers 1902 or the guide plates 1904). Once the card is no longer in the guide rollers 1902 or the guide plates 1904, the first directional roller 1908 and second directional roller 1910 may move relative to the guide rollers 1902 and/or guide plates 1904 such that an orientation of the card 10 is changed. For example, the first directional roller 1908 and the second directional roller 1910 may rotate relative to an axis 1912 between the first directional roller 1908 and the second directional roller 1910 rotating the card 10 relative to the axis 1912. The first directional roller 1908 and the second directional roller 1910 may continue to move the card 10 through a second position, illustrated in FIG. 19B, where the card 10 and the switching roller set 1906 are in a substantially perpendicular orientation relative to the guide rollers 1902 and the guide plates 1904.

The first directional roller 1908 and the second directional roller 1910 may further move relative to guide rollers 1902 and the guide plates 1904 until the switching roller set 1906 is in substantially the same orientation (e.g., where a direction of intended card travel is in the same orientation or plane) as guide rollers 1902 and the guide plates 1904 in a third position, as illustrated in FIG. 19C, wherein the card 10 has been inverted (e.g., rotated) 180°. The switching roller set 1906 may then transport the card 10 from the switching roller set 1906 back through the guide rollers 1902 and the guide plates 1904 to the card-imaging system 604.

If the card 10 is in the correct orientation, the switching roller set 1906, the switching roller set 1906 may rotate about the axis 1912 with the card 10 until the switching roller set 1906 is in substantially the same orientation (e.g., where a direction of intended card travel is in the same orientation or plane) as the insertion rollers 1908, as illustrated in FIG. 19D. The switching roller set 1906 may then transport the card 10 from the switching roller set 1906 to the insertion rollers 1908. The insertion rollers 1908 may then facilitate the insertion of the card 10 into the card-shuffling apparatus 114. For example, the switching roller set 1906 may change an orientation of the card 10 to match an orientation of the insertion rollers 1908 for insertion into the card shuffling apparatus 114.

In some embodiments, the insertion rollers 1908 may be substantially horizontally aligned with the switching roller set 1906. For example, in the card-handling device 100, illustrated in FIGS. 3-12, the pick-off rollers 610 may be substantially horizontally aligned with a switching roller set 1906 and insertion rollers 1908 such that the card 10 may pass through the switching roller set 1906, the insertion rollers 1908, and into the shuffling apparatus in a substantially horizontal configuration unless the card 10 is flipped by the switching roller set 1906. As described above, if the card-imaging system 604 detects an unrecognized card or flipped card, the card 10 may enter the switching roller set 1906 and the switching roller set 1906 may rotate the card 10 (e.g., about 180 degrees) about the axis 1912 and feed the card 10 in reverse over the card-imaging system 604. After the card 10 is imaged the second time the card may feed through the switching roller set 1906 and into the insertion rollers 1914.

Figure 20:
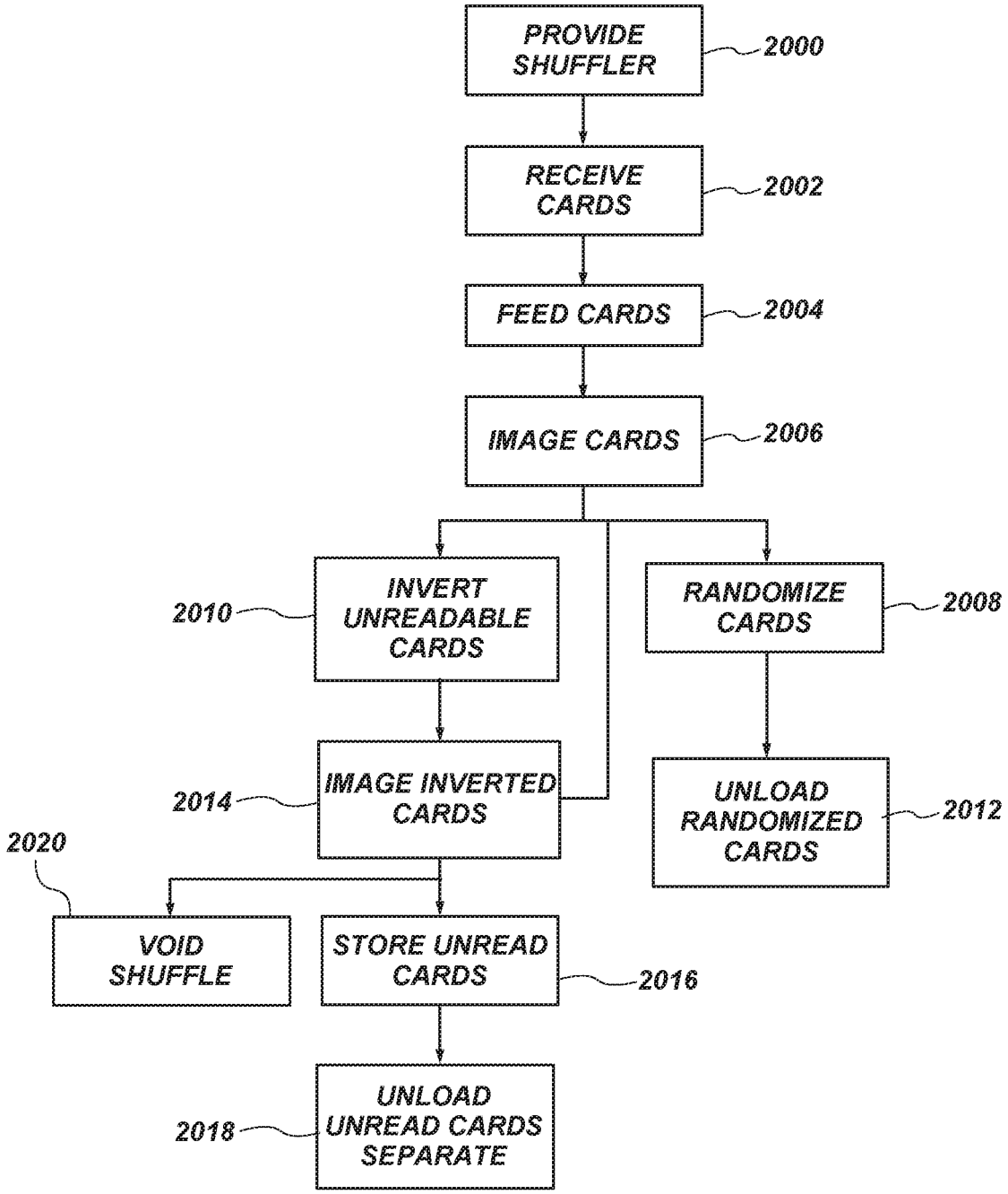
FIG. 20 is a process diagram for the shuffling of playing cards according to an embodiment of the present disclosure.

FIG. 20 is a process flow diagram illustrating acts of an example method of altering a face orientation of cards being shuffled in an automatic card shuffler is illustrated. The method comprises the act of providing an automatic card shuffler at operation 2000. The example shuffler may include a user display, a card intake, a card outlet, a card-shuffling apparatus, a card path between the card intake and the card output, a card imaging system, and a processor for controlling the card imaging system, the user display and an operation of the card shuffler, such as the embodiments described above with respect to FIG. 3 through 12 and 15 through 18. In some embodiments, the card-shuffling apparatus may include multiple compartments, wherein at least one compartment is designated for receiving cards that the imaging system has identified as lacking card face information. In some embodiments, card face information may include conventional rank and suit symbols, conventional rank or suit symbols or a special marking indicating rank and suit, or a special marking indicating rank or suit value. Examples of special markings include infrared (IR) ink markings, nano markings, barcode markings, encrypted codes, unencrypted codes, and the like.

For purposes of this disclosure, card imaging systems that are capable of reading a card back, or a card imaging system that is incapable of reading a card back are referred to as a card imaging system that failed to read card face data. Cards that were not recognized as having card face markings for purposes of this disclosure are unimaged cards. These cards can be flipped cards, cut cards, promotional cards, jokers, damaged cards, unreadable cards, and/or any other cards that do not belong in the card set.

In some embodiments, a plurality of cards may be received in the card intake area of a card shuffler at operation 2002. The card shuffler may be configured to shuffle cards. The shuffler may operate as a batch shuffler or a continuous shuffler. The cards inputted for shuffling may be arranged in a stack, such as a vertical stack with card faces located in horizontal planes. In other examples, the stack may be horizontal, with card faces located in vertical planes. In additional embodiments, the stack may be tipped with respect to the vertical slightly to stabilize the stack. The cards are generally arranged face-to-back, but there may be one or more cards in the stack that are oriented in a face-to-face orientation with an adjacent card. In other words, in the process of gathering cards from the gaming table, the dealer may fail to reorient all cards face-down before inserting the cards into a discard rack or into the card intake area of the shuffler.

Each card may be individually fed from the stack into the card shuffler automatically at operation 2004. For example, cards may be individually fed from one end of the stack, such as from the bottom of the stack when the stack of card is vertical. In some embodiments, cards may be removed with blades from the center of the stack. The blades may randomly select a location in the stack to eject the card.

At operation 2006, cards may be imaged. An example of a suitable card imaging device is described in detail above. The cards may be imaged in the card infeed area, along the card path or if cards are moved out of the shuffling apparatus individually, between the shuffling apparatus and the card output area.

Card face information may be read at operation 2006 by the card imaging system. In some embodiments, at least a portion of a card face of each card is read as the card is being fed into the shuffling apparatus. In some embodiments, cards are read between the card infeed area and the card-shuffling mechanism from an elevation beneath a horizontal card path. In other embodiments, the bottom card is read while in the stationary position in the card infeed area. In some embodiments, card faces are oriented face-down on the card path, and cards are read as they move. In other embodiments, cards are read before movement, or are caused to pause at a card reading station and are imaged when the card is stationary.

Cards may move individually along the card path after imaging and may then be shuffled at operation 2008 by a card-shuffling apparatus. For example, at operation 2008, cards that have recognizable card face information may be inserted into randomly or pseudo-randomly selected compartments in the card-shuffling apparatus. In one example, cards may be fed individually into a compartment of a shuffling carousel. In some embodiments, the cards may be fed into the compartment using horizontally aligned rollers. In some embodiments, the cards may be reoriented for insertion into the compartment by switching rollers. The carousel may be configured to rotate about horizontal axis and may be driven with a drive mechanism such as a stepper motor. The particulars of an example card-shuffling mechanism are described above.

As described above, when a card face is not recognized by the card imaging system, indicating at a minimum that there is a problem with a card, the processor directs the card-shuffling mechanism to handle that card differently as compared to the other cards being shuffled. At operation 2010, cards that are unimaged may be inverted by a mechanism in the card-shuffling mechanism. For example, a set of switching rollers may invert the card as described above. The inverted card may be fed back into the imaging mechanism and imaged again in operation 2014. If the inverted card is read successfully, the inverted card may continue through the normal process. All cards that were read (and recognized) to identify at least one of rank or suit may be handled in a manner such that the cards are randomly or pseudo-randomly shuffled at operation 2008. For example, under processor control, all readable cards may be randomly inserted into randomly selected compartments.

If the inverted card remains unreadable, the inverted card may be a card that does not include rank and suit such as a cut card, promotional card, Joker, and/or any other card that does not belong in the card set. In some embodiments, if the inverted card remains unreadable, the unreadable card may be stored in a designated compartment of the carousel in operation 2016. In some embodiments, if the inverted card remains unreadable, the card-shuffling mechanism may automatically void the shuffle in operation 2020 or may dispense the card to the inlet or outlet of the shuffling device.

In some embodiments, when all cards in the card input area have been randomly or pseudo-randomly distributed to a compartment, the card-shuffling apparatus may begin a card unloading process by moving groups of imaged cards from the compartments into a card output area as shown in operation 2012. The unloading process can be done randomly or sequentially. Sequential unloading causes the shuffling operation to be performed at a faster speed as opposed to using randomly selected compartment unloading procedures. Random unloading, on the other hand increases randomness.

All readable, randomized cards may be unloaded into the card outlet. In some embodiments, a stack of shuffled cards may be formed in the card outlet, with each card in the stack in a face-to-back orientation. In some embodiments, the stack may be substantially horizontal with card faces in a substantially vertical plane. In other embodiments, the stack may be substantially vertical with the card faces in a substantially horizontal plane.

At the end of the card distribution process, if any unreadable cards are present in a designated compartment of the shuffling mechanism, those cards may be unloaded last at operation 2018 from the at least one designated compartment. The processor may direct the display to issue a warning or an alert at operation that there are cards in the card output that are unreadable.

Any cards delivered to the card output area should be examined to determine if they are cut cards, flipped cards or extraneous cards. The dealer may then remove any cards that do not belong in the deck.

The embodiments of the disclosure may enable a continuous shuffler and/or batch shuffler to handle a non-conforming card such as a flipped card, Joker, promotional card, cut card, damaged card, unreadable card, etc., without aborting or voiding the shuffle. Aborting a shuffle may add time between games. Longer time period between games may result in fewer games being played at each table. Therefore, the ability to avoid unnecessarily aborting or voiding a shuffle may enable more games to be played at each table, which may increase revenue of the gaming establishment.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternate useful combinations of the elements described, will become apparent to those skilled in the art from the description. Such modifications and embodiments also fall within the scope of the appended claims and equivalents.

What is claimed is:

1. A card-handling device comprising:

a card intake configured to receive playing cards;

a card output configured to provide at least some of the playing cards to a user;

a card imaging device positioned between the card intake and the card output configured to identify whether a card face of the at least some of the playing cards is positioned in an expected orientation or whether the card face is in an unexpected orientation comprising one or more flipped cards; and a card-flipping apparatus configured to reorient the one or more flipped cards in order to return the card face of the one or more flipped cards to the expected orientation.

2. The card-handling device of claim 1, wherein the card-flipping apparatus comprises one or more rollers configured to secure the one or more flipped cards while the one or more flipped card is rotated to alter an orientation of the card face.

3. The card-handling device of claim 2, wherein at least one of the one or more rollers is configured to change a position with respect to another one or more stationary rollers of the one or more rollers.

4. The card-handling device of claim 2, wherein each of the one or more rollers comprises a set of opposing rollers configured to pass the playing cards between the set of opposing rollers.

5. The card-handling device of claim 1, wherein the card-flipping apparatus is configured to rotate the one or more flipped cards about 180 degrees to invert a position of the card face of the one or more flipped cards comprising indicia of a rank and/or suit and a back face of the one or more flipped cards that lacks the indicia of the rank and/or suit.

6. The card-handling device of claim 1, wherein the card-flipping apparatus is configured to rotate the one or more flipped cards between a substantially face down orientation and a substantially face up orientation.

7. The card-handling device of claim 6, wherein the card imaging device is configured to detect the one or more flipped cards being positioned in the unexpected orientation comprising the substantially face up orientation, and wherein the card-flipping apparatus is configured to reorient the one or more flipped card to the expected orientation comprising the substantially face down orientation in response to the detection by the card imaging device.

8. The card-handling device of claim 1, wherein the card-flipping apparatus is configured to insert the one or more playing cards into a card-shuffling apparatus after reorienting the card face of the one or more flipped cards.

9. The card-handling device of claim 1, wherein the card-flipping apparatus comprises one or more rollers, wherein the card-handling device is configured to rotate the one or more rollers with at least one of the playing cards held in the one more roller in a first direction of rotation when the card face is in the expected orientation and is configured to rotate the one or more rollers with the at least one of the playing cards held in the one more roller in a second direction of rotation opposite the first direction of rotation when the card face is in the unexpected orientation.

10. The card-handling device of claim 9, wherein the card-handling device is configured to receive the at least one of the playing cards in the one or more rollers in a first direction and, after rotating the one or more rollers to remove the at least one of playing card in a second direction reverse to the first direction.

11. The card-handling device of claim 1, wherein the card-flipping apparatus is configured to rotate one or more of the playing cards about a minor axis of the one or more playing cards, wherein the minor axis extends in a direction substantially perpendicular to the card face.

12. A method of handling flipped cards comprising:

receiving one or more playing cards in a card input of a card-handling device;

transporting the one or more playing cards from the card input to a card-shuffling apparatus of the card-handling device;

imaging the one or more playing cards with an imaging apparatus between the card input and the card-shuffling apparatus;

identifying flipped cards of the one or more playing cards with the imaging apparatus;

inverting the flipped cards in a card-flipping apparatus;

supplying the one or more playing cards to the card-shuffling apparatus; and outputting at least some of the one or more playing cards from the card-shuffling apparatus.

13. The method of claim 12, further comprising imaging the flipped cards with the imaging apparatus a second time after inverting the flipped cards in the card-flipping apparatus.

14. The method of claim 13, further comprising identifying unauthorized cards after imaging the flipped cards the second time, wherein the unauthorized cards do not include identifying information on a front side or a back side of the unauthorized cards.

15. The method of claim 14, further comprising at least one of:

placing the unauthorized cards in a designated location in the card-shuffling apparatus; or outputting the unauthorized cards separate from the card-shuffling apparatus.

16. The method of claim 12, wherein identifying the flipped cards comprises identifying cards that do not include identifying value information on a side of the cards facing the imaging apparatus.

17. The method of claim 12, wherein inverting the flipped cards comprises rotating the flipped card about 180 degree until positons of major faces of the flipped cards are reversed.

18. The method of claim 12, wherein inverting the flipped cards comprises:

receiving the flipped cards in a set of opposing rollers; and rotating the set of opposing rollers about an axis between the set of opposing rollers and substantially parallel with an axis of each roller of the set of opposing rollers.

19. The method of claim 12, further comprising rotating at least one card of the one or more playing cards about a minor axis, wherein the minor axis extends in a direction substantially perpendicular to a face of the at least one card.

20. A method of handling non-conforming cards, comprising:

receiving cards into a card-handling device at a card input;

imaging the cards as the cards are transported between the card input and a card output the card-handling device;

identifying non-conforming cards;

placing the non-conforming cards in a designated location in a card-shuffling apparatus;

shuffling an order of the cards in the card-shuffling apparatus;

outputting at least one card to the card output after the at least one card has been shuffled by the card-shuffling apparatus; and outputting the non-conforming cards from the designated location separately from the cards.

21. The method of claim 20, wherein shuffling an order of the cards comprises randomizing the cards in the card-shuffling apparatus comprising a carousel comprising multiple compartments, and wherein placing the non-conforming cards in the designated location comprise moving the non-conforming cards into one or more of the multiple compartments.

22. The method of claim 20, further comprising voiding a shuffling operation if more than 10 of the non-conforming cards are identified.

* * * * *